US011562756B2

(12) United States Patent
Disch et al.

(10) Patent No.: US 11,562,756 B2
(45) Date of Patent: Jan. 24, 2023

(54) APPARATUS AND METHOD FOR POST-PROCESSING AN AUDIO SIGNAL USING PREDICTION BASED SHAPING

(71) Applicant: Fraunhofer-Gesellschaft zur Förderung der angewandten Forschung e.V., Munich (DE)

(72) Inventors: Sascha Disch, Fürth (DE); Christian Uhle, Ursensollen (DE); Jürgen Herre, Erlangen (DE); Peter Prokein, Erlangen (DE); Patrick Gampp, Erlangen (DE); Antonios Karampourniotis, Nuremberg (DE); Julia Havenstein, Nuremberg (DE); Oliver Hellmuth, Buckenhof (DE); Daniel Richter, Ludwigsburg (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 481 days.

(21) Appl. No.: 16/573,519

(22) Filed: Sep. 17, 2019

(65) Prior Publication Data

US 2020/0013421 A1 Jan. 9, 2020

Related U.S. Application Data

(63) Continuation of application No. PCT/EP2018/025084, filed on Mar. 29, 2018.

(30) Foreign Application Priority Data

Mar. 31, 2017 (EP) ..... 17164332
Jul. 25, 2017 (EP) ..... 17183135

(51) Int. Cl.
*G10L 19/00* (2013.01)
*G10L 19/03* (2013.01)
(Continued)

(52) U.S. Cl.
CPC ..... *G10L 19/03* (2013.01); *G10L 19/025* (2013.01); *G10L 19/26* (2013.01)

(58) Field of Classification Search
CPC ... G10L 19/025; G10L 19/022; G10L 19/028; G10L 19/03; G10L 19/032; G10L 19/035;
(Continued)

(56) References Cited

U.S. PATENT DOCUMENTS 5,226,083 A * 7/1993 Taguchi ..... G10L 19/08 704/219
5,825,320 A 10/1998 Miyamori et al.
(Continued)

FOREIGN PATENT DOCUMENTS

CN 101553870 A 10/2009
CN 103477387 A 12/2013
(Continued)

OTHER PUBLICATIONS

J. Herre, E. Allamanche, K. Brandenburg, M. Dietz, B. Teichmann, and B. Grill, "The Integrated Filterbank Based Scalable MPEG-4 Audio Coder," Paper 4810, (Sep. 1998.) (Year: 1998).*
(Continued)

*Primary Examiner* — Edgar X Guerra-Erazo
(74) *Attorney, Agent, or Firm* — McClure, Qualey & Rodack, LLP

(57) ABSTRACT

What is described is an apparatus for post-processing an audio signal, having: a time-spectrum-converter for converting the audio signal into a spectral representation having a sequence of spectral frames; a prediction analyzer for calculating prediction filter data for a prediction over frequency
(Continued)

within a spectral frame; a shaping filter controlled by the prediction filter data for shaping the spectral frame to enhance a transient portion within the spectral frame; and a spectrum-time-converter for converting a sequence of spectral frames having a shaped spectral frame into a time domain.

20 Claims, 48 Drawing Sheets

(51) Int. Cl.
*G10L 19/025* (2013.01)
*G10L 19/26* (2013.01)

(58) Field of Classification Search
CPC ..... G10L 19/038; G10L 2021/02082; G10L 21/02; G10L 21/003; G10L 21/00; G10L 19/06; G10L 19/07; G10L 19/083; G10L 19/087; G10L 19/09; G10L 19/093; G10L 19/097; G10L 19/10; G10L 19/113; G10L 21/007; G10L 21/01; G10L 21/013; G10L 21/0208; G10L 2021/02085; G10L 2021/02087; G10L 21/0216; G10L 2021/02161; G10L 2021/02166; G10L 2021/02165; G10L 2021/02163; G10L 21/0224; G10L 21/0232; G10L 21/0264; G10L 21/028; G10L 21/0308; G10L 21/0316; G10L 21/0332; G10L 21/034; G10L 21/0364; G10L 21/038; G10L 21/04; G10L 21/043; G10L 21/047; G10L 21/049; G10L 21/12; G10L 21/14; G10L 21/16; G10L 25/00; G10L 25/03; G10L 25/06; G10L 25/09; G10L 25/12; G10L 25/15; G10L 25/18; G10L 25/21; G10L 25/24; G10L 25/27; G10L 25/60; G10L 25/51; G10L 25/69; G10L 25/72; G10L 25/75; G10L 25/78; G10L 2025/783; G10L 2025/786; G10L 25/81; G10L 25/84; G10L 25/87; G10L 25/90; G10L 2025/906; G10L 2025/932; G10L 2025/935; G10L 2025/937; G10L 25/93; G10L 19/02; G10L 19/008; G10L 19/0208; G10L 19/0212; G10L 19/24; G10L 19/26; H04S 1/007; H04S 2400/09; H04S 2400/05; H04S 2400/03; H04S 2400/01; H04S 2400/00; H04S 2400/15; H04S 2400/13; H04S 2420/03; H04S 2420/07; H04S 2420/11; H04S 2420/13
See application file for complete search history.

(56) References Cited

U.S. PATENT DOCUMENTS

| | | | | |
|---|---|---|---|---|
| 5,913,191 | A | 6/1999 | Fielder | |
| 5,933,801 | A | 8/1999 | Fink et al. | |
| 6,263,312 | B1 | 7/2001 | Kolesnik et al. | |
| 6,842,733 | B1 * | 1/2005 | Gao | G10L 19/265 704/E19.041 |
| 9,026,236 | B2 | 5/2015 | Ishikawa et al. | |
| 9,489,964 | B2 | 11/2016 | Kovesi et al. | |
| 10,373,623 | B2 | 8/2019 | Dittmar et al. | |
| 2002/0120445 | A1 | 8/2002 | Vafin et al. | |
| 2003/0115052 | A1 | 6/2003 | Chen et al. | |
| 2004/0008615 | A1 | 1/2004 | Oh | |
| 2005/0165611 | A1 | 7/2005 | Mehrotra et al. | |
| 2009/0012797 | A1 | 1/2009 | Boehm et al. | |
| 2010/0017213 | A1 | 1/2010 | Edler et al. | |
| 2011/0004479 | A1 | 1/2011 | Ekstrand et al. | |
| 2011/0178795 | A1 | 7/2011 | Bayer et al. | |
| 2012/0010879 | A1 | 1/2012 | Tsujino et al. | |
| 2012/0051549 | A1 | 3/2012 | Nagel et al. | |
| 2012/0224703 | A1 | 9/2012 | Kishi et al. | |
| 2013/0332153 | A1 | 12/2013 | Markovic et al. | |
| 2014/0257824 | A1 | 9/2014 | Taleb et al. | |
| 2014/0310011 | A1 | 10/2014 | Biswas et al. | |
| 2015/0106108 | A1 | 4/2015 | Baeckstroem et al. | |
| 2015/0170668 | A1 | 6/2015 | Kovesi et al. | |
| 2015/0287417 | A1 | 10/2015 | Disch et al. | |
| 2015/0332695 | A1 | 11/2015 | Doehla et al. | |
| 2015/0348561 | A1 | 12/2015 | Kovesi et al. | |
| 2016/0050420 | A1 | 2/2016 | Helmrich et al. | |
| 2017/0117000 | A1 | 4/2017 | Kikuiri et al. | |
| 2017/0162208 | A1 | 6/2017 | Soulodre | |
| 2017/0178648 | A1 | 6/2017 | Schug et al. | |
| 2018/0358028 | A1 | 12/2018 | Biswas | |

FOREIGN PATENT DOCUMENTS

| | | | | |
|---|---|---|---|---|
| CN | 105122357 | A | 12/2015 | |
| EP | 2 717 261 | A1 | 4/2014 | |
| EP | 2 830 054 | A1 | 1/2015 | |
| EP | 2916321 | A1 | 9/2015 | |
| EP | 2 980 798 | A1 | 2/2016 | |
| EP | 3 125 243 | A1 | 2/2017 | |
| EP | 3382700 | A1 * | 10/2018 | G10L 19/02 |
| EP | 3382701 | A1 * | 10/2018 | G10L 19/025 |
| FR | 2888704 | A1 | 1/2007 | |
| JP | 2001-521259 | A | 11/2001 | |
| JP | 2011034046 | A1 | 2/2011 | |
| JP | 2012-053493 | A | 3/2012 | |
| JP | 2015-525893 | A | 9/2015 | |
| JP | 2015184470 | A1 | 10/2015 | |
| JP | 2016502139 | A | 1/2016 | |
| JP | 2016506543 | A | 3/2016 | |
| RU | 2607418 | C2 | 8/2016 | |
| RU | 2607263 | C2 | 10/2016 | |
| WO | 2007/006958 | A2 | 3/2007 | |
| WO | 2008/052627 | A1 | 5/2008 | |
| WO | 2011/048792 | A1 | 4/2011 | |
| WO | 2013/075753 | A1 | 5/2013 | |
| WO | 2013136846 | A | 9/2013 | |

OTHER PUBLICATIONS

Lapierre, J., Lefebvre, R., Mabilleau, P., & Plourde, É. (2016). Amélioration de Codecs Audio Standardisés Avec Maintien de L'interopérabilité (Doctoral dissertation, Université de Sherbrooke) (Year: 2016).*

O. A. Niamutand R. Heusdens, "RD Optimal Temporal Noise Shaping for Transform Audio Coding," 2006 IEEE International Conference on Acoustics Speech and Signal Processing Proceedings, 2006, pp. V-V. (Year: 2006).*

Lapierre, J., Lefebvre, R., Mabilleau, P., & Plourde, É. (2016). Amélioration de Codecs Audio Standardisés Avec Maintien de L'interopérabilité (Doctoral dissertation, Université de Sherbrooke) (French-to-English Translation) (Year: 2016).*

Office Action in the parallel Japanese patent application No. 2019-553965, dated Dec. 10, 2020, with English Translation.

Office Action in the parallel Japanese patent application No. 2019-55397, dated Dec. 10, 2020, with English Translation.

Suresh Babu, V., Malot, A. Vijayachandran, V.,& amp; Vinay, M. (May 1, 2004). "Transient Detection for Transform Domain Coders"; Audio engineering Society Convention Paper, pp. 1-5. Retreived Nov. 16, 2020, from http://www.aes.org/e-lib/browse.cfm?elib=12735 (Year: 2004).

Laurenti, N., De Poli, G., & amp; Montagner, D. (Feb. 2007) "A Nonlinear Method for Stochastic Spectrum Estimation in the Modeling of Musical Sounds"; IEEE Transactions on Audio, Speech, and Language Processing, vol. 15, No. 2, pp. 531-541. Retreived Nov. 12, 2020, from http://ieeexplore.ieee.org/document/4067043 (Year 2007).

USPTO Non-Final Office Action, dated Dec. 15, 2020, in U.S. Appl. No. 16/580,203.

(56) References Cited

OTHER PUBLICATIONS

Intention to grant in the parallel European patent application No. 18714684.0, dated Mar. 17, 2021.
Russian Office Action dated Apr. 7, 2020, issued in application No. 2019134577.
Russian Office Action dated Apr. 21, 2020, issued in application No. 2019134632.
Japanese language office action dated Sep. 9, 2021, issued in application No. JP 2019-553965.
English language translation of office action dated Sep. 9, 2021, issued in application No. JP 2019-553965.
International Search Report dated May 17, 2018, issued in application No. PCT/EP2018/025084.
Brandenburg, K.; "MP3 and AAC explained;" Aud. Eng. Soc. Conf.: 17th Int. Conf.: High-Quality Audio Coding; Sep. 1999; pp. 1-12.
Brandenburg, K., et al.; "ISO/MPEG-1 audio: A generic standard for coding of high-quality digital audio;" J. Aud. Eng. Soc.; vol. 42; Oct. 1994; pp. 780-792.
ISO/IEC 11172-3; "Information Technology: Coding of moving pictures and associated audio for digital storage media at up to about 1.5 mbit/s—part 3: Audio;" international standard; Aug. 1993; pp. 1-158.
ISO/IEC 13818-1; "Information technology—generic coding of moving pictures and associated audio information: Systems;" international standard, ISO/IEC, ISO/IEC JTC1/SC29; 2000; pp. 1-174.
Herre, J., et al.; "Enhancing the performance of perceptual audio coders by using temporal noise shaping (TNS);" 101st Aud. Eng. Soc. Conv., No. 4384, AES; Nov. 1996; pp. 1-25.
Edler, B.; "Codierung von Audiosignalen mit überlappender Transformation und adaptiven Fensterfunktionen;" Frequenz—Zeitschrift für Telekommunikation, vol. 43; Sep. 1989; pp. 253-256.
Samaali, I, et al.; "Temporal envelope correction for at- tack restoration im low bit-rate audio coding;" 17th European Signal Processing Conf. (EUSIPCO), (Glasgow, Scotland), IEEE; Aug. 2009; pp. 1-5.
Lapierre, J., et al.; "Pre-echo noise reduction in frequency-domain audio codecs;" 42nd IEEE Int. Conf. on Acoustics, Speech and Signal Processing, IEEE; Mar. 2017; pp. 686-690.
Benesty, J., et al.; "Springer handbook of speech processing, ch. 7. Linear Prediction;" Berlin: Springer, 2008; pp. 121-134.
Makhoul, J.; "Spectral analysis of speech by linear prediction;" IEEE Trans. on Audio and Electroacoustics, vol. 21, IEEE; Jun. 1973; pp. 140-148.
Makhoul, J.; "Linear prediction: A tutorial review;" Proc. of the IEEE, vol. 63, No. 4, IEEE; Apr. 1975; pp. 561-580.
Athineos, M., et al.; "Frequency-domain linear prediction for temporal features;" IEEE Workshop on Automatic Speech Recognition and Understanding, IEEE; Nov. 2003; pp. 261-266.
Keiler, F., et al.; "Efficient linear prediction for digital audio effects; "COST G-6 Conf. on Digital Audio Effects (DAFX-00), (Verona, Italy), Dec. 2000; pp. 1-6.
Makhoul, J.; "Spectral linear prediction: Properties and applications;" IEEE Trans. on Acoustics, Speech, and Signal Processing, vol. 23, IEEE; Jun. 1975; pp. 283-296.
Painter, T., et al.; "Perceptual coding of digital audio;" Proc. of the IEEE, vol. 88; Apr. 2000; pp. 1-66.
Makhoul, J.; "Stable and efficient lattice methods for linear prediction;" IEEE Trans. on Acoustics, Speech, and Signal Processing, vol. ASSP-25, IEEE; Oct. 1977; pp. 423-428.
Herre, J.; "Temporal noise shaping, qualtization and coding methods in perceptual audio coding: A tutorial introduction;" Aud. Eng. Soc. Conf.: 17th Int. Conf.: High-Quality Audio Coding, vol. 17, AES; Aug. 1999; pp. 1-14.
Schroeder, M.R.; "Linear prediction, entropy and signal analysis;" IEEE ASSP Magazine, vol. 1, Jul. 1984; pp. 3-11.
Daudet, L., et al.; "Transient detection and encoding using wavelet coeffcient trees; "Colloques sur le Traitement du Signal et des Images, Sep. 2001; pp. 1-4.
Edler, B., et al.; "Detection and extraction of transients for audio coding;" Aud. Eng. Soc. Conv. 120, No. 6811; May 2006; pp. 1-8.
Kliewer, J., et al.; "Audio subband coding with improved representation of transient signal segments;" 9th European Signal Processing Conf., vol. 9, IEEE; Sep. 1998; pp. 1-4.
Rodet, X., et al.; Detection and modeling of fast attack transients; Proc. of the Int. Computer Music Conf.; 2001; pp. 30-33.
Bello, J.P., et al.; "A tutorial on onset detection in music signals;" IEEE Trans. on Speech and Audio Processing, vol. 13, No. 5; Sep. 2005; pp. 1035-1047.
Babu, V.S., et al; "Transient detection for transform domain coders;" Aud. Eng. Soc. Conv. 116, No. 6175; May 2004; pp. 1-5.
Masri, P., et al.; "Improved modelling of attack transients in music analysis-resynthesis;" Int. Computer Music Conf.; Jan. 1996; pp. 100-103.
Kwong, M.D., et al.; "Transient detection of audio signals based on an adaptive comb filter in the frequency domain;" in Conf. on Signals, Systems and Computers, 2004. Conf. Record of the Thirty-Seventh Asilomar, vol. 1,; IEEE, Nov. 2003; pp. 542-545.
Zhang, X., et al.; "A transient signal detection technique based on flatness measure;" 6th Int. Conf. on Computer Science and Education, (Singapore), IEEE; Aug. 2011; pp. 310-312.
Johnston, J.D.; "Transform coding of audio signals using perceptual noise criteria;" IEEE Journal on Selected Areas in Communications, vol. 6; Feb. 1988; pp. 314-323.
Herre, J., et al.; "Academic press library in Signal processing;" vol. 4, ch. 28.Perceptual Audio Coding, Academic press; 2014; pp. 757-799.
Fastl, H., et al.; "Psychoacoustics—Facts and Models;" Heidelberg: Springer, 3. ed.; 2007; pp. 1-201.
Moore, B.C.J.; "An Introduction to the Psychology of Hearing;" London: Emerald, 6. ed.; 2012; pp. 1-457.
Brandenburg, K., et al.; "Perceptual coding of high-quality digital audio;" IEEE Trans. on Acoustics, Speech, and Signal Processing, vol. 101, IEEE; Sep. 2013; pp. 1905-1919.
Fletcher, H., et al.; "Loudness, its definition, measurement and calculation;" The Bell System Technical Journal, vol. 12, No. 4; 1933; p. 377-430.
Bosi, M., et al.; "Introduction to Digital Audio Coding and Standards;" Kluwer Academic Publishers, 1. ed.; 2003; pp. 1-426.
Noll, P.; "MPEG digital audio coding;" IEEE Signal Processing Magazine, vol. 14; Sep. 1997; pp. 59-81.
Pan, D.; "A tutorial on MPEG/audio compression;" IEEE MultiMedia, vol. 2, No. 2; 1995; pp. 60-74.
Erne, M., et al.; Perceptual audio coders "what to listen for;" 111st Aud. Eng. Soc. Conv., No. 5489, AES; Sep. 2001; pp. 1-10.
Liu, C.M., et al.; "Compression artifacts in perceptual audio coding;" IEEE Trans. on Audio, Speech, and Language Processing, vol. 16; IEEE, May 2008; pp. 681-695.
Daudet, L.; "A review on techniques for the extraction of transients in musical signals;" Proc. of the Third international conference on Computer Music; Sep. 2005; pp. 219-232.
Lee, W.C., et al.; "Musical onset detection based on adaptive linear prediction;" IEEE Int. Conf. on Multimedia and Expo, IEEE; Jul. 2006; pp. 957-960.
Link, M.; "An attack processing of audio signals for optimizing the temporal characteristics of a low bit-rate audio coding system;" Aud. Eng. Soc. Conv., vol. 95, Oct. 1993; pp. 1-12.
Vaupel, T.; "Ein Beitrag zur Transformationscodierung von Audiosignalen unter Verwendung der Methode der 'Time Domain Aliasing Cancellation (TDAC)' und einer Signalkompandierung im Zeitbereich;" PhD Thesis, Universität-Gesamthochschule Duisburg, Germany, 1991; pp. 1-3, along with translation.
Bertini, G., et al.; "A time domain system for transient enhancement in recorded music;" 14th European Signal Processing Conf. (EUSIPCO); IEEE; Sep. 2006; pp. 1-5.
Duxbury, C., et al.; "A hybrid approach to musical note onset detection;" Proc. of the 5th Int. Conf. on Digital Audio Effects (DAFx-02); Sep. 2002; pp. 33-38.
Klapuri, A.; "Sound onset detection by applying psychoacoustic knowledge;" Proc. of the IEEE Int. Conf. on Acoustics, Speech, and Signal Processing; Mar. 1999; pp. 1-2.

(56) References Cited

OTHER PUBLICATIONS

Goh, S.L., et al.; "Nonlinear adaptive prediction of complex-valued signals by complex-valued PRNN;" IEEE Trans. on Signal Processing, vol. 53, IEEE; May 2005; pp. 1827-1836.
Haykin, S., et al.; "Nonlinear adaptive prediction of nonstationary signals;" IEEE Trans. on Signal Processing, vol. 43, IEEE; Feb. 1995; p. 526-535.
Mandic, D.P., et al.; "Complex-valued prediction of wind profile using augmented complex statistics;" Renewable Energy, vol. 34, Elsevier Ltd.; Jan. 2009; pp. 196-201.
Tohkura, Y., et al.; "Spectral smoothing technique in parcor speech analysis-synthesis;" IEEE Trans. on Acoustics, Speech and Signal Processing, vol. ASSP-26; Dec. 1978; pp. 587-596.
Non-Final Office Action dated Nov. 15, 2021, issued in U.S. Appl. No. 16/580,203 (copy not provided).
Niemeyer, O., et al.; "Detection and extraction of transients for audio coding;" 2006; Audio Engineering Society Convention 120; 2006; May 1. Audio Engineering Society, pp. 1-8.
Goodwin, M., et al.; "Frequency-domain algorithms for audio signal enhancement based on transient modification;" 2006; Journal of the Audio Engineering Society 2006; Sep. 15;54(9):827-40.
Fitz, K., ,et al.; "Transient preservation under transformation in an additive sound model;" 2000; IniCMC; Aug. 2000; pp. 1-4.
Dittmar, C., et al.; "Towards transient restoration in score-informed audio decomposition;" Dec. 2015; InProc. Int. Conf. Digital Audio Effects 2015; Dec. (pp. 145-152).
Every, M.R.; "Separation of musical sources and structure from single-channel polyphonic recordings;" 2006; (Doctoral dissertation,University ofYork); pp. 1-215.
"Method for the subjective assessment of small impairments in audio systems;" recommendation, International Telecommunication Union, Geneva, Switzerland, Feb. 2015; pp. 1-32.
"Method for the subjective assessment of intermediate quality level of audio systems;" recommendation, International Telecommunication Union, Geneva, Switzerland, Oct. 2015; pp. 1-36.
"Algorithms to measure audio programme loudness and true-peak audio level;" recommendation, International Telecommunication Union, Geneva, Switzerland, Oct. 2015; pp. 1-25.
Ross, S.M.; Introduction to Probability and Statistics for Engineers and Scientists; Elsevier, 3. ed.; 2004; pp. 1-641.
Lapierre, J.; "Amélioration de codecs audio standardisés avec maintien de l'interopérabilité;" (May 31, 2016), URLhttps://www.researchgate.net/profile/Jimmy_Lapierre/publication/303693218_Amelioration_de_codecs_audio_standardises_avec_maintien_de_l'interoperabilite/links/574ddedb08ae061b330385c1.pdf, (Dec. 22, 2017), XP055437630; May 2016; pp. 1-140.
Lee, T.C., et al.; "Pre-echo control using an improved post-filter in the frequency domain;" The 18th IEEE International Symposium on Consumer Electronics (ISCE 2014), IEEE, (Jun. 22, 2014), doi:10.1109/ISCE.2014.6884313, pp. 1-2.
Chen, J.H., et al..; "Adaptive postfiltering for quality enhancement of coded speech;" IEEE Transactions on Speech and Audio Processing, doi:10.1109/89.365380, (Jan. 1, 1995), URL: http://ieeexplore.ieee.org/xpls/abs_all.jsp?arnumber=365380, XP055104008; Jan. 1995; pp. 59-71.
Schuller, G.D.T., et al.; "Perceptual Audio Coding Using Adaptive Pre-and Post-Filters and Lossless Compression;" IEEE Transactions on Speech and Audio Processing, IEEE Service Center, New York, NY, US, (Sep. 1, 2002), vol. 10, No. 6, ISSN 1063-6676, XP011079662; Sep. 2002; pp. 379-390.
Wang, J., et al.; "Quality enhancement of coded transient audio with a post-filter in frequency domain;" Signal Processing (ICSP), 2010 IEEE 10th International Conference ON, IEEE, Piscataway, NJ, USA, (Oct. 24, 2010), ISBN 978-1-4244-5897-4, XP031817404; pp. 506-509.
Notice of Allowance dated Feb. 24, 2022, issued in U.S. Appl. No. 16/580,203 (copy not provided).
Chinese language office action dated Oct. 14, 2022, issued in application No. CN 201880036642.3.
English language translation of Chinese language office action dated Oct. 14, 2022, issued in application No. CN 201880036642.3 (pp. 9-18 of attachment).
Mei, Y.; "Research On MPEG-4 AAC CODEC Based on RISC;" Communication and Information System, Department of Information Science and Electronic Engineering Zhejiang University; Mar. 2006; pp. 1-61.

* cited by examiner

— reduces pre-echo or

— shapes to amplify attack of transient $r'(k) = r(k) \cdot w_{lag}(k)$ r: autocorrection signal
$w_{lag}$: window
r': windowed autocorrection signal $$w_{t,lag}(k) = \exp\left[-\frac{1}{2}\left(\frac{2\pi t_0 k}{2n/f_s}\right)^2\right] = \exp\left[-\frac{1}{2}\left(\frac{\pi \cdot f_s t_0 k}{n}\right)^2\right] = \exp(-a \cdot k^2)$$

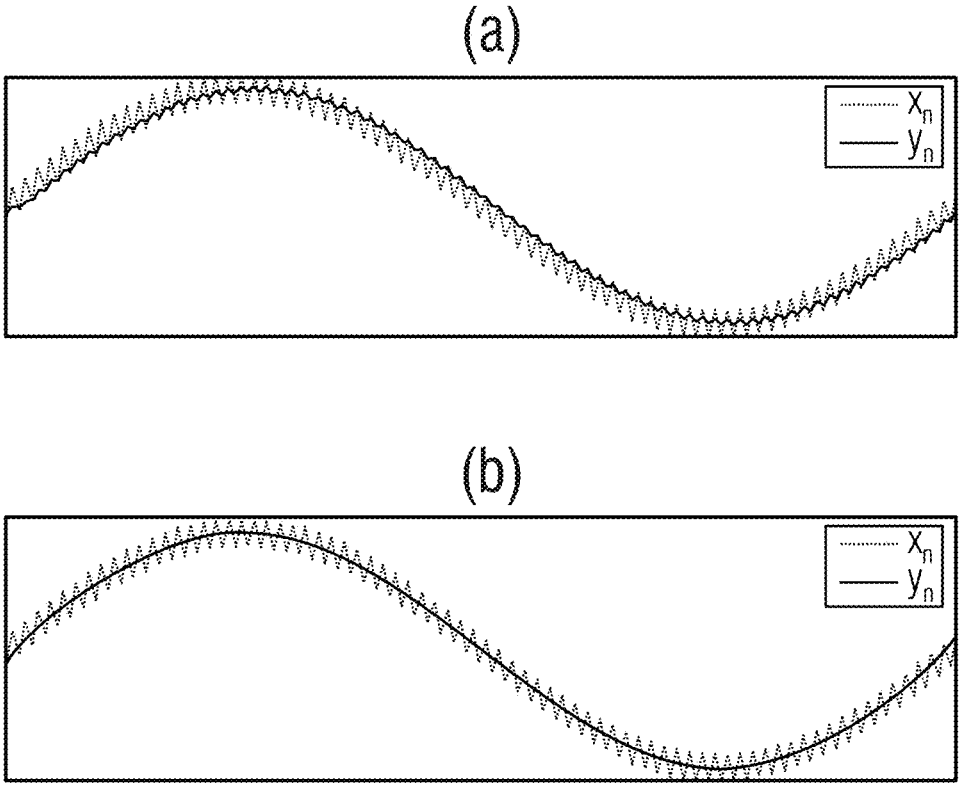
Moving average filter applied in (a) forward direction and in (b) both forward and backward direction of $x_n$.
Fig. 12.1

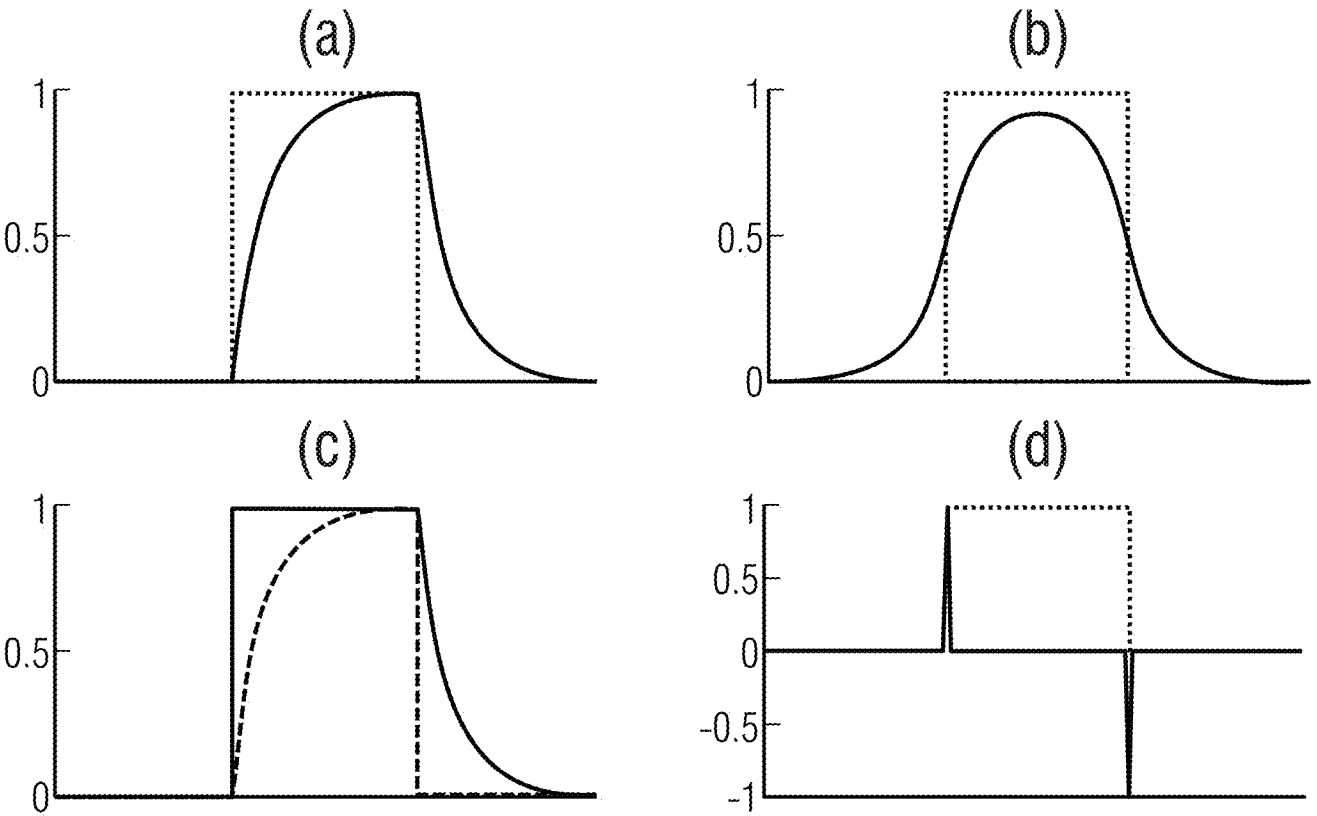
Results of different applications of a single pole recursive averaging filter on a rectangular function in (a)-(c). Image (d) shows the result of a simple FIR high-pass filter with the filter coefficients b = [1, -1].
Fig. 12.2

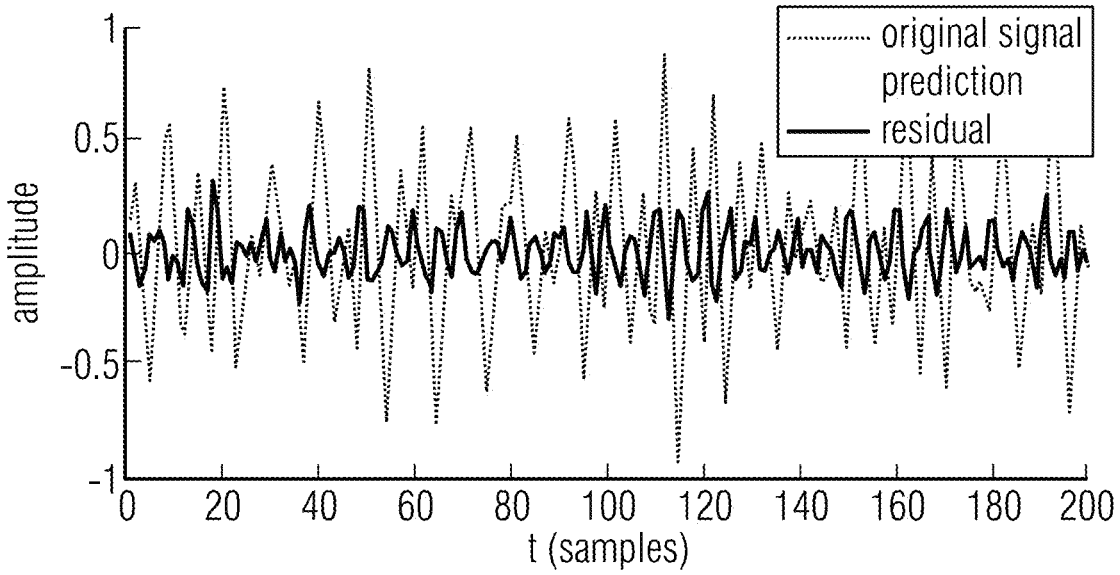
Prediction and residual of a speech signal frame
Fig. 12.3
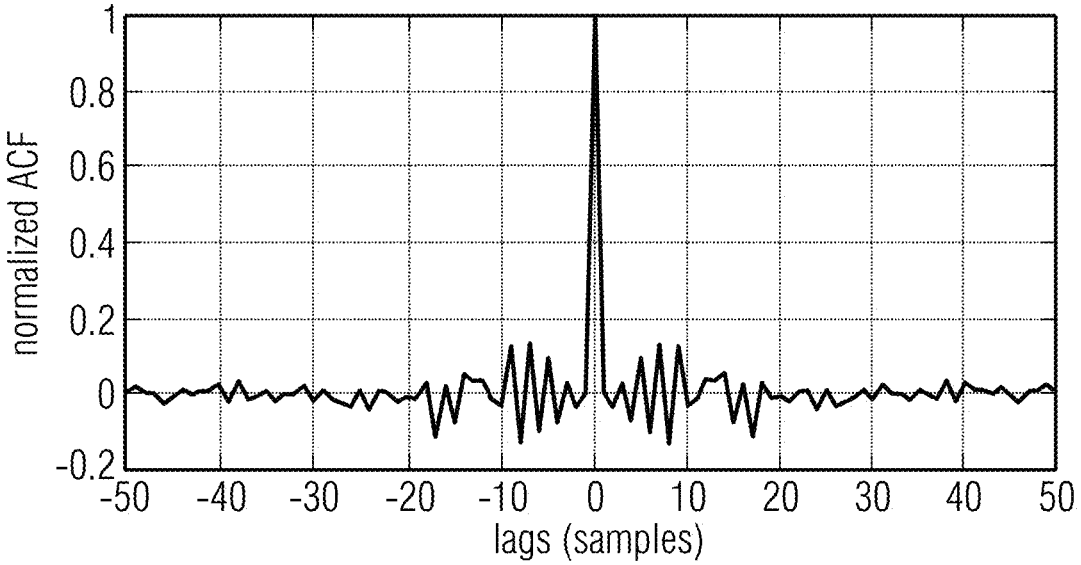
Autocorrelation of the residual from the whole speech signal from Figure 12.3
Fig. 12.4

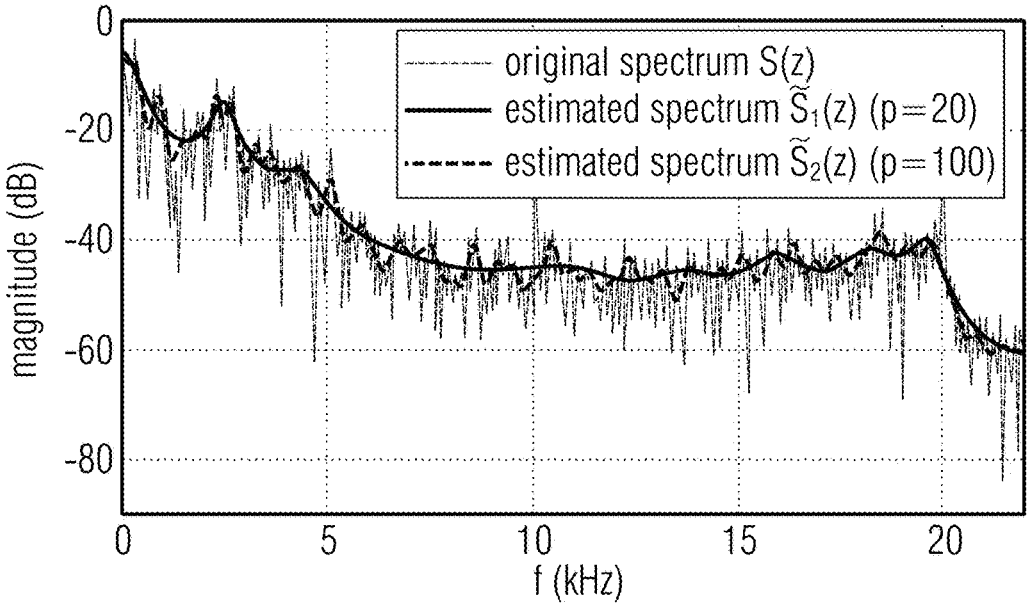

Original spectrum of a speach signal segment of 1024 samples and two of ist approximations, the first (black vurve) with a lower and the second (dashed curve) with higher prediction order.

Fig. 12.5

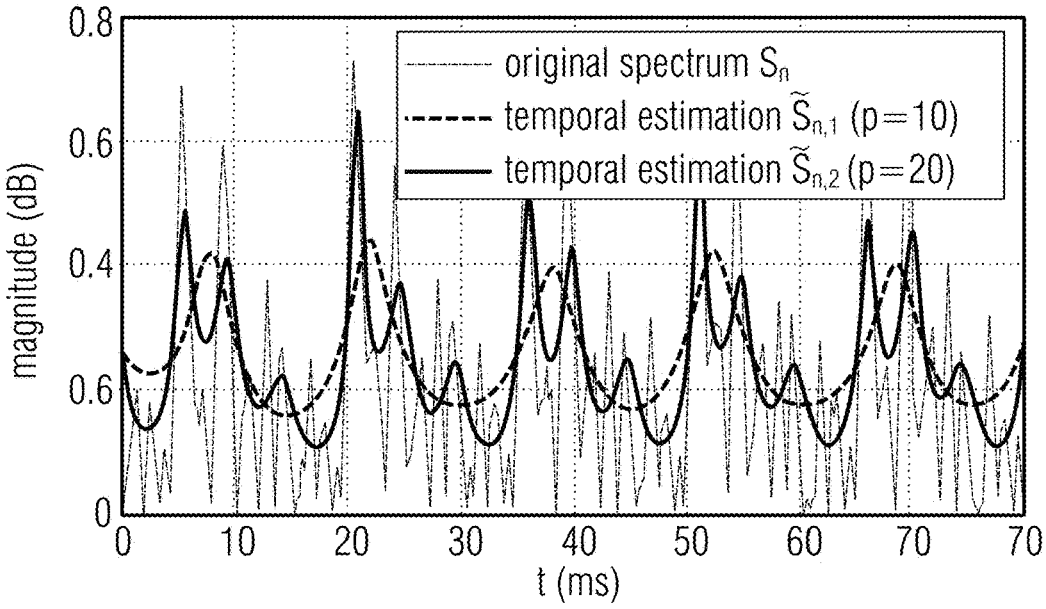

Absolute values of 80 ms from a music signal and ist approximation in the time domain.The smoother dashed and black curves are computed via linear prediction in the frequency domain with a prediction order of 10 and 20 respectively.

Fig. 12.6

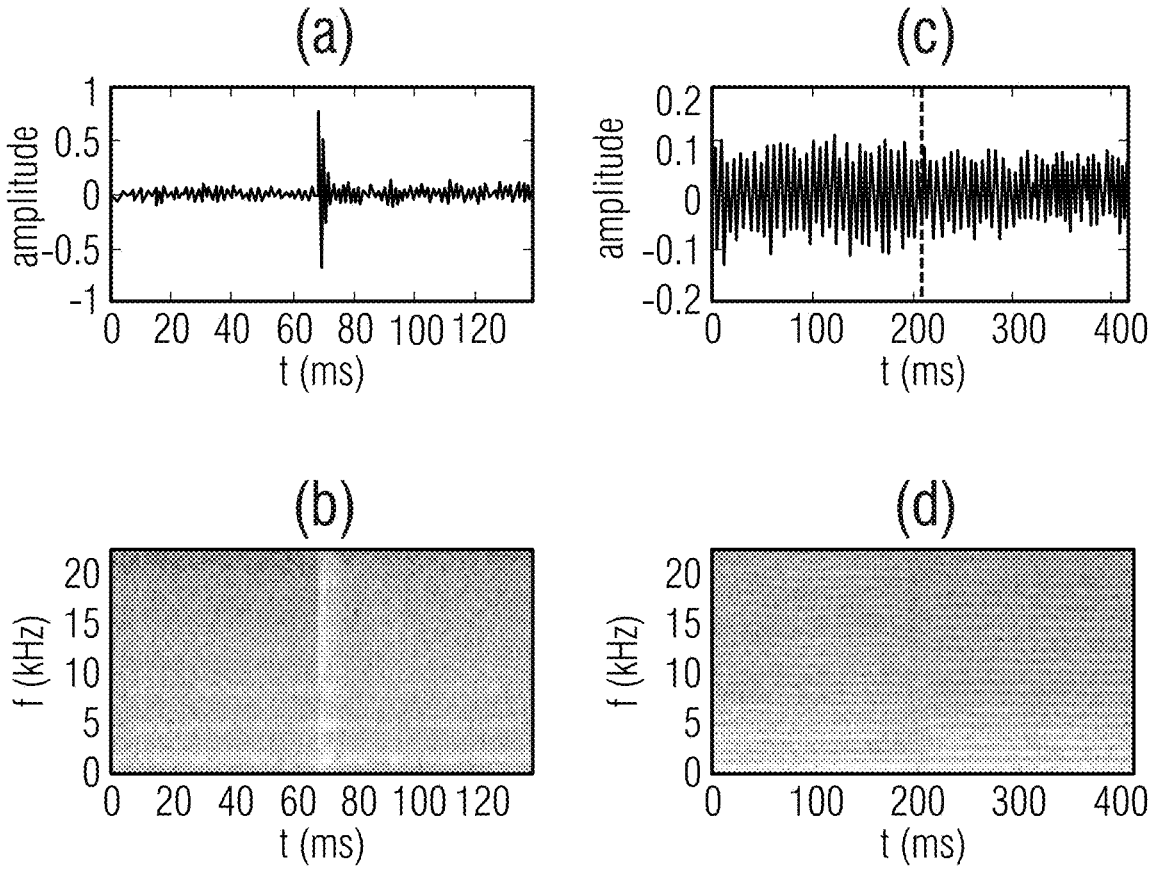
(a) Audio signal with an "attack transient" (castanets),
(b) time-frequency representation of the signal in (a),
(c) audio signal with a "frequency domain transient" (violin),
(d) time-frequency representation of the signal in (c)
Fig. 12.7

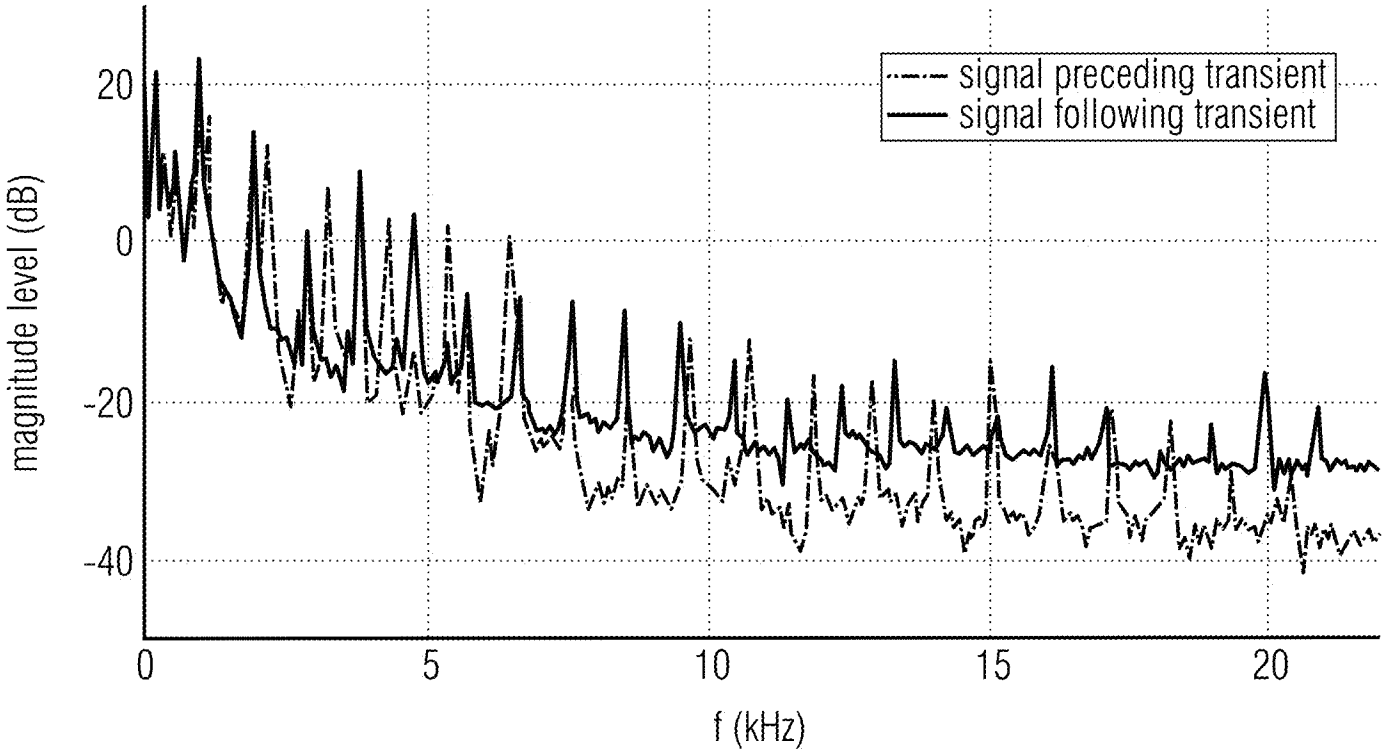
Spectra of the two time-frames before an after the frequency domain transient displayed in Figure 2.7 (c)
Fig. 12.8

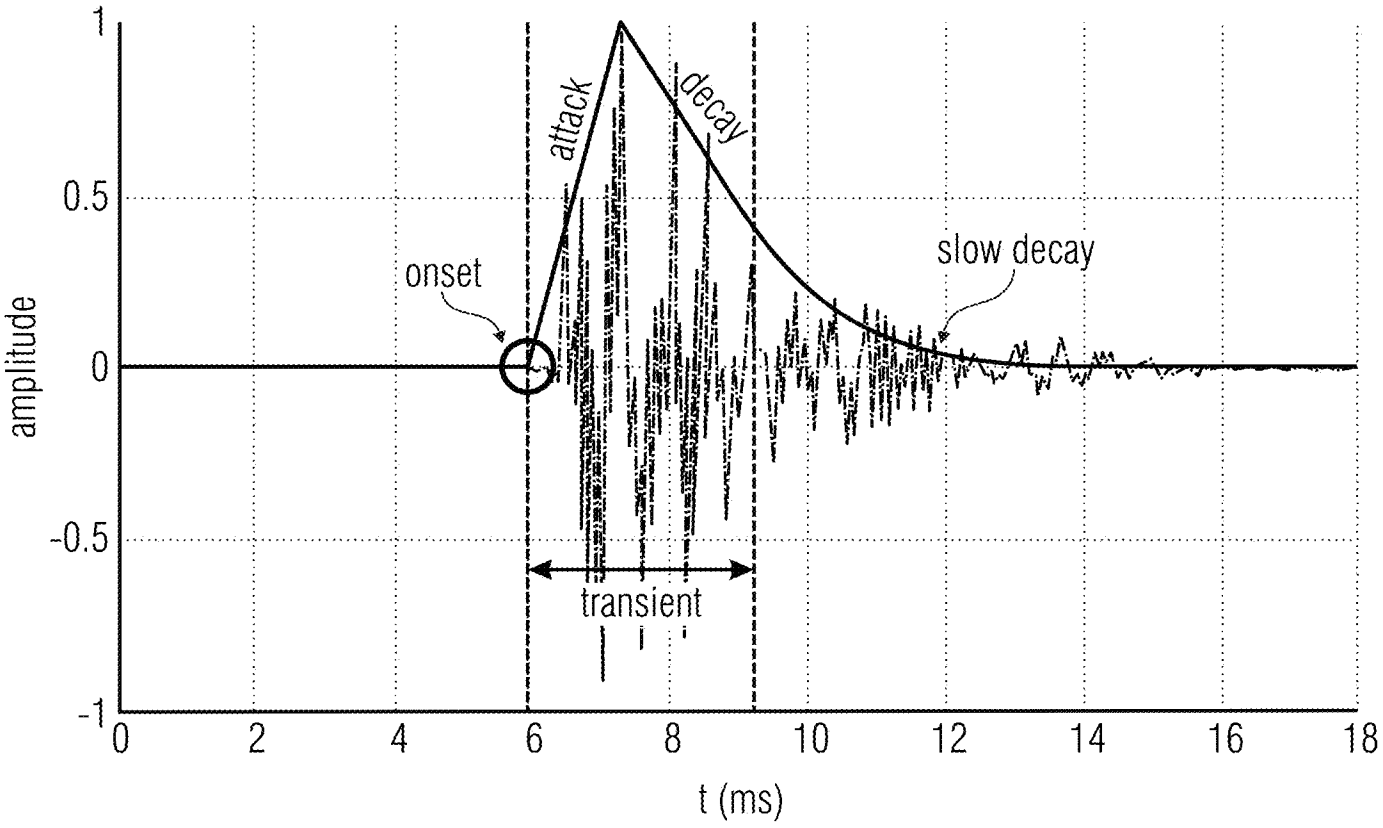
Illustration of the differentiation between transient, attack, onset and decay using the example of a transient signal produced by castanets (after [26]).
Fig. 12.9

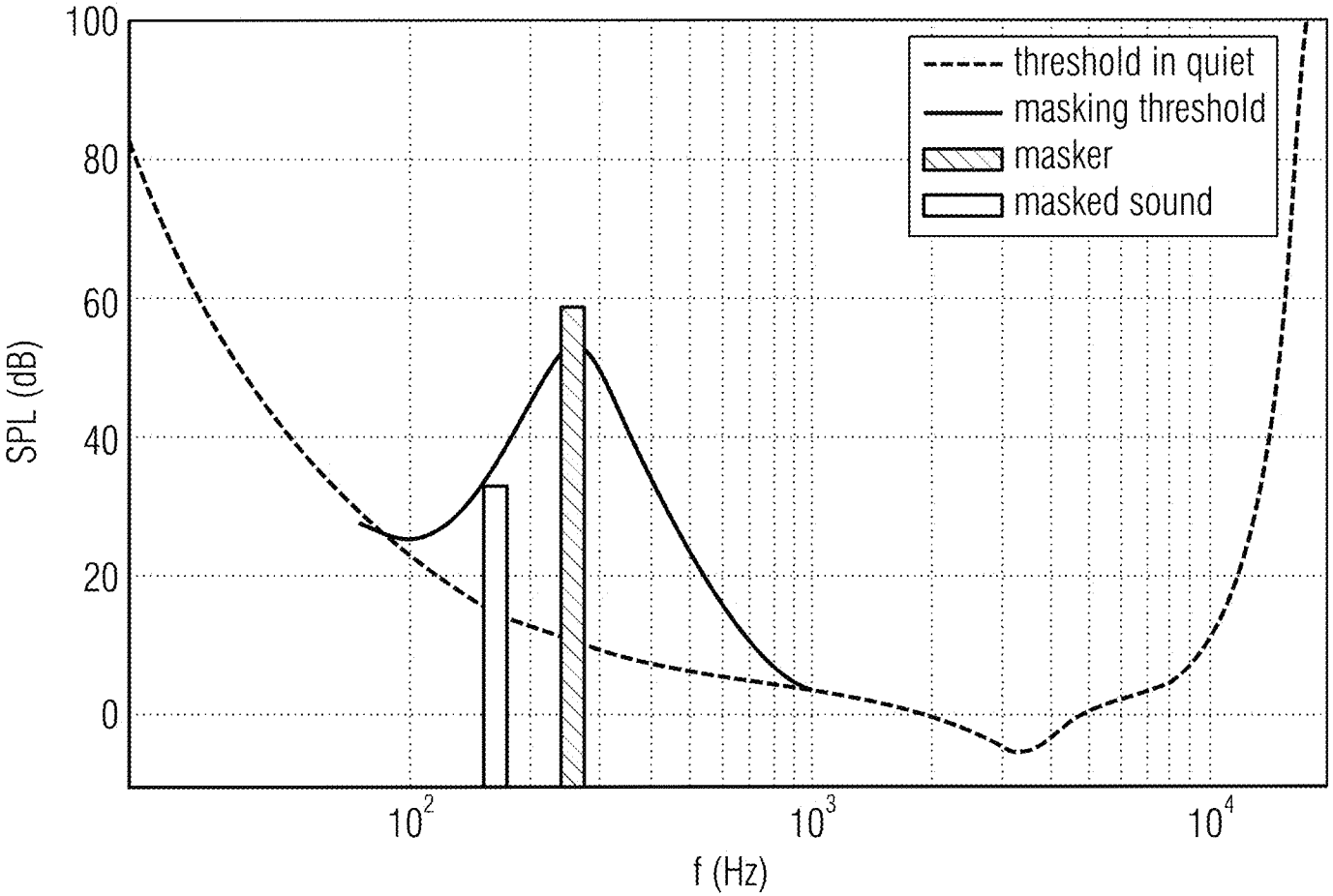
Absolute threshold in quiet and illustration of the simultaneous masking phenomenon (image after [33]).
Fig. 12.10

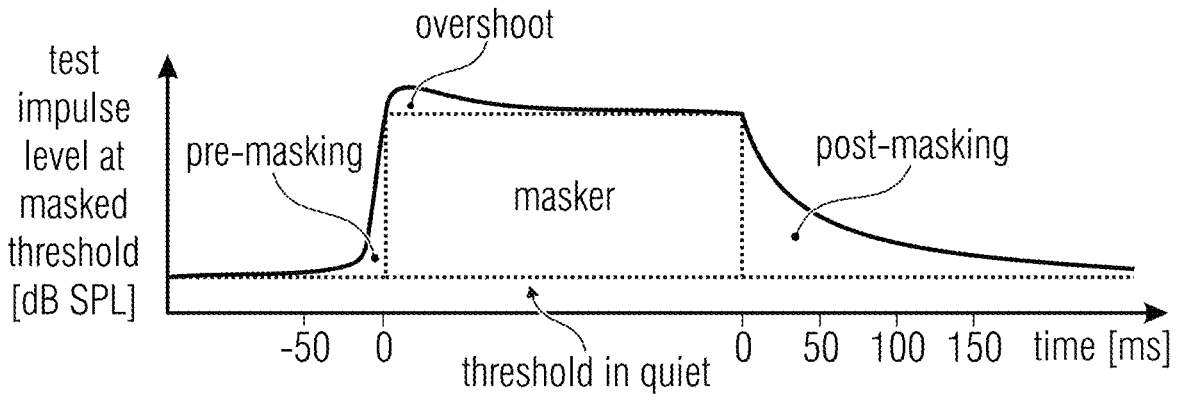
Illustration of the temporal masking effects (image from [37])
Fig. 12.11
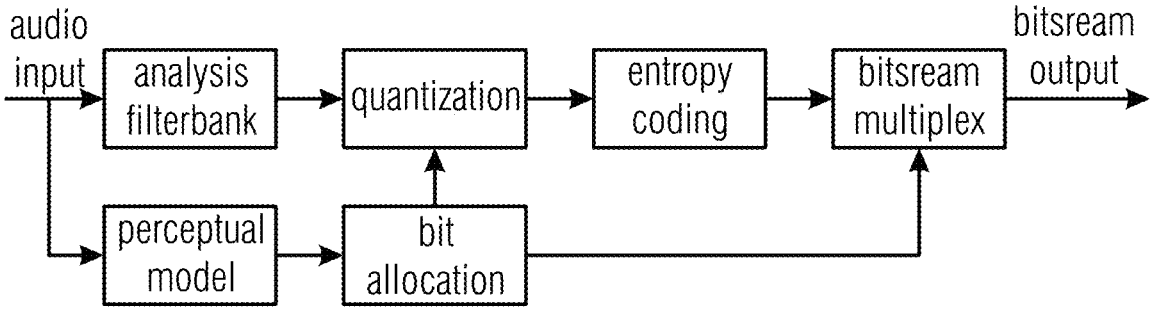
Generic structure of a perceptual audio encoder (image after [17, 32])
Fig. 12.12
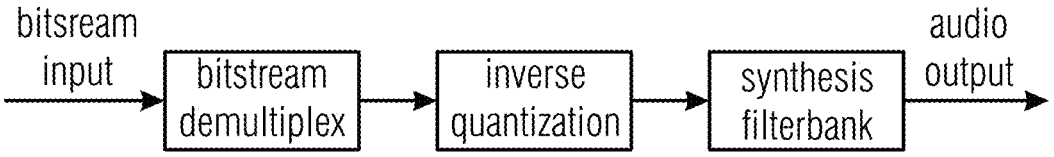
Generic structure of a perceptual audio decoder (image after [32])
Fig. 12.13

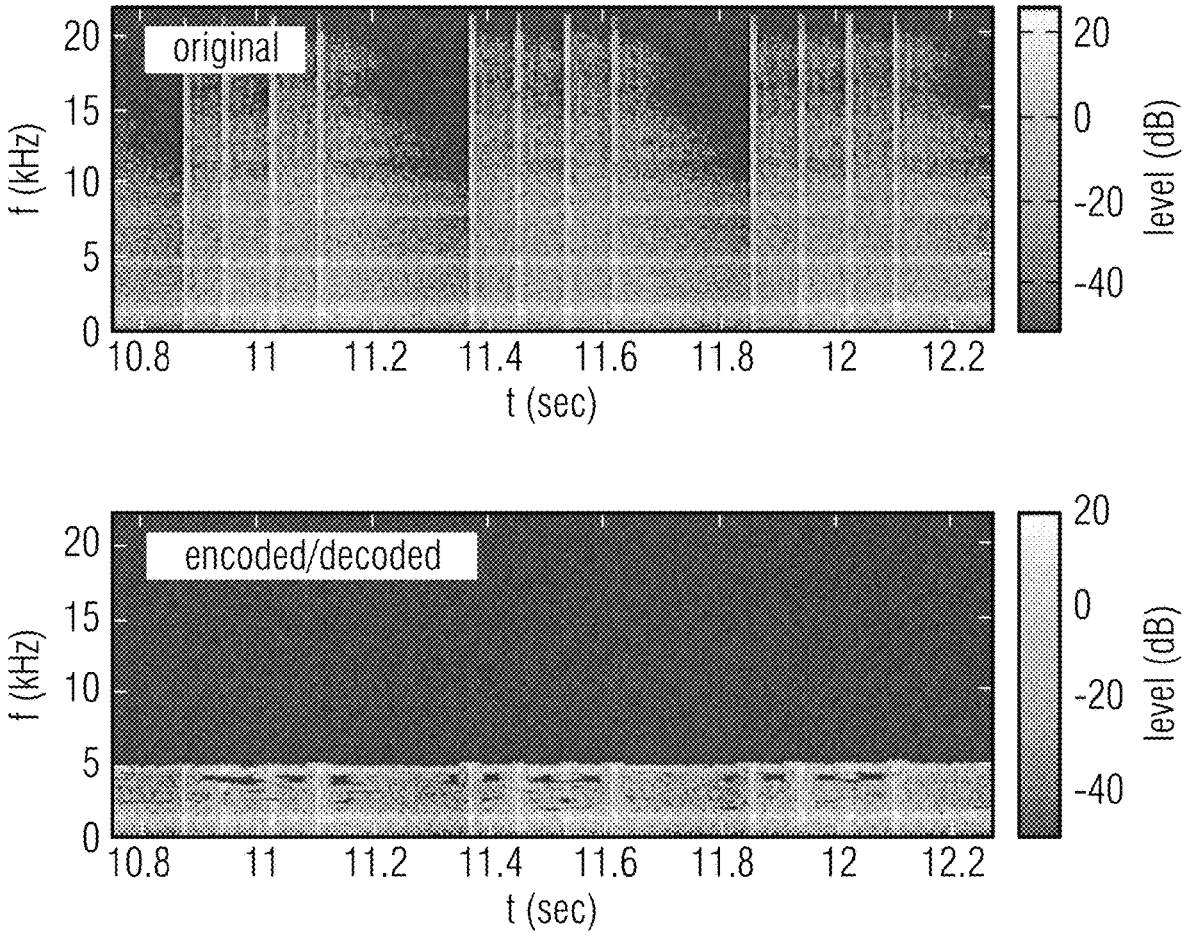
Top: Spectrogram of an uncompressed audio signal (castanets).
Bottom: Perceptually encoded/decoded aidio signal with limited bandwidth and "birdie" artifacts (spectral gaps).
Fig. 12.14

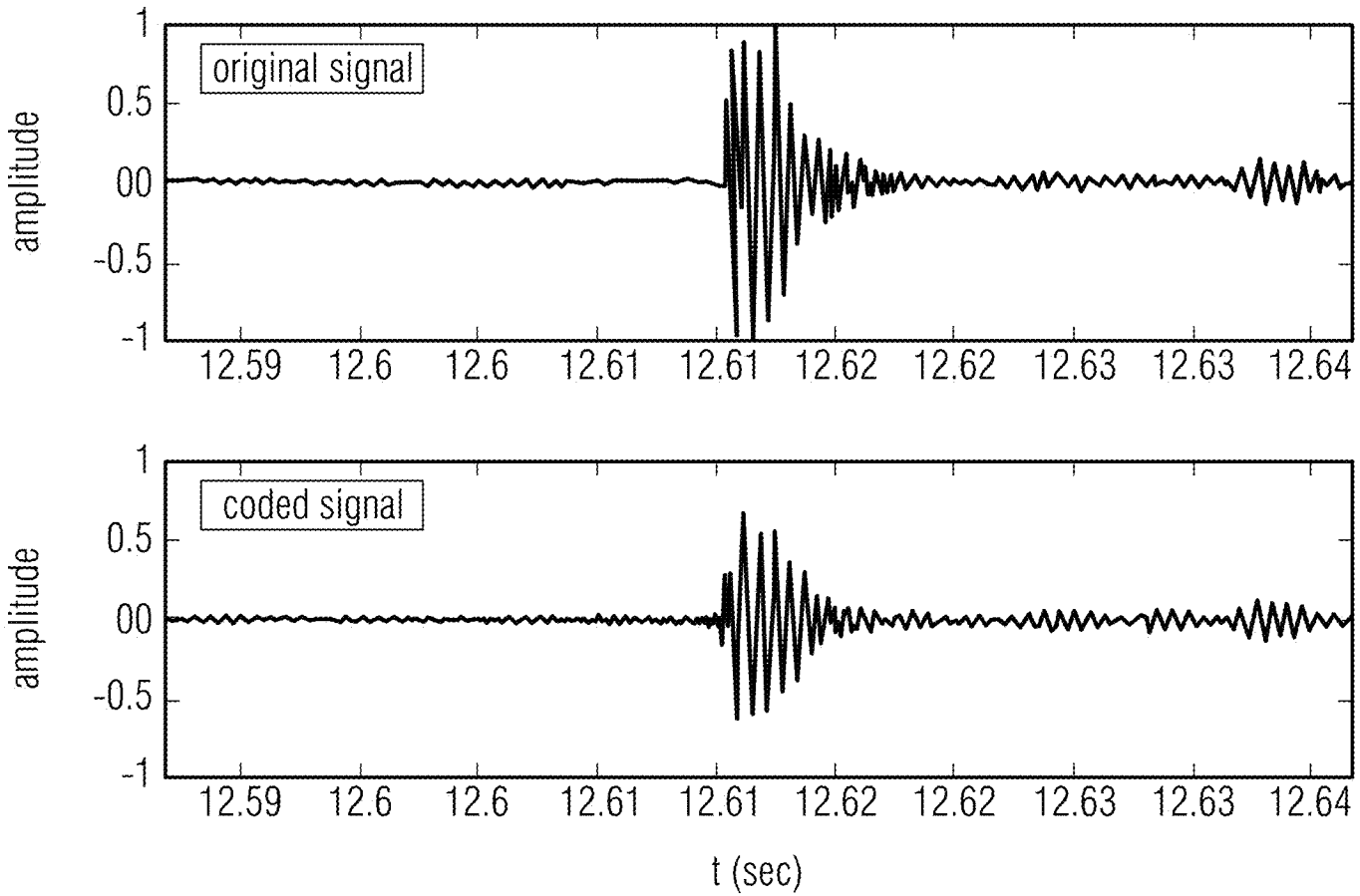
Illustration of the degraded attack and energy of a transient after the perceptual audio coding.
Fig. 12.15

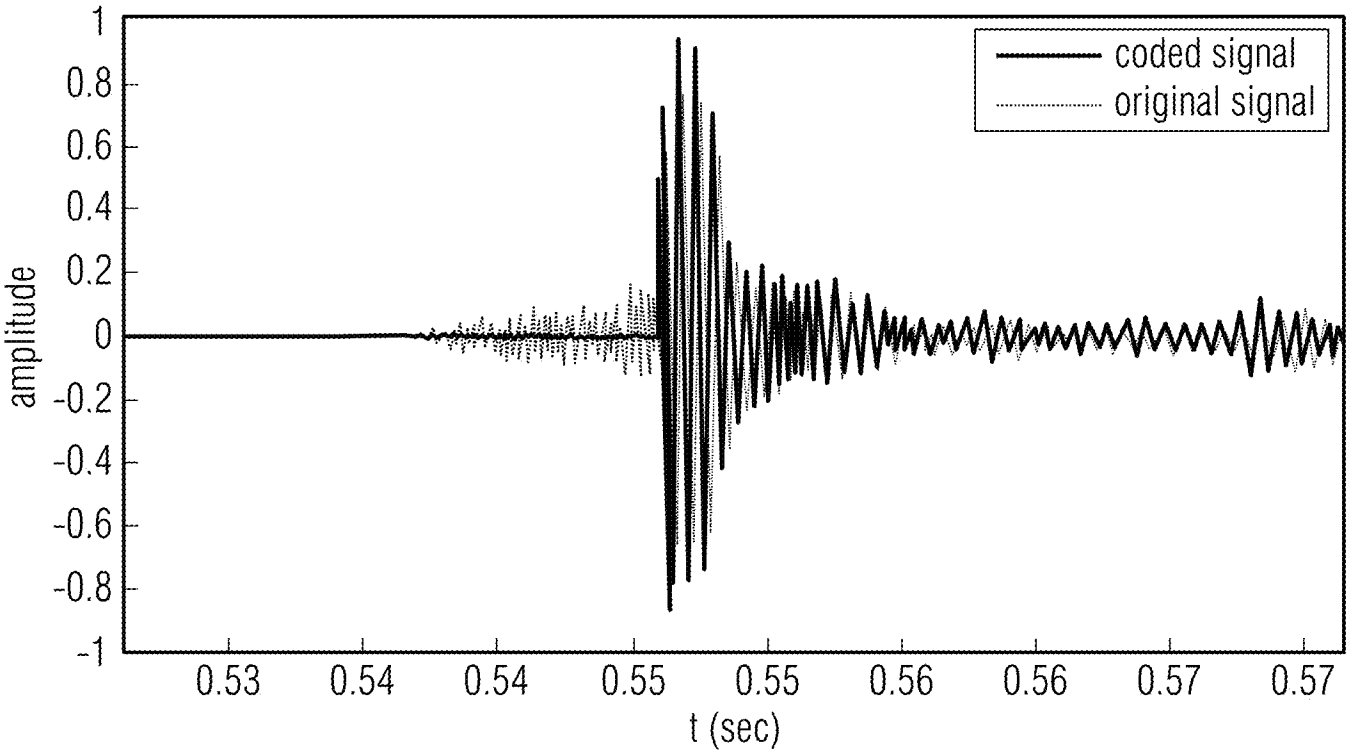
Example of a pre-echo artifact for a castanet signal transient.
Fig. 12.16

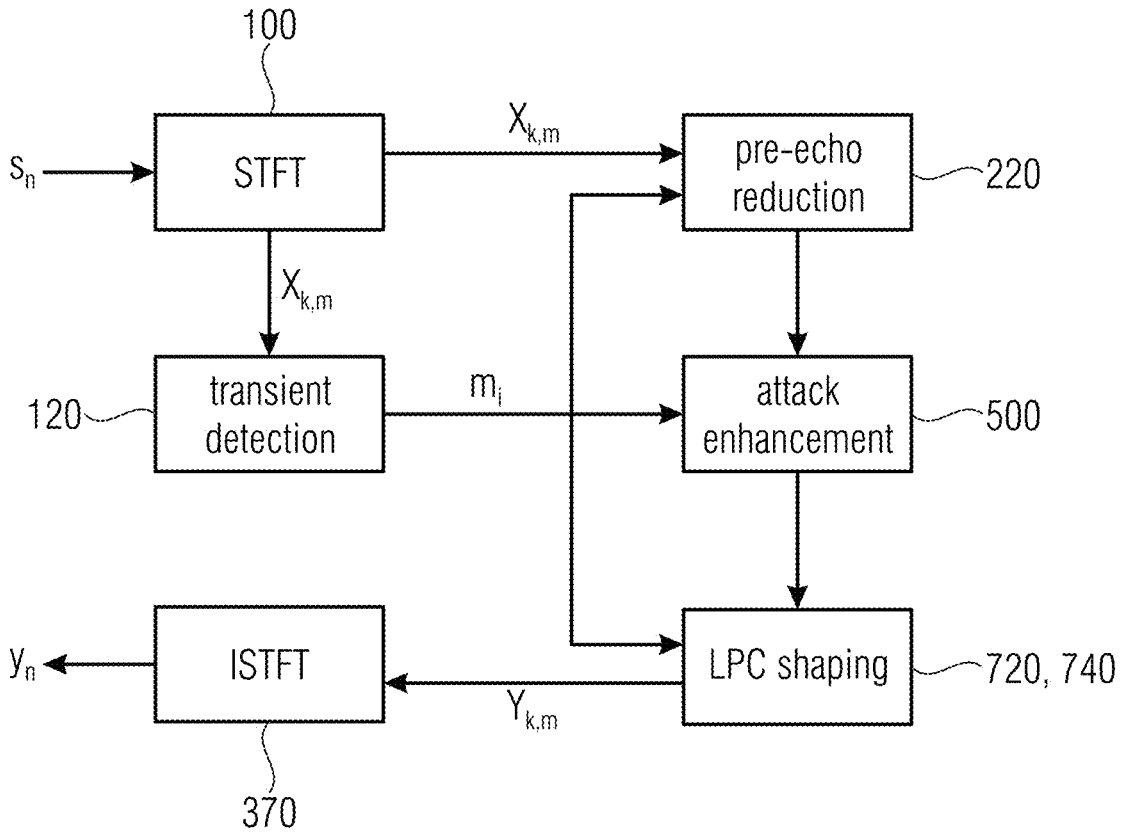
Algorithm for the enhancemenet of transient signal parts
Fig. 13.1

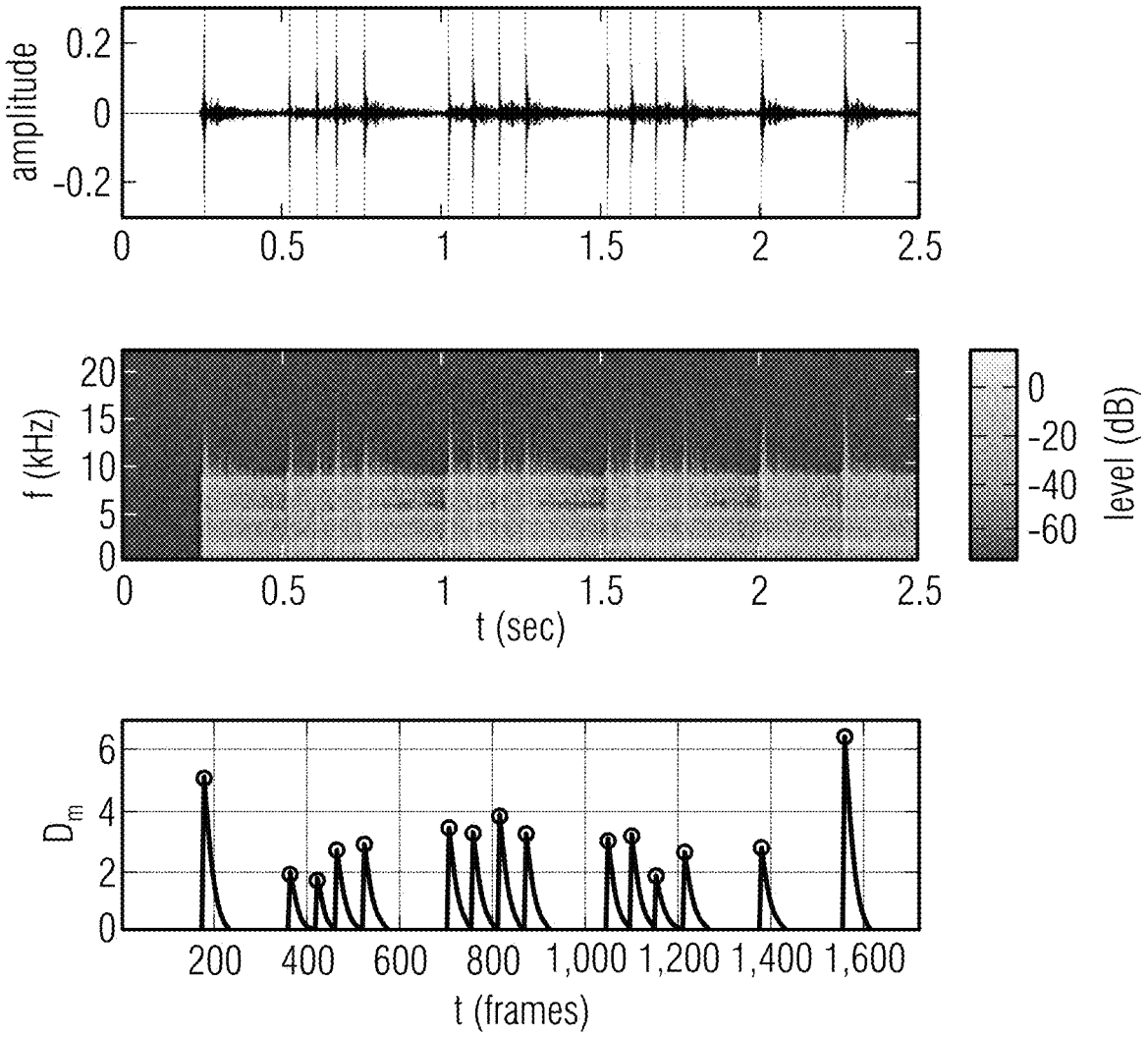
Top image: Waveform of the input audio signal $S_n$ (castanets).
Middle image: Spectogram of the input signal $X_{k,m}$.
Bottom image: Resulting transient detection function $D_m$ and identified peaks (red circles), corresponding to the detected transient onset frames $m_i$.
Fig. 13.2

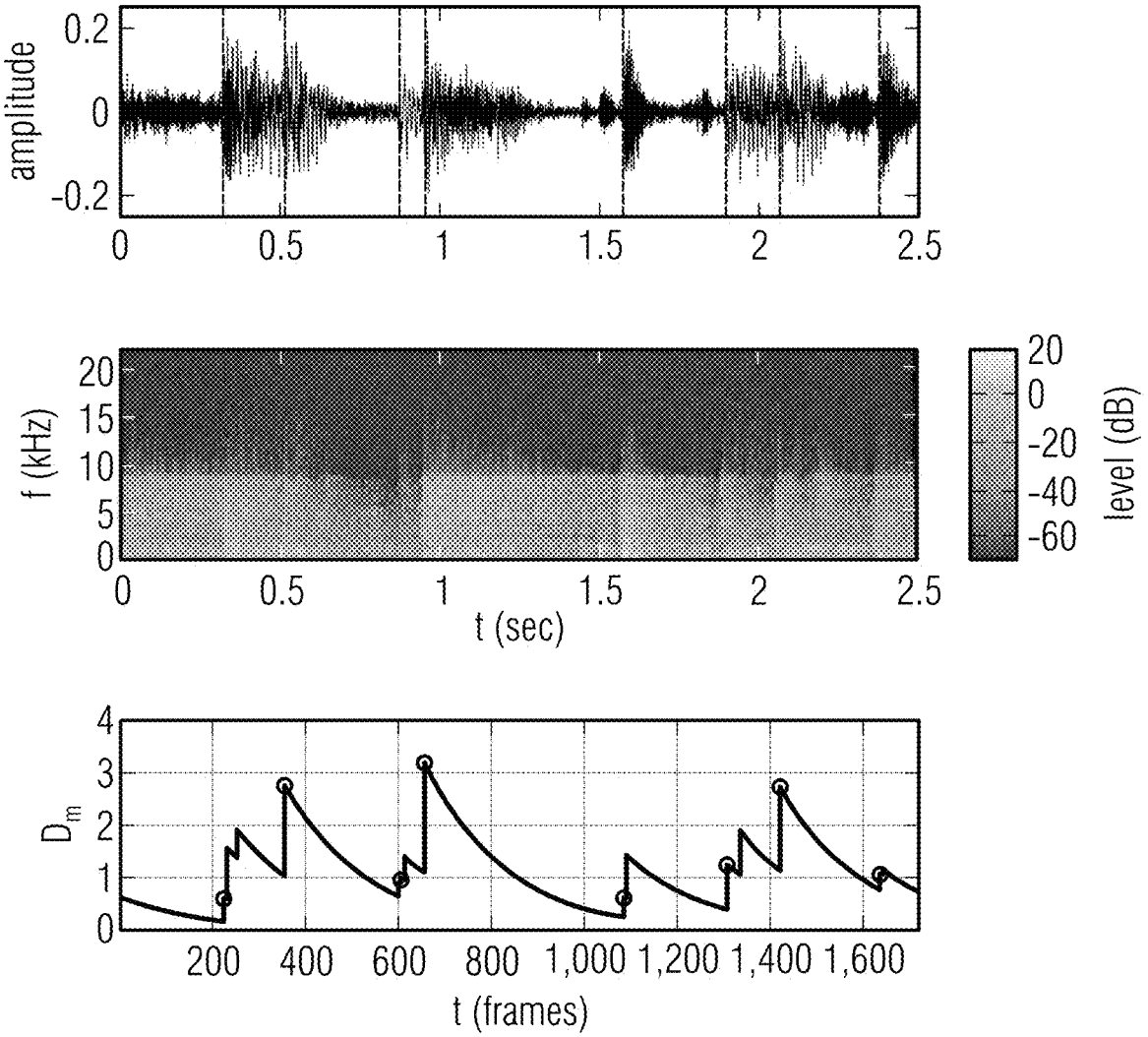
Top image: Waveform of the input audio signal $S_n$ (funk musics) and detected onset times (vertical red lines).
Middle image: Spectogram of the input signal $X_{k,m}$.
Bottom image: Resulting transient detection function $D_m$ and identified peaks (red circles), corresponding to the detected transient onset frames $m_i$.
Fig. 13.3

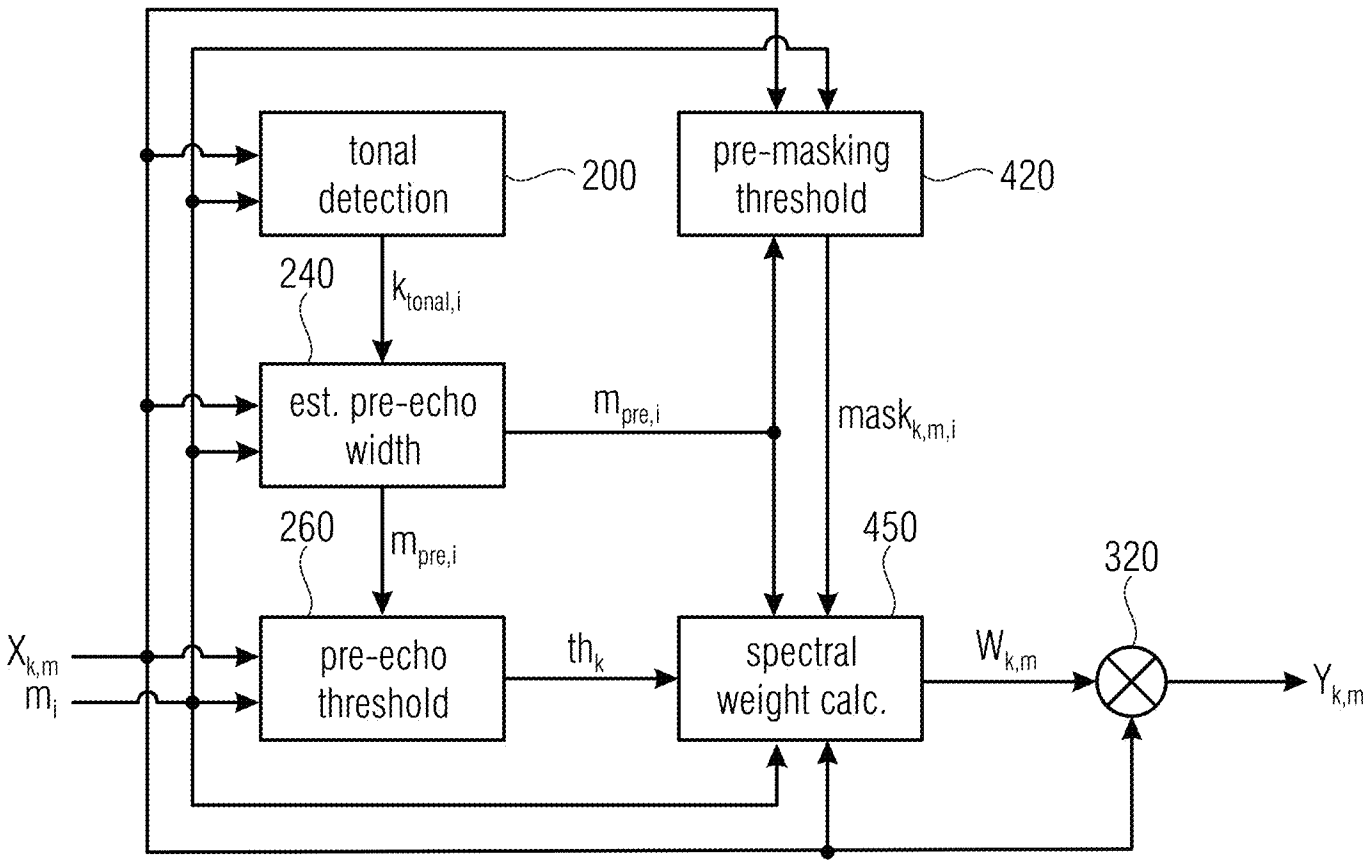
Block diagram for the pre-echo reduction algorithm
Fig. 13.4

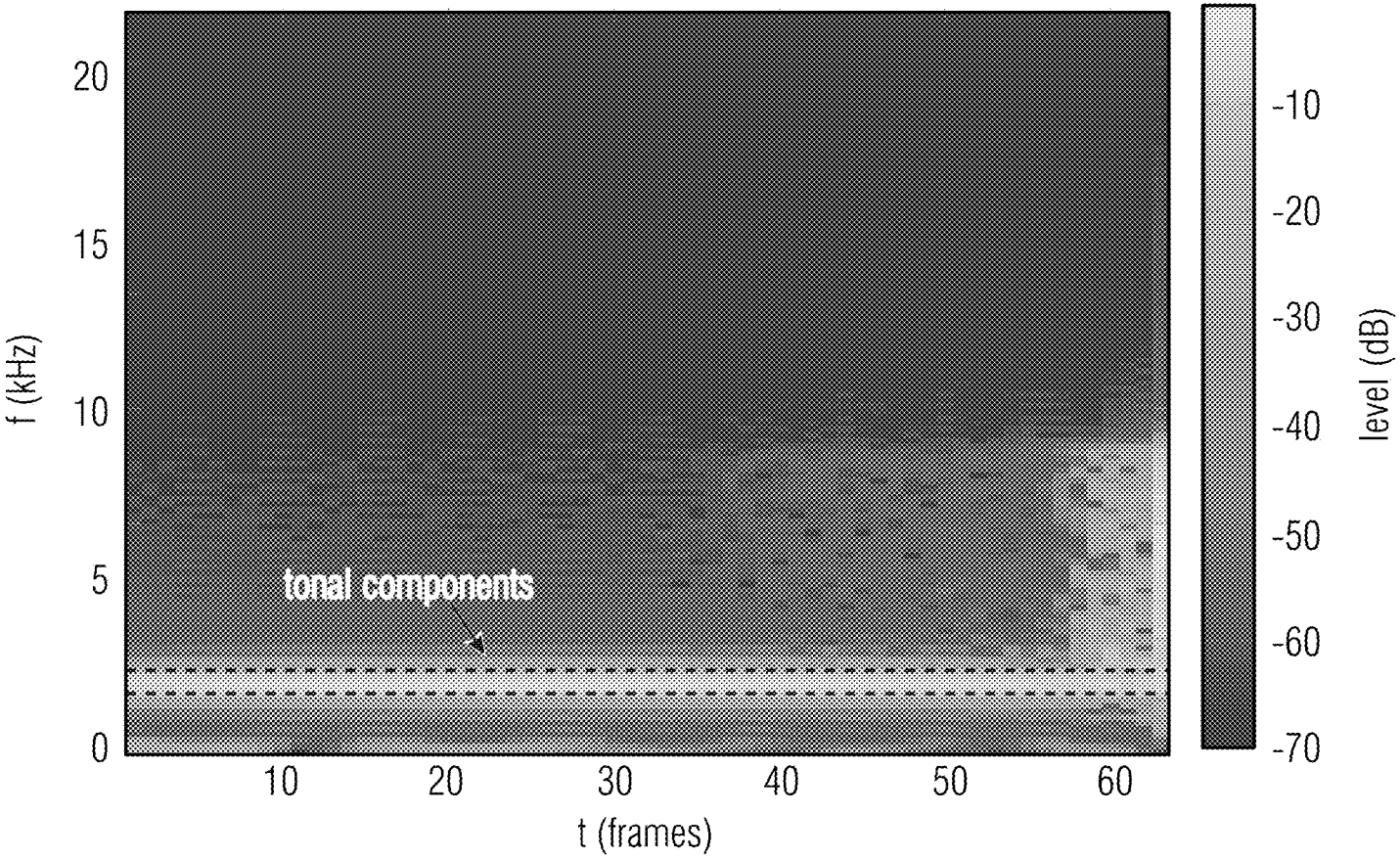
Spectrogram of the area before a detected transient onset of an input signal (glockenspiel). The two dashed horizontal lines border several detected tonal spectral coefficients, in this case originating from previous glockenspiel tone as the sustained signal decay.
Fig. 13.5

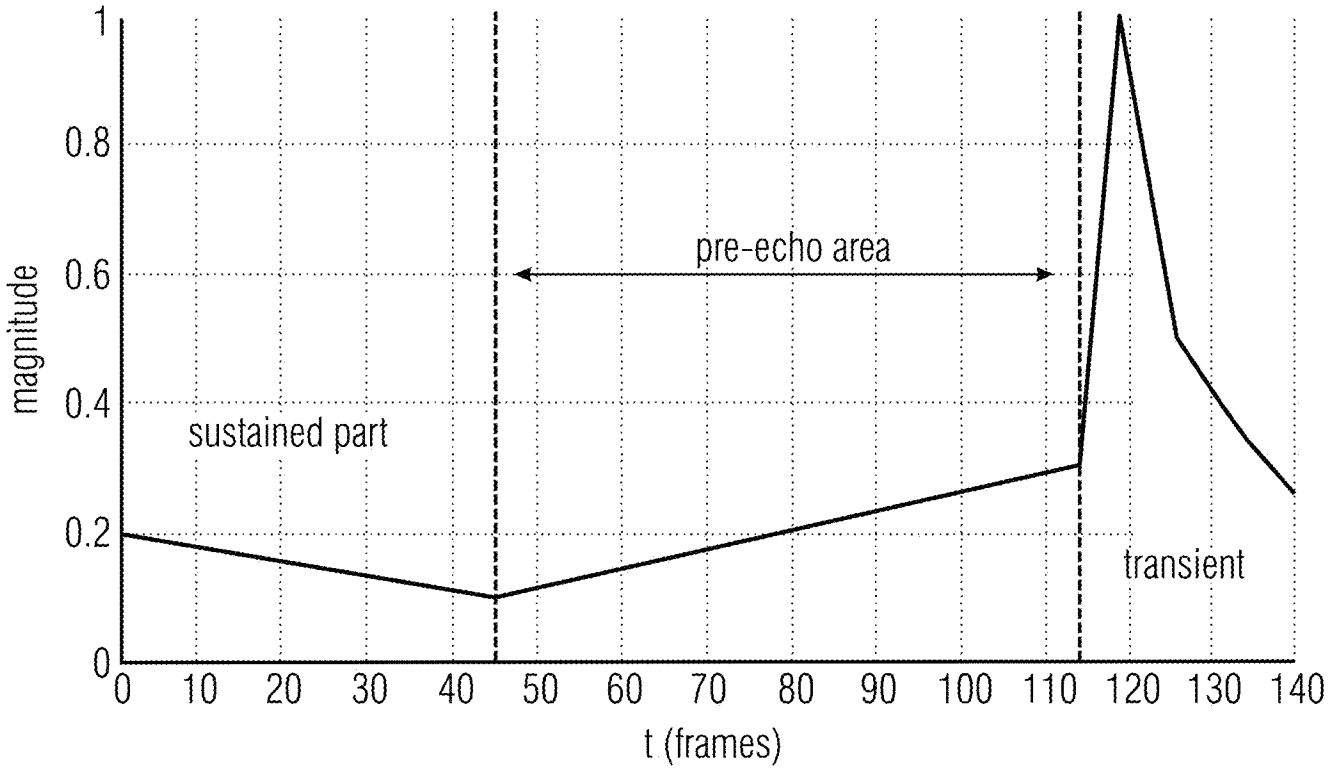
Schematic representation of a transient and the preceding pre-echo area, to illustrate the approach for the estimation of the actual extent of the pre-echo artifact.
Fig. 13.6

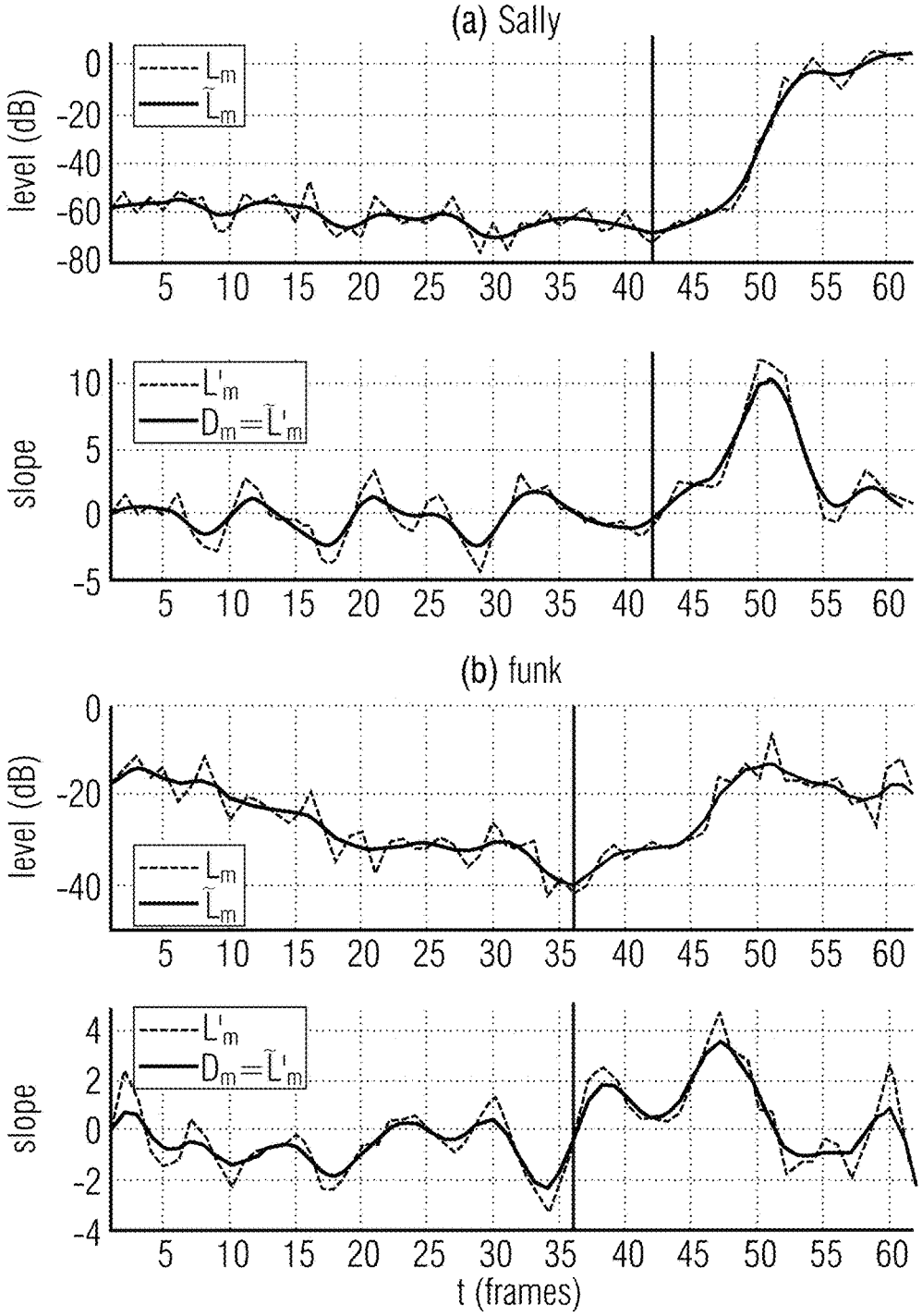

Examples for the computation of the pre-echo width detection function $D_m$ for two different signals. The upper images in (a) and (b) show the magnitude signals $L_m$ and $\tilde{L}_m$ and the lower image the slopes $L'_m$ and $\tilde{L}'_m = D_m$. The vertical lines represent the estimated pre-echo start frame. The transient onset is located outside the diagram at frame 62.

Fig. 13.7

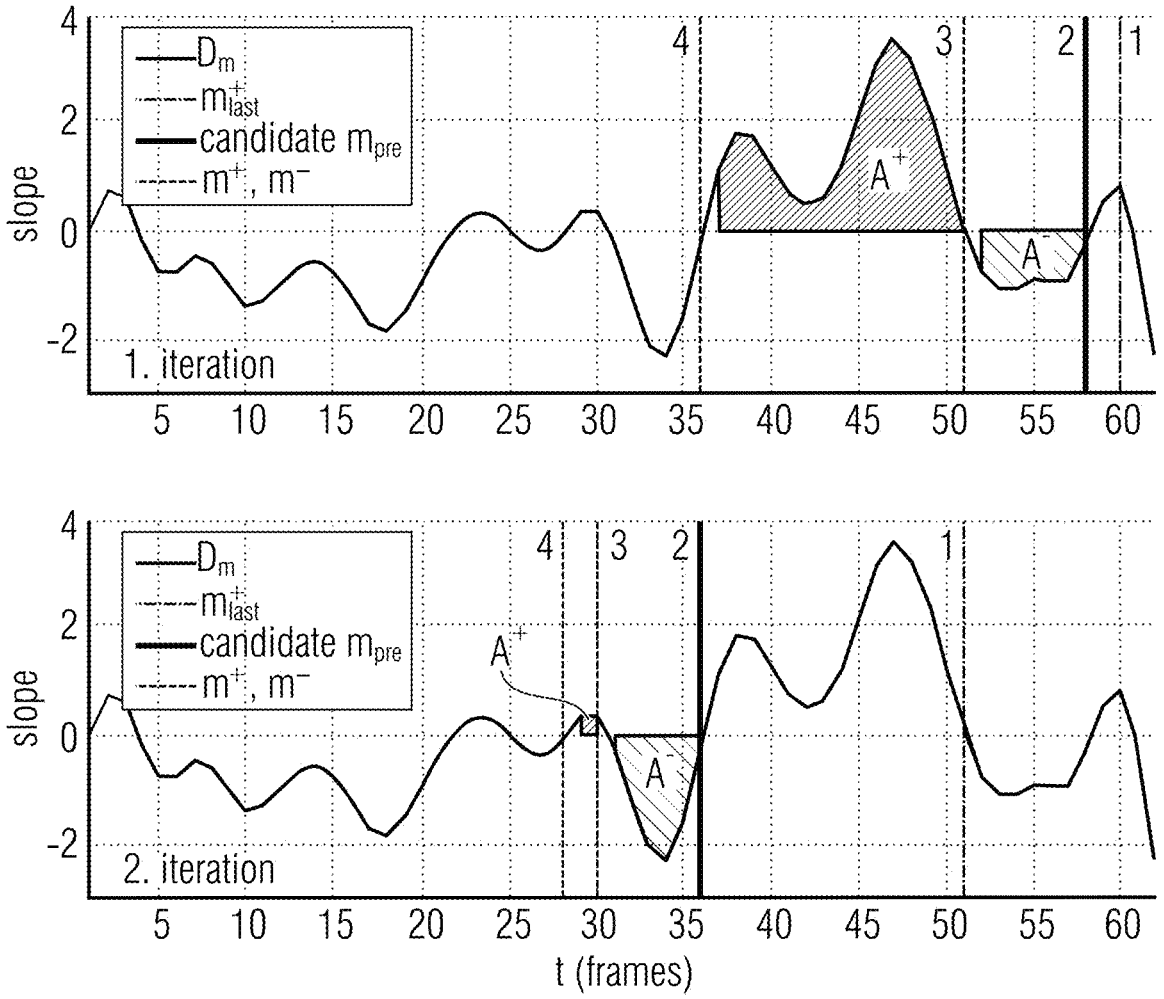
Detection function of the signal in figure 4.7 (b), to illustrate the first two iterations of the algorithm for the estimation of the pre-echo start frame. The diagrams show the detection function $D_m$ in the pre-echo search area, with the detected transient onset being located at frame 62 outside the diagrams.
Fig. 13.8

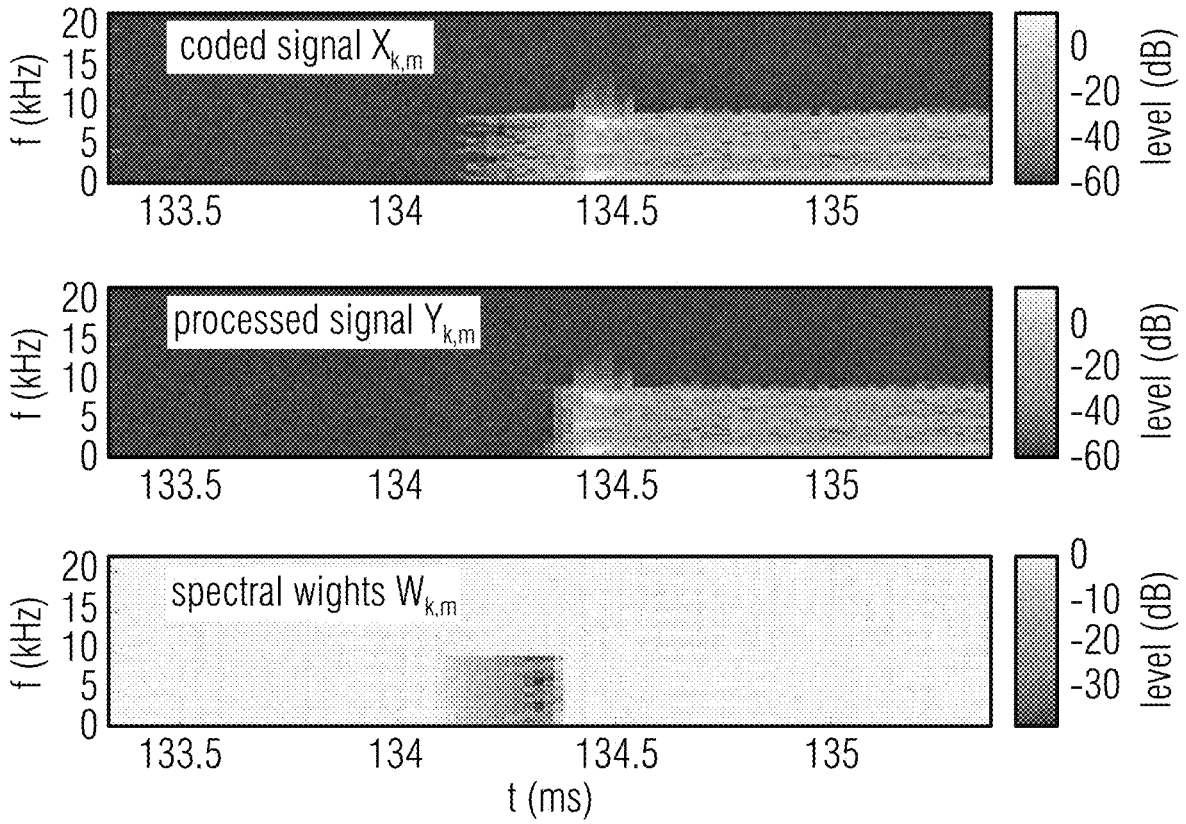
Top image: Spectrogram of an excerpt of a coded input signal $X_{k,m}$ (castanets) around a transient event with preceding pre-echo artifact.
Middle image: Processed output signal $Y_{k,m}$ with reduced pre-echo.
Bottom image: Spectral weights $W_{k,m}$ for the pre-echo damping.
Fig. 13.9

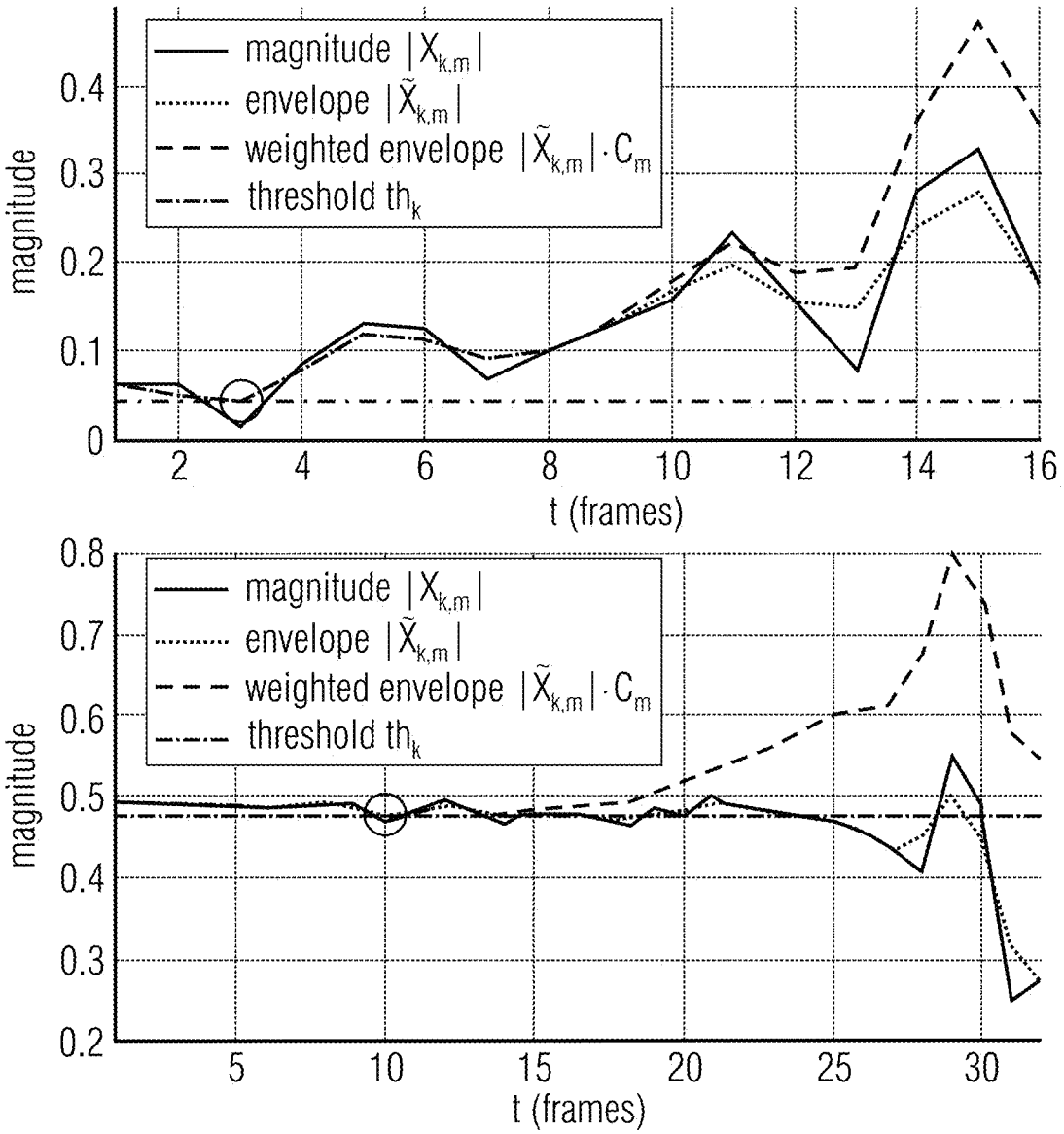

Illustration of the pre-echo threshold determination for the castanet signal in the top image and the glockenspiel signal in the bottom image. The solid gray curve is the magnitude signal $|X_{k,m}|$ for one spectral coefficient k in the pre-echo area directly preceding the transient onset (located outside the diagrams at frame 18 (top image) and 34 (bottom image)). The dashed black and dashed gray curves represent the smoothed magnitude signal $|\tilde{X}_{k,m}|$ before and after the multiplicationthe with the weighting function $C_m$. The resulting pre-echo threshold $th_k$ is depicted as the horizontal dash-dotted line.

Fig. 13.10

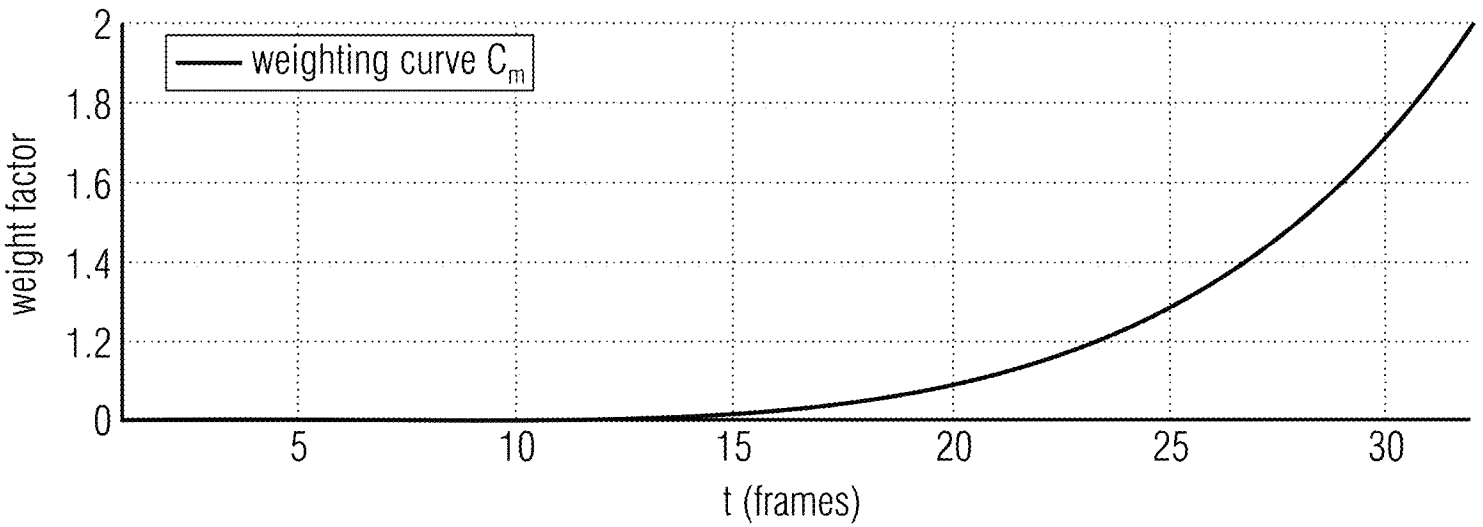
Weighting curve $C_m$, that is used to weight the smoothed magnitude signal $|\tilde{X}_{k,m}|$ prior to the determination of the pre-echo threshold $th_k$.
Fig. 13.11

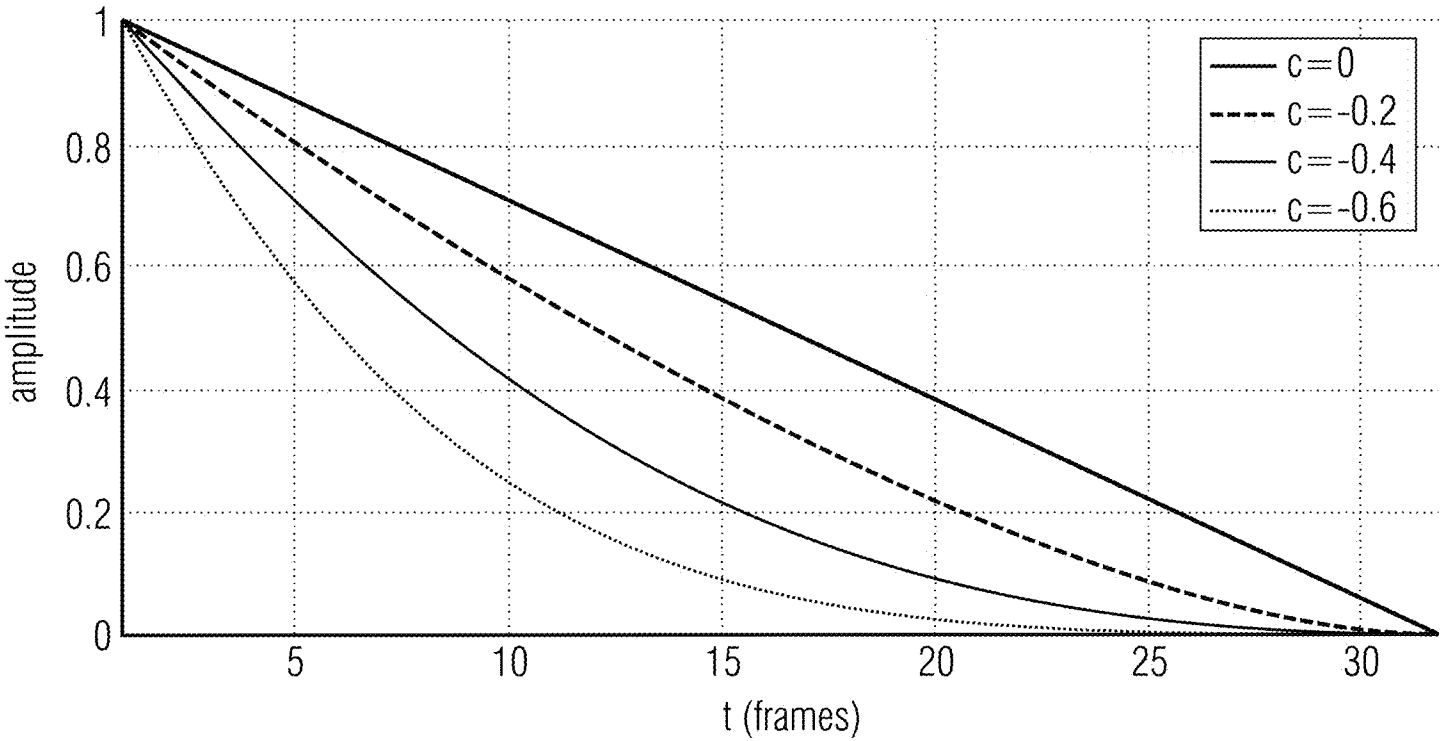
Parametric fading curve $f_m$ for different values of c.
Fig. 13.12

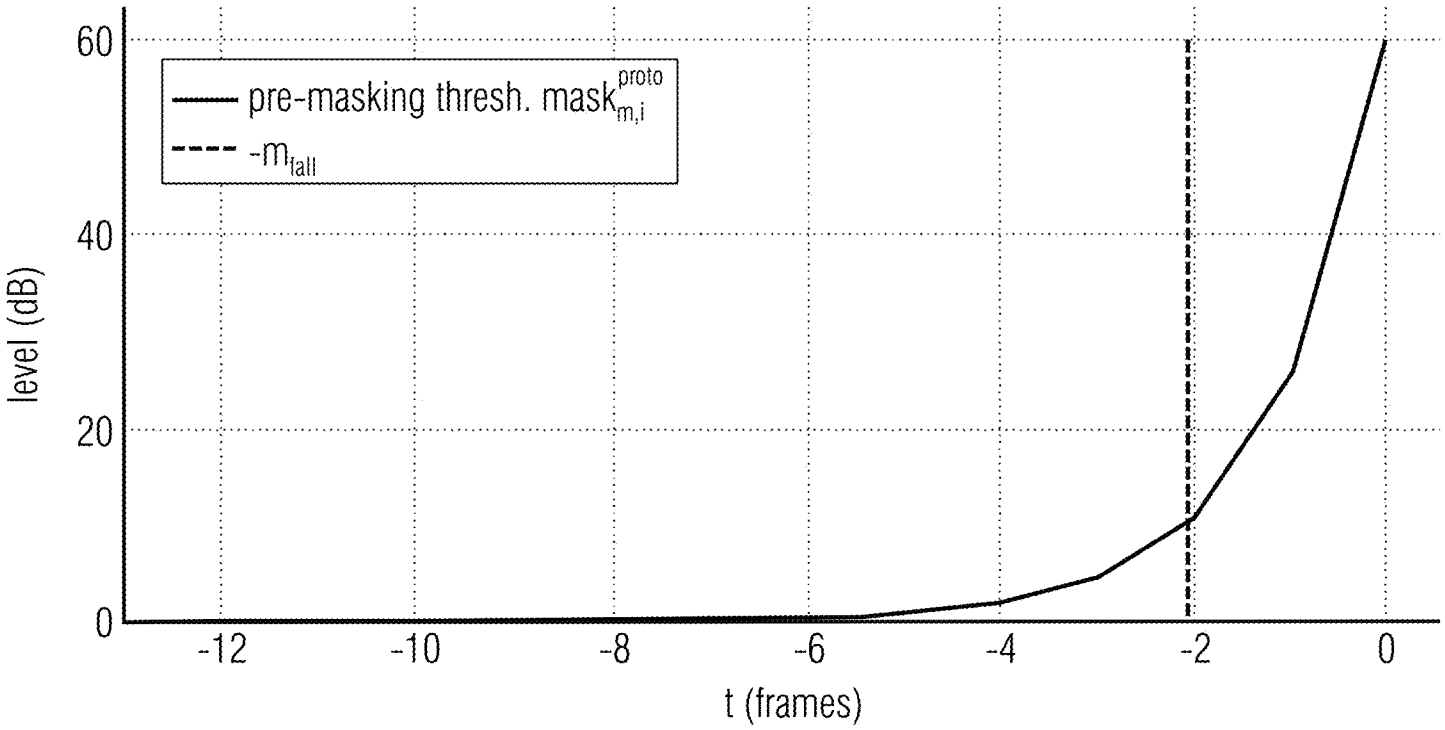
Model of the pre-masking threshold at m=0 with s masker level of 66 dB (signal-to-mask ratio SMR= -6 dB)
Fig. 13.13

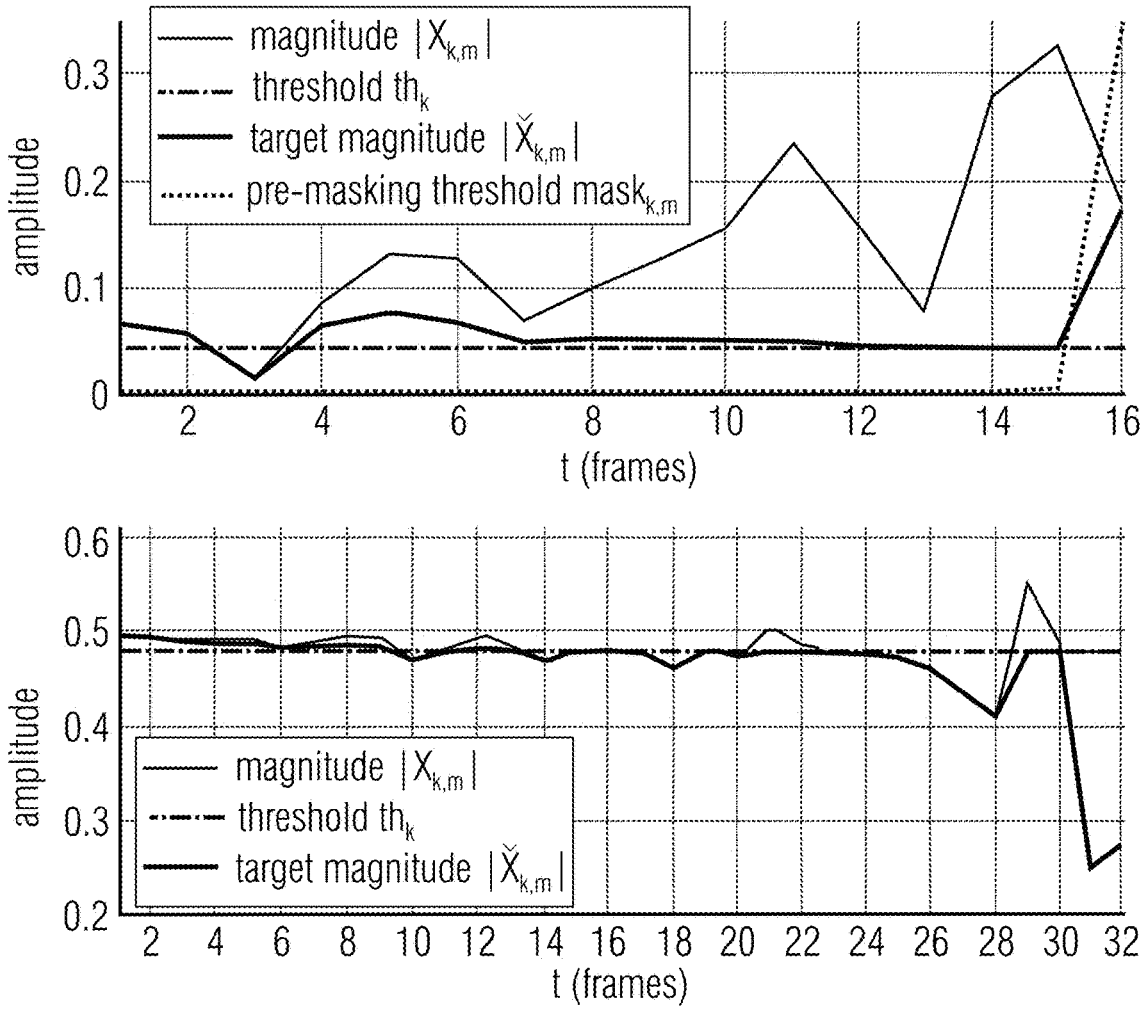
Illustration of the computation of the target magnitude signal $|\check{X}_{k,m}|$ for the castanet signal (top) and the glockenspiel signal (bottom) from Figure 13.10.
Fig. 13.14

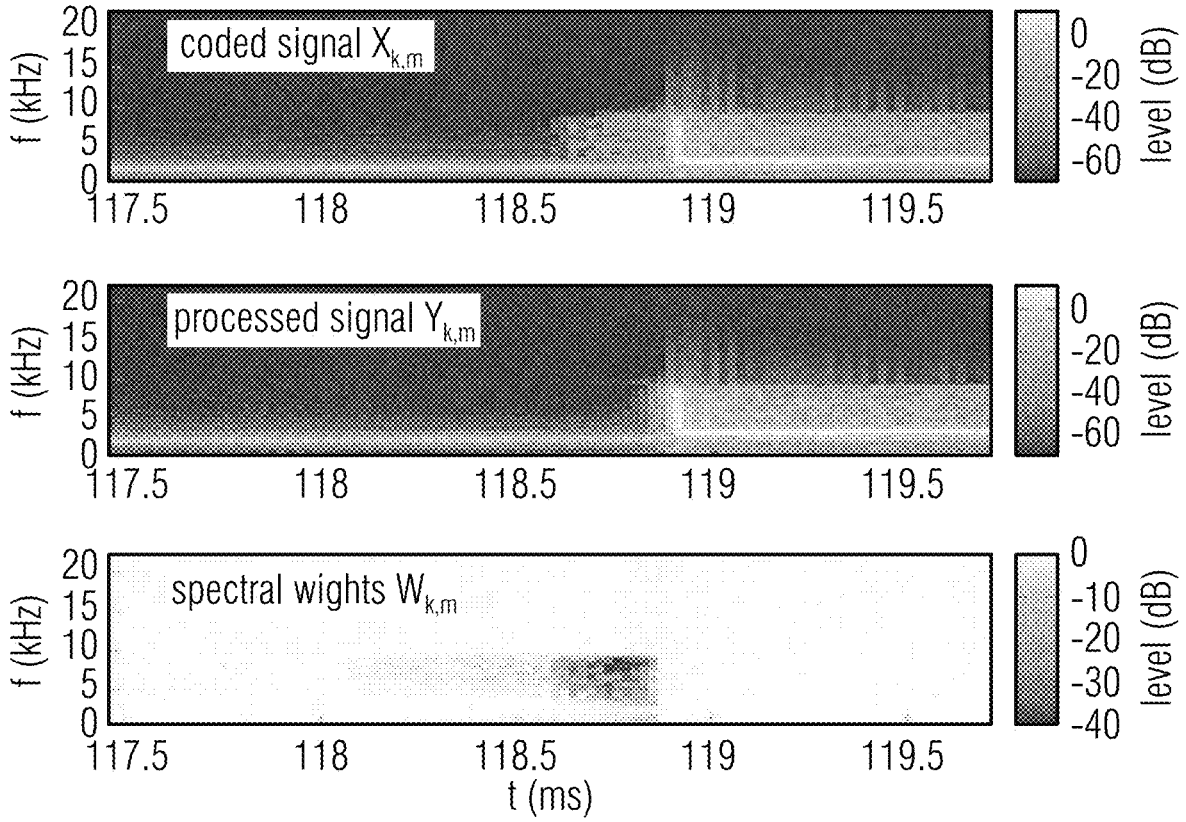
Top image: Spectrogram of a coded input signal $X_{k,m}$ (glockenspiel) around a transient event with preceding pre-echo artifact.
Middle image: Processed output signal $Y_{k,m}$ with reduced pre-echo.
Bottom image: Spectral weights $W_{k,m}$ for the pre-echo damping.
Fig. 13.15

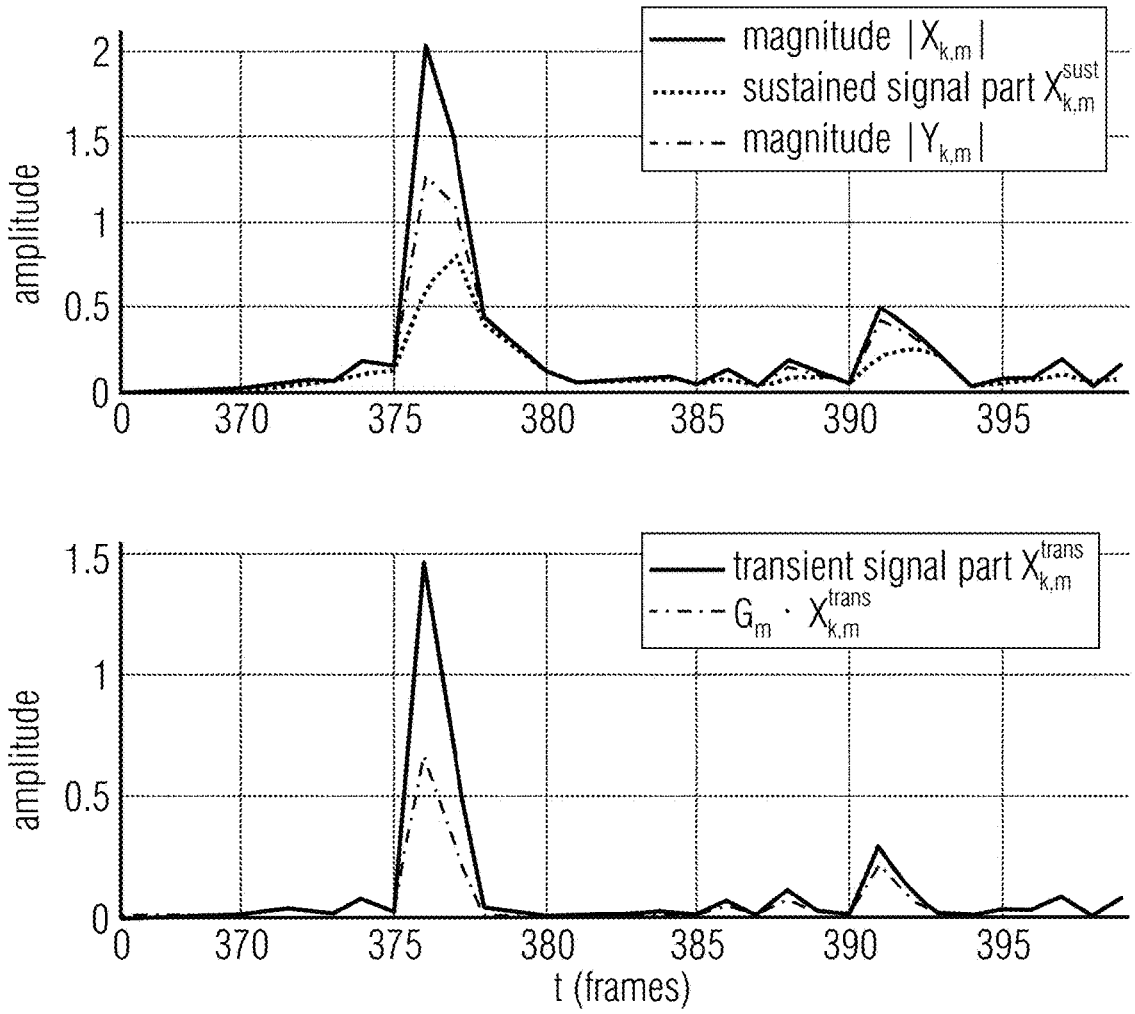
Top image: Input signal magnitude $|X_{k,m}|$ with the corresponding sustained signal part $X_{k,m}^{sust}$ and the output signal magnitude $|Y_{k,m}|$ as the result of the adaptive transient attack enhancement method.
Bottom image: Transient signal part $X_{k,m}^{trans}$ of the input signal $X_{k,m}$ before (gray) and after (black) the amplification with the gain curve $G_m$.
Fig. 13.16

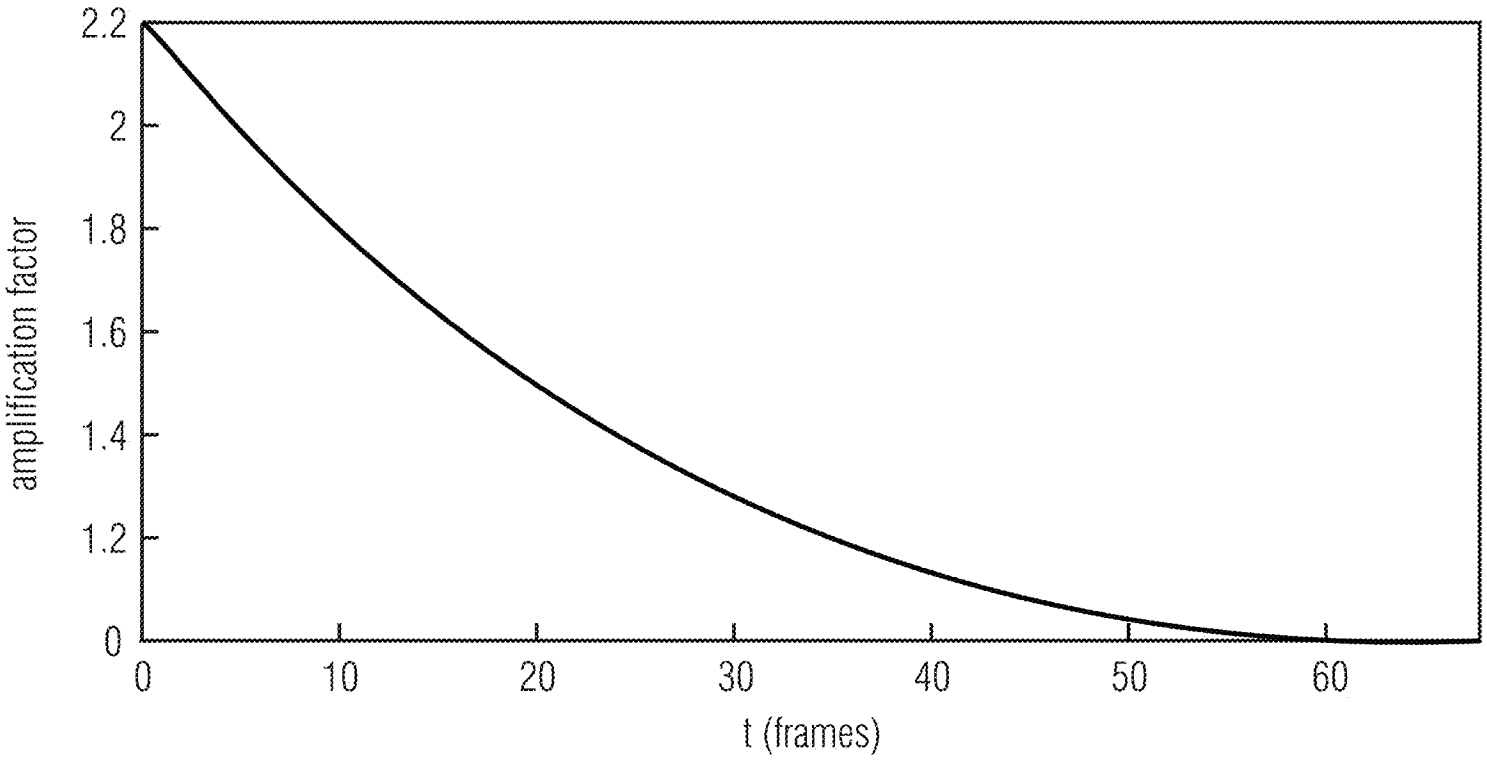
Faded out gain curve $G_m$ for the amplification of the transient signal part of an input signal. The transient onset is located at 0.
Fig. 13.17

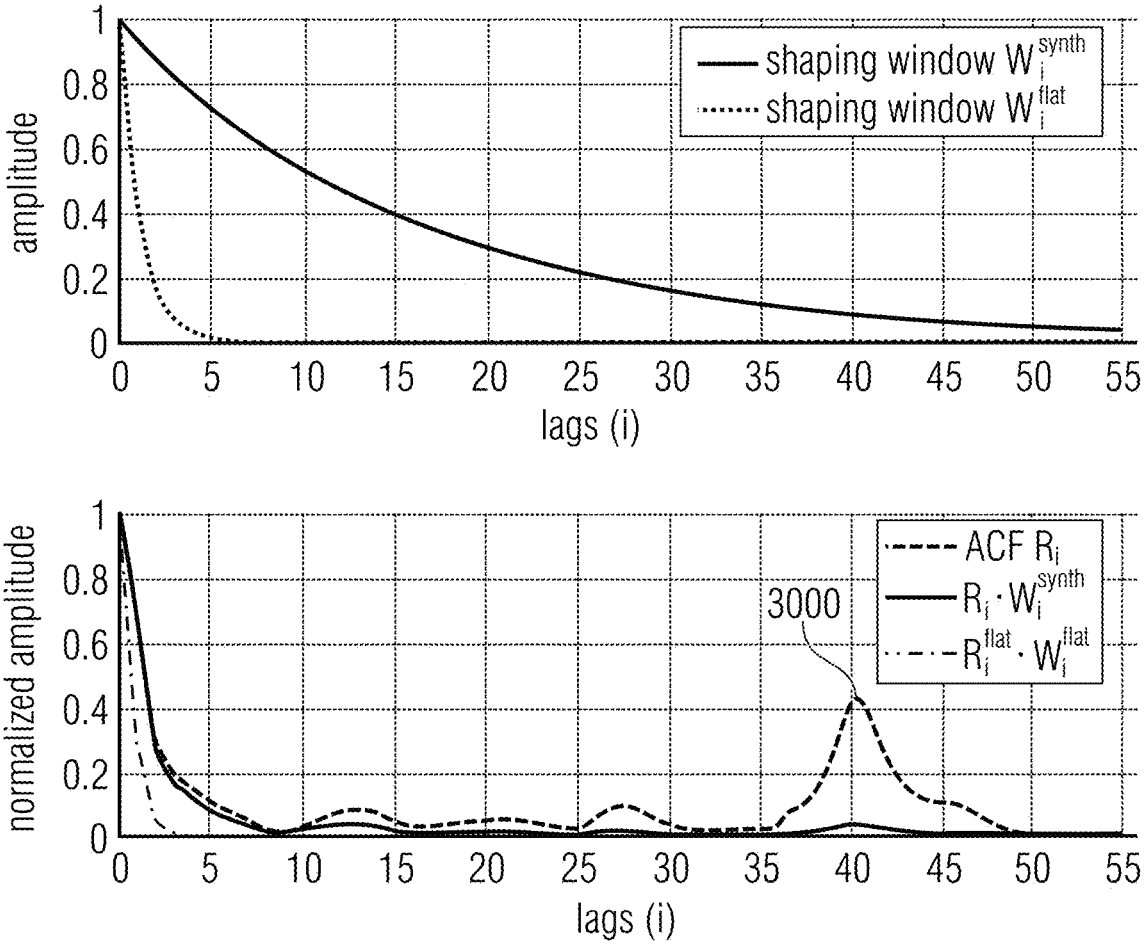
Top image: Window functions used to window the autocorrelation function $R_i$ of the input signal $X_{k,m}$ before the computation o the prediction coefficients for the inverse and the synthesis filter.
Bottom image: Original and windowed autocorrelation functions [56].
Fig. 13.18

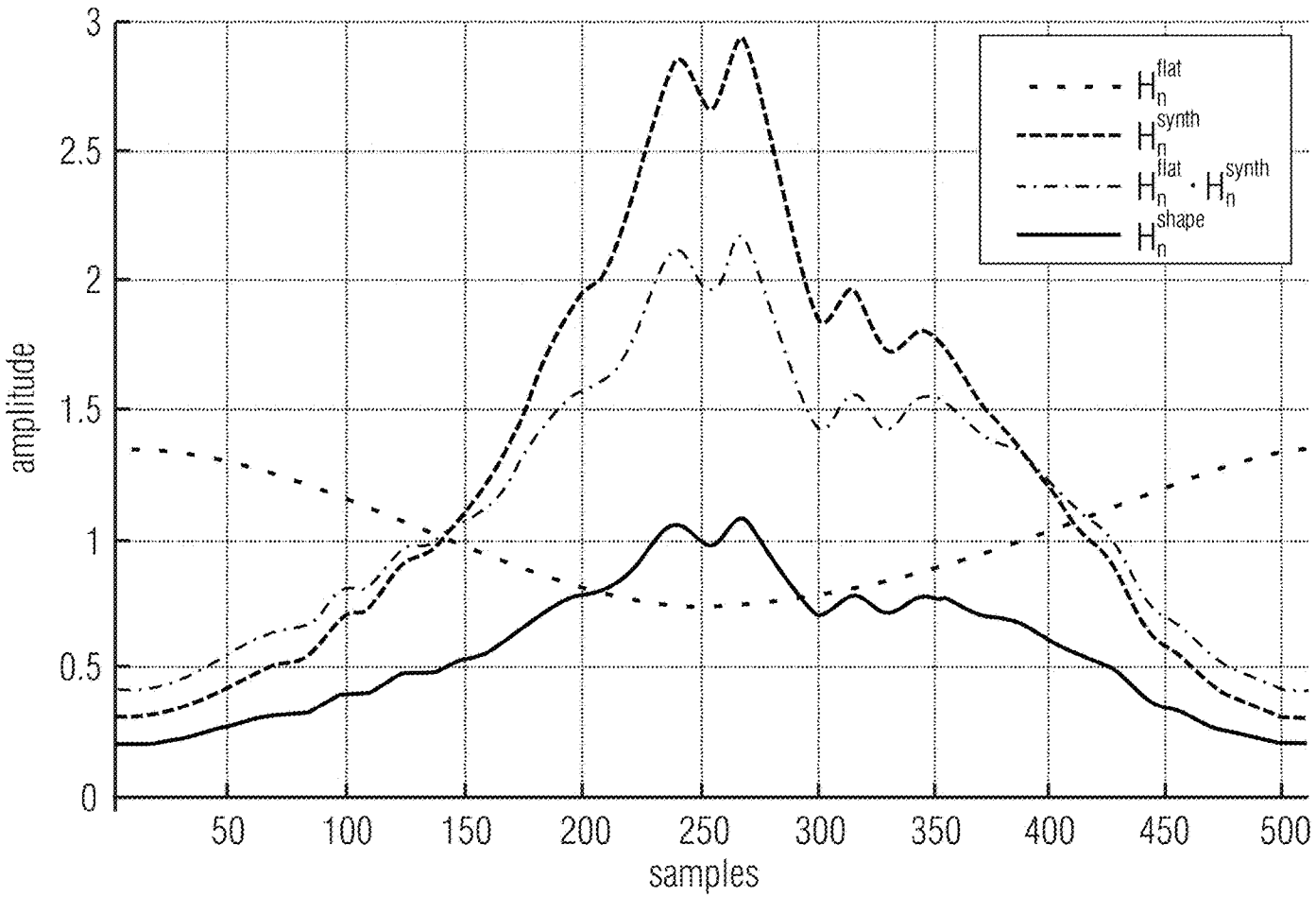
Time-domain transfer function $H_n^{shape}$ of the LPC shaping filter, as well as of the flattening and synthesis filters $H_n^{flat}$ and $H_n^{synth}$
Fig. 13.19

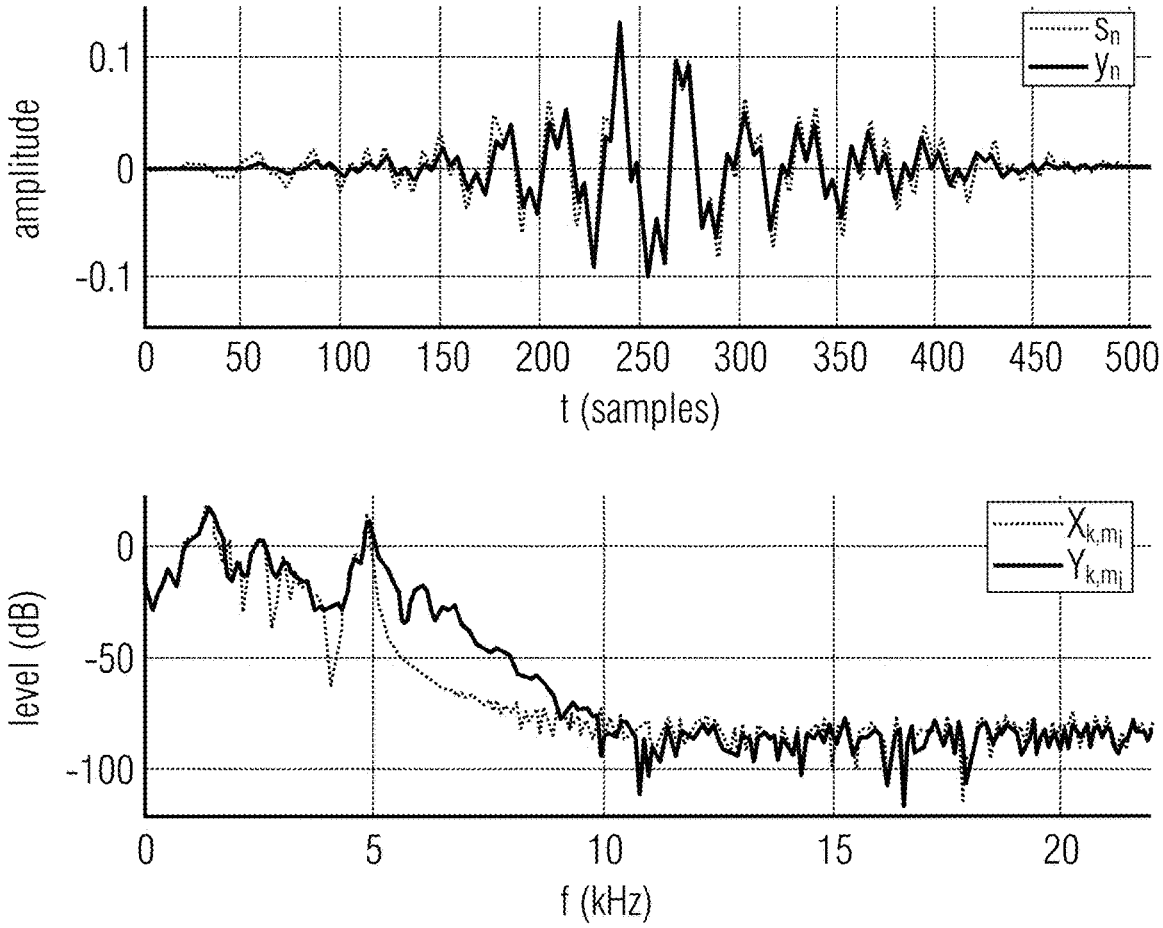
Top image: Input signal $s_n$ and output signal $y_n$ after the LPC envelope shaping.
Bottom image: Corresponding magnitude spectra of the input and output signal.
Fig. 13.20

APPARATUS AND METHOD FOR POST-PROCESSING AN AUDIO SIGNAL USING PREDICTION BASED SHAPING

CROSS-REFERENCE TO RELATED APPLICATIONS

This application is a continuation of copending International Application No. PCT/EP2018/025084, filed Mar. 29, 2018, which is incorporated herein by reference in its entirety, and additionally claims priority from European Application No. 17164332.3, filed Mar. 31, 2017, and from European Application No. 17183135.7, filed Jul. 25, 2017, which are both incorporated herein by reference in their entirety.

BACKGROUND OF THE INVENTION

The present invention relates to audio signal processing and, in particular, to audio signal post-processing in order to enhance the audio quality by removing coding artifacts.

Audio coding is the domain of signal compression that deals with exploiting redundancy and irrelevance in audio signals using psychoacoustic knowledge. At low bitrate conditions, often unwanted artifacts are introduced into the audio signal. A prominent artifact are temporal pre- and post-echoes that are triggered by transient signal components.

Especially in block-based audio processing, these pre- and post-echoes occur, since e.g. the quantization noise of spectral coefficients in a frequency domain transform coder is spread over the entire duration of one block. Semi-parametric coding tools like gap-filling, parametric spatial audio, or bandwidth extension can also lead to parameter band confined echo artefacts, since parameter-driven adjustments usually happen within a time block of samples.

The invention relates to a non-guided post-processor that reduces or mitigates subjective quality impairments of transients that have been introduced by perceptual transform coding.

State of the art approaches to prevent pre- and post-echo artifacts within a codec include transform codec block-switching and temporal noise shaping. A state of the art approach to suppress pre- and post-echo artifacts using post-processing techniques behind a codec chain is published in [1].

[1] Imen Samaali, Mania Turki-Hadj Alauane, Gael Mahe, "Temporal Envelope Correction for Attack Restoration in Low Bit-Rate Audio Coding", 17th European Signal Processing Conference (EUSIPCO 2009), Scotland, Aug. 24-28, 2009; and

[2] Jimmy Lapierre and Roch Lefebvre, "Pre-Echo Noise Reduction In Frequency-Domain Audio Codecs", ICASSP 2017, New Orleans.

The first class of approaches need to be inserted within the codec chain and cannot be applied a-posteriori on items that have been coded previously (e.g., archived sound material). Even though the second approach is essentially implemented as a post-processor to the decoder, it still needs control information derived from the original input signal at the encoder side.

SUMMARY

According to an embodiment, an apparatus for post-processing an audio signal may have: a time-spectrum-converter for converting the audio signal into a spectral representation having a sequence of spectral frames; a prediction analyzer for calculating prediction filter data for a prediction over frequency within a spectral frame; a shaping filter controlled by the prediction filter data for shaping the spectral frame to enhance a transient portion within the spectral frame; and a spectrum-time-converter for converting a sequence of spectral frames having a shaped spectral frame into a time domain.

According to another embodiment, a method for post-processing an audio signal may have the steps of: converting the audio signal into a spectral representation having a sequence of spectral frames; calculating prediction filter data for a prediction over frequency within a spectral frame; shaping, in response to the prediction filter data, the spectral frame to enhance a transient portion within the spectral frame; and converting a sequence of spectral frames having a shaped spectral frame into a time domain.

Still another embodiment may have a non-transitory digital storage medium having stored thereon a computer program for performing a method for post-processing an audio signal, having the steps of: converting the audio signal into a spectral representation having a sequence of spectral frames; calculating prediction filter data fora prediction over frequency within a spectral frame; shaping, in response to the prediction filter data, the spectral frame to enhance a transient portion within the spectral frame; and converting a sequence of spectral frames having a shaped spectral frame into a time domain, when said computer program is run by a computer.

An aspect of the present invention is based on the finding that transients can still be localized in audio signals that have been subjected to earlier encoding and decoding, since such earlier coding/decoding operations, although degrading the perceptual quality, do not completely eliminate transients. Therefore, a transient location estimator is provided for estimating a location in time of a transient portion using the audio signal or the time-frequency representation of the audio signal. In accordance with the present invention, a time-frequency representation of the audio signal is manipulated to reduce or eliminate the pre-echo in the time-frequency representation at the location in time before the transient location or to perform a shaping of the time-frequency representation at the transient location and, depending on the implementation, subsequent to the transient location so that an attack of the transient portion is amplified.

In accordance with the present invention, a signal manipulation is performed within a time-frequency representation of the audio signal based on the detected transient location. Thus, a quite accurate transient location detection and, on the one hand, a corresponding useful pre-echo reduction, and, on the other hand, an attack amplification can be obtained by processing operations in the frequency domain so that a final frequency-time conversion results in an automatic smoothing/distribution of manipulations over the entire frame and due to overlap add operations over more than one frame. In the end, this avoids audible clicks due to the manipulation of the audio signal and, of course, results in an improved audio signal without any pre-echo or with a reduced amount of pre-echo on the one hand and/or with sharpened attacks for the transient portions on the other hand.

Embodiments relate to a non-guided post-processor that reduces or mitigates subjective quality impairments of transients that have been introduced by perceptual transform coding.

In accordance with a further aspect of the present invention, transient improvement processing is performed without the specific need of a transient location estimator. In this aspect, a time-spectrum converter for converting the audio signal into a spectral representation comprising a sequence of spectral frames is used. A prediction analyzer then calculates prediction filter data for a prediction over frequency within a spectral frame and a subsequently connected shaping filter controlled by the prediction filter data shapes the spectral frame to enhance a transient portion within the spectral frame. The post-processing of the audio signal is completed with the spectrum-time conversion for converting a sequence of spectral frames comprising a shaped spectral frame back into a time domain.

Thus, once again, any modifications are done within a spectral representation rather than in a time domain representation so that any audible clicks, etc., due to a time domain processing are avoided. Furthermore, due to the fact that a prediction analyzer for calculating prediction filtered data for a prediction over frequency within a spectral frame is used, the corresponding time domain envelope of the audio signal is automatically influenced by subsequent shaping. Particularly, the shaping is done in such a way that, due to the processing within the spectral domain and due to the fact that the prediction over frequency is used, the time domain envelope of the audio signal is enhanced, i.e., made so that the time domain envelope has higher peaks and deeper valleys. In other words, the opposite of smoothing is performed by the shaping which automatically enhances transients without the need to actually locate the transients.

Advantageously, two kinds of prediction filter data are derived. The first prediction filter data are prediction filter data for a flattening filter characteristic and the second prediction filter data are prediction filter data for a shaping filter characteristic. In other words, the flattening filter characteristic is an inverse filter characteristic and the shaping filter characteristic is a prediction synthesis filter characteristic. However, once again, both these filter data are derived by performing a prediction over frequency within a spectral frame. Advantageously, time constants for the derivation of the different filter coefficients are different so that, for calculating the first prediction filter coefficients, a first time constant is used and for the calculation of the second prediction filter coefficients, a second time constant is used, where the second time constant is greater than the first time constant. This processing, once again, automatically makes sure that transient signal portions are much more influenced than non-transient signal portions. In other words, although the processing does not rely on an explicit transient detection method, the transient portions are much more influenced than the non-transient portion by means of the flattening and subsequent shaping that are based on different time constants.

Thus, in accordance with the present invention and due to the application of a prediction over frequency, an automatic kind of transient improvement procedure is obtained, in which the time domain envelope is enhanced (rather than smoothed).

Embodiments of the present invention are designed as post-processors on previously coded sound material operating without using further guidance information. Therefore, these embodiments can be applied on archived sound material that has been impaired through perceptual coding that has been applied to this archived sound material before it has been archived.

Embodiments of the first aspect consist of the following main processing steps:

- Unguided detection of transient locations within the signals to find the transient locations;
- Estimation of pre-echo duration and strength preceding transient;
- Deriving a suitable temporal gain curve for muting the pre-echo artefact;
- Ducking/Damping of estimated pre-echo through said adapted temporal gain curve before transient (to mitigate pre-echo);
- at attack, mitigate dispersion of attack;
- Exclusion of tonal or other quasi-stationary spectral bands from ducking.

Embodiments of the second aspect consist of the following main processing steps:

- Unguided detection of transient locations within the signals to find the transient locations (this step is optional);
- Sharpening of an attack envelope through application of a Frequency Domain Linear Prediction Coefficients (FD-LPC) flattening filter and a subsequent FD-LPC shaping filter, the flattening filter representing a smoothed temporal envelope and the shaping filter representing a less smooth temporal envelope, wherein the prediction gains of both filters is compensated for.

An embodiment is that of a post-processor that implements unguided transient enhancement as a last step in a multi-step processing chain. If other enhancement techniques are to be applied, e.g., unguided bandwidth extension, spectral gap filling etc., then the transient enhancement may be last in chain, such that the enhancement includes and is effective on signal modifications that have been introduced from previous enhancement stages.

All aspects of the invention can be implemented as post-processors, one, two or three modules can be computed in series or can share common modules (e.g., (I)STFT, transient detection, tonality detection) for computational efficiency.

It is to be noted that the two aspects described herein can be used independently from each other or together for post-processing an audio signal. The first aspect relying on transient location detection and pre-echo reduction and attack amplification can be used in order to enhance a signal without the second aspect. Correspondingly, the second aspect based on LPC analysis over frequency and the corresponding shaping filtering within the frequency domain does not necessarily rely on a transient detection but automatically enhances transients without an explicit transient location detector. This embodiment can be enhanced by a transient location detector but such a transient location detector is not necessarily required. Furthermore, the second aspect can be applied independently from the first aspect. Additionally, it is to be emphasized that, in other embodiments, the second aspect can be applied to an audio signal that has been post-processed by the first aspect. Alternatively, however, the order can be made in such a way that, in the first step, the second aspect is applied and, subsequently, the first aspect is applied in order to post-process an audio signal to improve its audio quality by removing earlier introduced coding artifacts.

Furthermore it is to be noted that the first aspect basically has two sub-aspects. The first sub-aspect is the pre-echo reduction that is based on the transient location detection and the second sub-aspect is the attack amplification based on the transient location detection. Advantageously, both sub-aspects are combined in series, wherein, even more advantageously, the pre-echo reduction is performed first and then the attack amplification is performed. In other embodiments, however, the two different sub-aspects can be implemented independent from each other and can even be combined with the second sub-aspect as the case may be. Thus, a pre-echo reduction can be combined with the prediction-based transient enhancement procedure without any attack amplification. In other implementations, a pre-echo reduction is not preformed but an attack amplification is performed together with a subsequent LPC-based transient shaping not necessarily requiring a transient location detection.

In a combined embodiment, the first aspect including both sub-aspects and the second aspect are performed in a specific order, where this order consists of first performing the pre-echo reduction, secondly performing the attack amplification and thirdly performing the LPC-based attack/transient enhancement procedure based on a prediction of a spectral frame over frequency.

BRIEF DESCRIPTION OF THE DRAWINGS

Embodiments of the present invention are subsequently discussed with respect to the accompanying drawings in which:

FIG. 12.1 illustrates a moving average filtering;

FIG. 12.2 illustrates a single pole recursive averaging and high-pass filtering;

FIG. 12.3 illustrates a time signal prediction and residual;

FIG. 12.4 illustrates an autocorrelation of the prediction error;

FIG. 12.5 illustrates a spectral envelope estimation with LPC;

FIG. 12.6 illustrates a temporal envelope estimation with LPC;

FIG. 12.7 illustrates an attack transient vs. frequency domain transient;

FIG. 12.8 illustrates spectra of a "frequency domain transient";

FIG. 12.9 illustrates the differentiation between transient, onset and attack;

FIG. 12.10 illustrates an absolute threshold in quiet and simultaneous masking;

FIG. 12.11 illustrates a temporal masking;

FIG. 12.12 illustrates a generic structure of a perceptual audio encoder;

FIG. 12.13 illustrates a generic structure of a perceptual audio decoder;

FIG. 12.14 illustrates a bandwidth limitation in perceptual audio coding;

FIG. 12.15 illustrates a degraded attack character;

FIG. 12.16 illustrates a pre-echo artifact;

FIG. 13.1 illustrates a transient enhancement algorithm;

FIG. 13.2 illustrates a transient detection: Detection Function (Castanets);

FIG. 13.3 illustrates a transient detection: Detection Function (Funk);

FIG. 13.4 illustrates a block diagram of the pre-echo reduction method;

FIG. 13.5 illustrates a detection of tonal components;

FIG. 13.6 illustrates a pre-echo width estimation—schematic approach;

FIG. 13.7 illustrates a pre-echo width estimation—examples;

FIG. 13.8 illustrates a pre-echo width estimation—detection function;

FIG. 13.9 illustrates a pre-echo reduction—spectrograms (Castanets);

FIG. 13.10 is an illustration of the pre-echo threshold determination (castanets);

FIG. 13.11 is an illustration of the pre-echo threshold determination for a tonal component;

FIG. 13.12 illustrates a parametric fading curve for the pre-echo reduction;

FIG. 13.13 illustrates a model of the pre-masking threshold;

FIG. 13.14 illustrates a computation of the target magnitude after the pre-echo reduction FIG. 13.15 illustrates a pre-echo reduction—spectrograms (glockenspiel);

FIG. 13.16 illustrates an adaptive transient attack enhancement;

FIG. 13.17 illustrates a fade-out curve for the adaptive transient attack enhancement;

FIG. 13.18 illustrates autocorrelation window functions;

FIG. 13.19 illustrates a time-domain transfer function of the LPC shaping filter; and FIG. 13.20 illustrates an LPC envelope shaping—input and output signal.

DETAILED DESCRIPTION OF THE INVENTION

Figure 1:
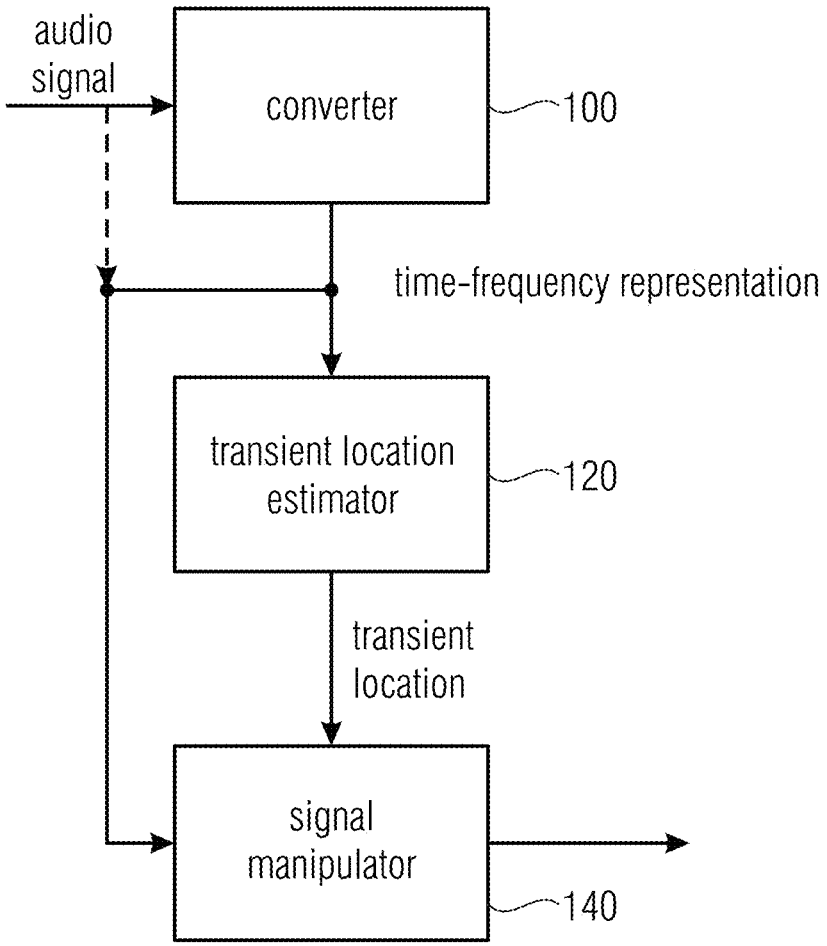
FIG. 1 is a schematic block diagram in accordance with the first aspect.
Figure 11:
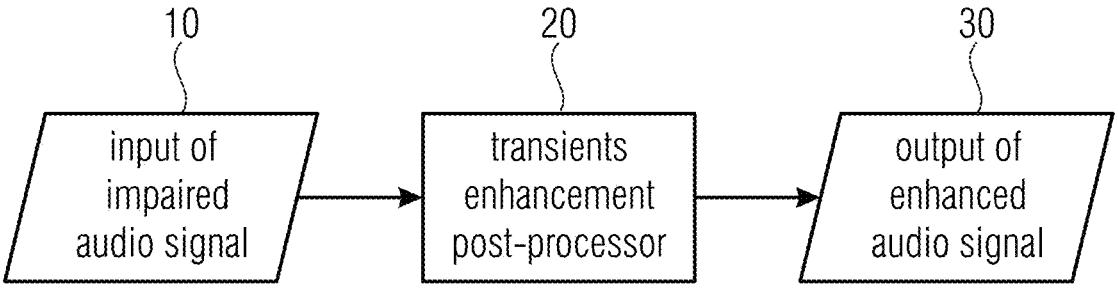
FIG. 11 illustrates a general setting of the present invention in accordance with the first and/or the second aspect as a transient enhancement post-processor.

FIG. 1 illustrates an apparatus for post-processing an audio signal using a transient location detection. Particularly, the apparatus for post-processing is placed, with respect to a general framework, as illustrated in FIG. 11. Particularly, FIG. 11 illustrates an input of an impaired audio signal shown at 10. This input is forwarded to a transient enhancement post-processor 20, and the transient enhancement post-processor 20 outputs an enhanced audio signal as illustrated at 30 in FIG. 11.

The apparatus for post-processing 20 illustrated in FIG. 1 comprises a converter 100 for converting the audio signal into a time-frequency representation. Furthermore, the apparatus comprises a transient location estimator 120 for estimating a location in time of a transient portion. The transient location estimator 120 operates either using the time-frequency representation as shown by the connection between the converter 100 and the transient location estimation 120 or uses the audio signal within a time domain. This alternative is illustrated by the broken line in FIG. 1. Furthermore, the apparatus comprises a signal manipulator 140 for manipulating the time-frequency representation. The signal manipulator 140 is configured to reduce or to eliminate a pre-echo in the time-frequency representation at a location in time before the transient location, where the transient location is signaled by the transient location estimator 120. Alternatively or additionally, the signal manipulator 140 is configured to perform a shaping of the time-frequency representation as illustrated by the line between the converter 100 and the signal manipulator 140 at the transient location so that an attack of the transient portion is amplified.

Thus, the apparatus for post-processing in FIG. 1 reduces or eliminates a pre-echo and/or shapes the time-frequency representation to amplify an attack of the transient portion.

Figure 2A:
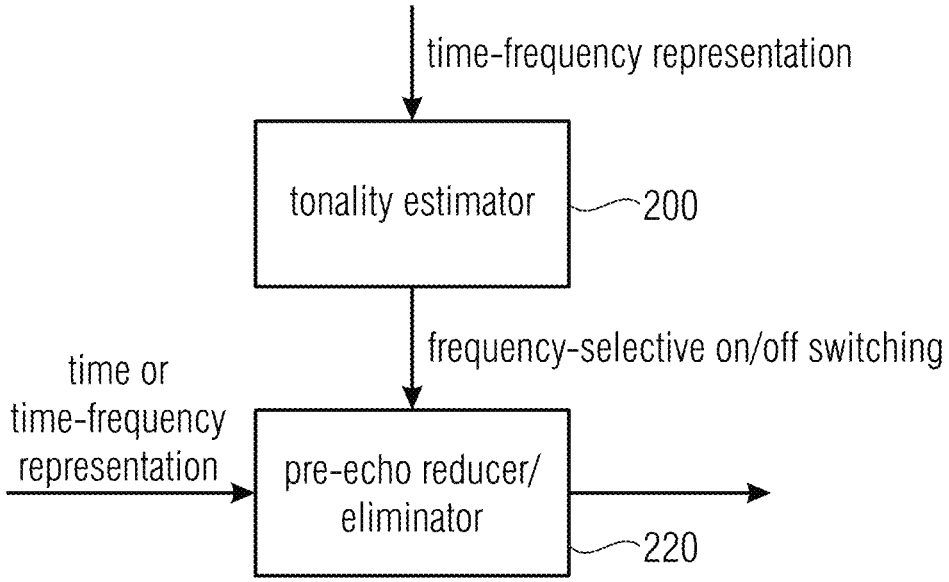
FIG. 2*a* is an implementation of the first aspect based on a tonality estimator.

FIG. 2*a* illustrates a tonality estimator 200. Particularly, the signal manipulator 140 of FIG. 1 comprises such a tonality estimator 200 for detecting tonal signal components in the time-frequency representation preceding the transient portion in time. Particularly, the signal manipulator 140 is configured to apply the pre-echo reduction or elimination in a frequency-selective way so that, at frequencies where tonal signal components have been detected, the signal manipulation is reduced or switched off compared to frequencies, where the tonal signal components have not been detected. In this embodiment, the pre-echo reduction/elimination as illustrated by block 220 is, therefore, frequency-selectively switched on or off or at least gradually reduced at frequency locations in certain frames, where tonal signal components have been detected. This makes sure that tonal signal components are not manipulated, since, typically, tonal signal components cannot, at the same time, be a pre-echo or a transient. This is due to the fact that a typical nature of the transient is that a transient is a broad-band effect that concurrently influences many frequency bins, while, on the contrary, a tonal component is, with respect to a certain frame, a certain frequency bin having a peak energy while other frequencies in this frame have only a low energy.

Figure 2B:
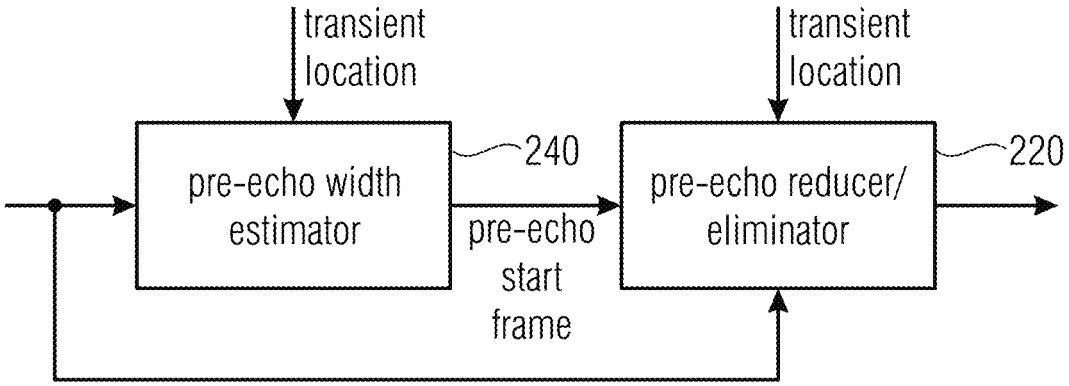
FIG. 2*b* is an implementation of the first aspect based on a pre-echo width estimation.
Figure 2C:
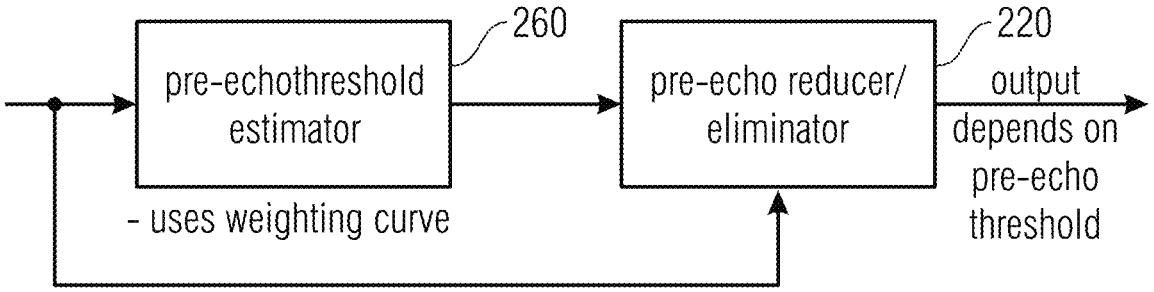
FIG. 2*c* is an embodiment of the first aspect based on a pre-echo threshold estimation.

Furthermore, as illustrated in FIG. 2*b*, the signal manipulator 140 comprises a pre-echo width estimator 240. This block is configured for estimating a width in time of the pre-echo preceding the transient location. This estimation makes sure that the correct time portion before the transient location is manipulated by the signal manipulator 140 in an effort to reduce or eliminate the pre-echo. The estimation of the pre-echo width in time is based on a development of a signal energy of the audio signal over time in order to determine a pre-echo start frame in the time-frequency representation comprising a plurality of subsequent audio signal frames. Typically, such a development of the signal energy of the audio signal over time will be an increasing or constant signal energy, but will not be a falling energy development over time.

Figure 2D:
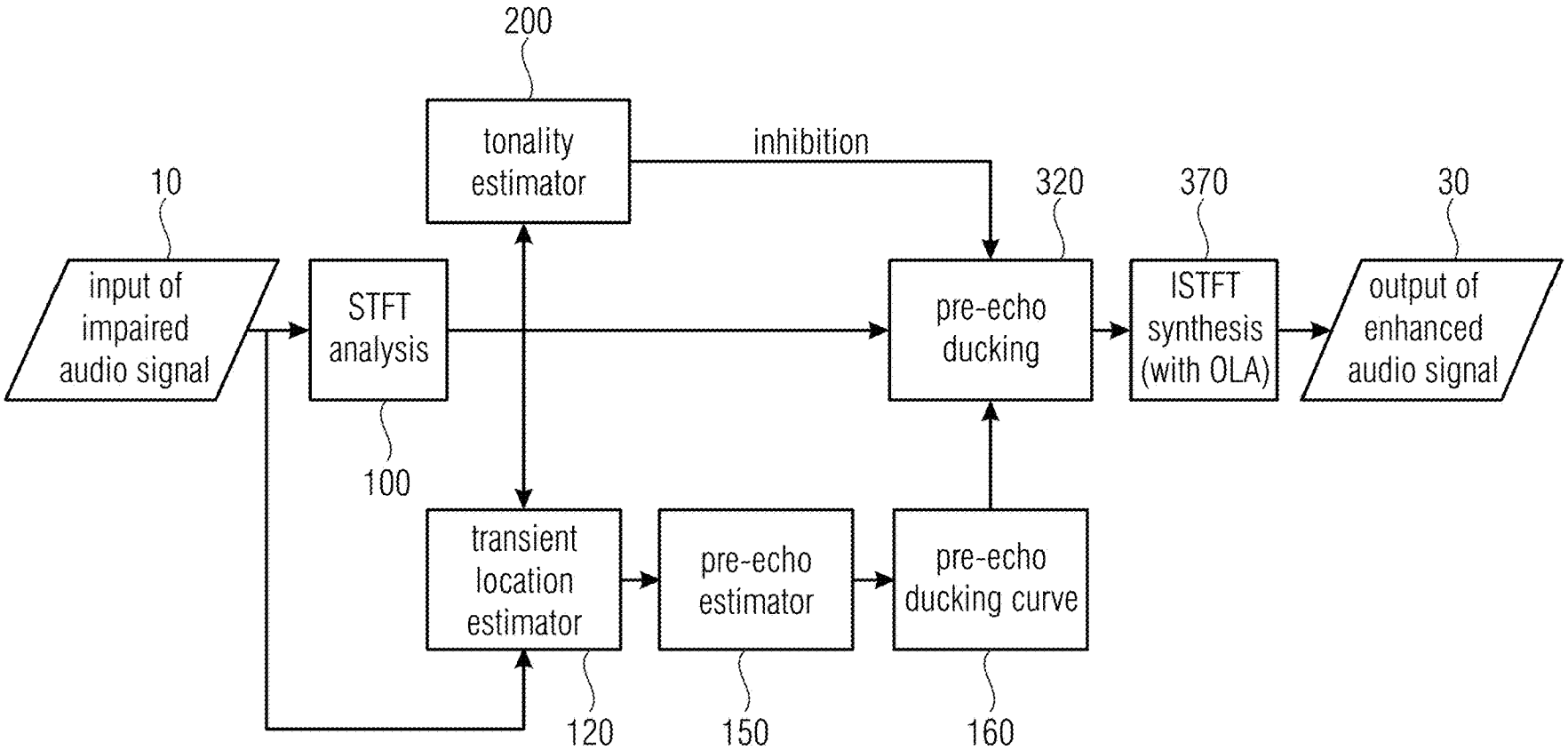
FIG. 2*d* is an embodiment of the first sub-aspect related to pre-echo reduction/elimination.

FIG. 2*b* illustrates a block diagram of an embodiment of the post-processing in accordance with a first sub-aspect of the first aspect of the present invention, i.e., where a pre-echo reduction or elimination or, as stated in FIG. 2*d*, a pre-echo "ducking" is performed.

An impaired audio signal is provided at an input 10 and this audio signal is input into a converter 100 that is, advantageously, implemented as short-time Fourier transform analyzer operating with a certain block length and operating with overlapping blocks.

Furthermore, the tonality estimator 200 as discussed in FIG. 2*a* is provided for controlling a pre-echo ducking stage 320 that is implemented in order to apply a pre-echo ducking curve 160 to the time-frequency representation generated by block 100 in order to reduce or eliminate pre-echoes. The output of block 320 is then once again converted into the time domain using a frequency-time converter 370. This frequency-time converter may be implemented as an inverse short-time Fourier transform synthesis block that operates with an overlap-add operation in order to fade-in/fade-out from each block to the next one in order to avoid blocking artifacts.

The result of block 370 is the output of the enhanced audio signal 30.

Figure 3A:
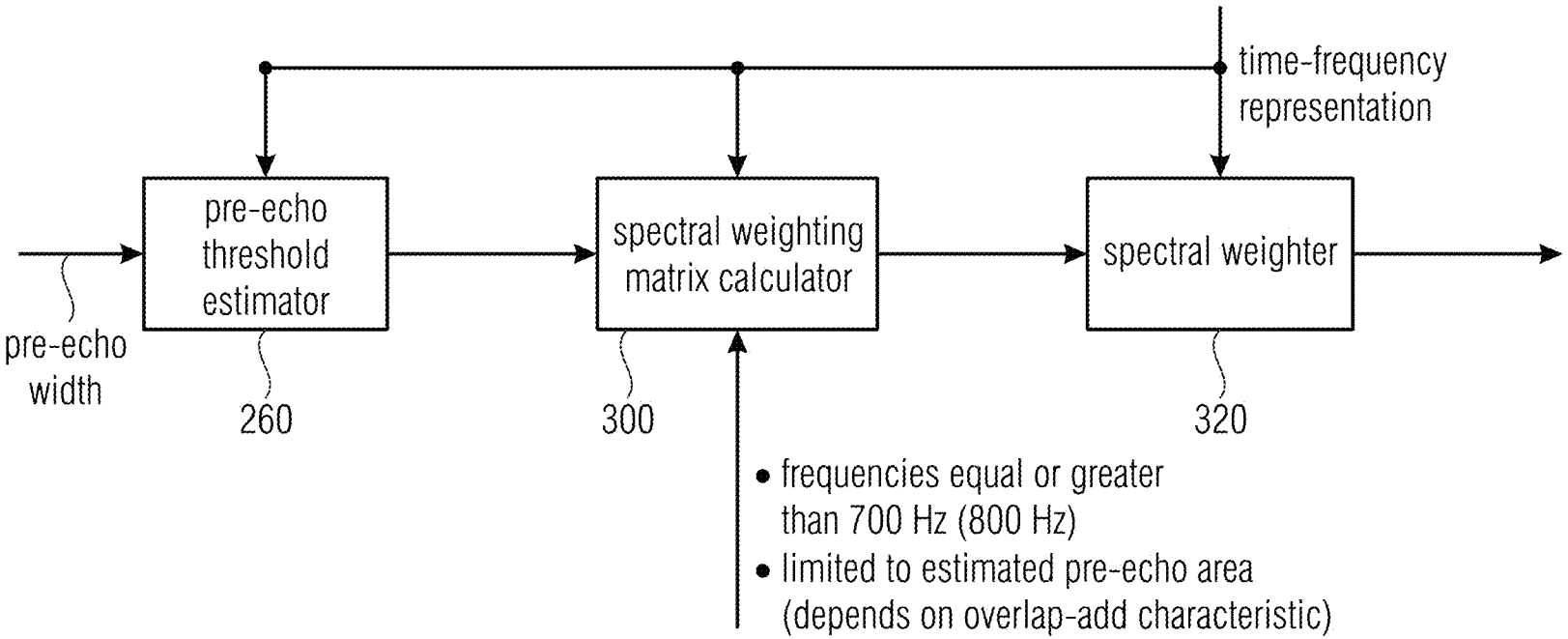
FIG. 3*a* is an implementation of the first sub-aspect.
Figure 3B:
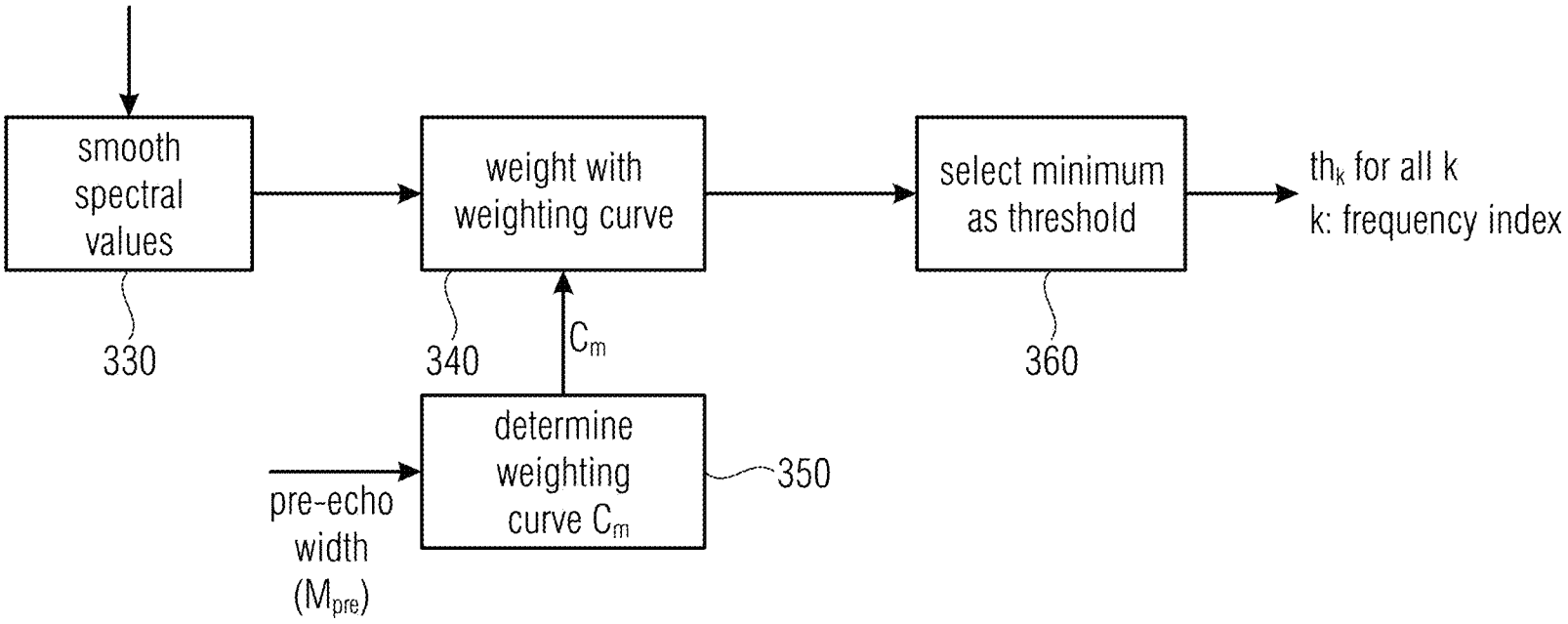
FIG. 3*b* is an implementation of the first sub-aspect.
Figure 4:
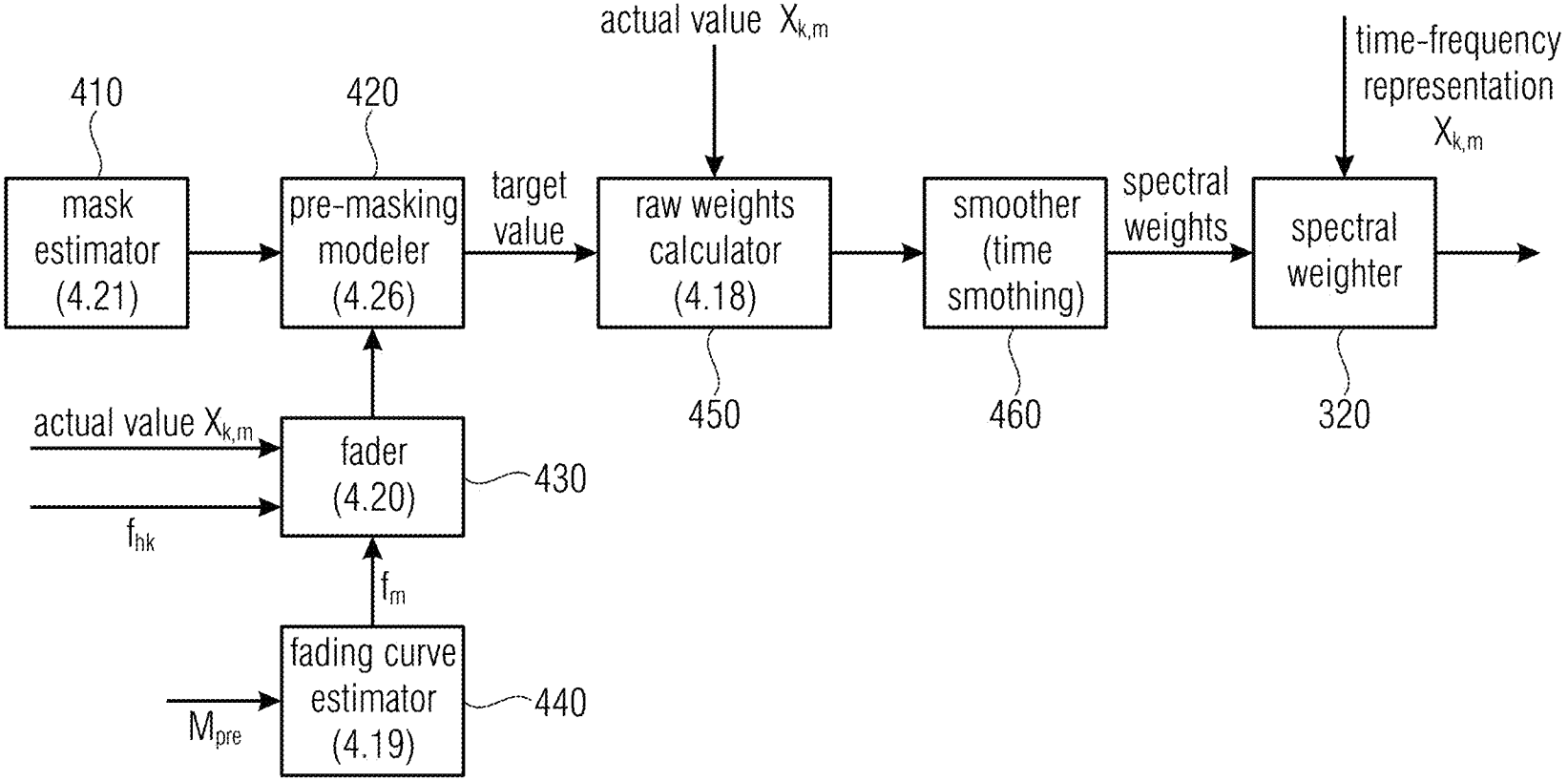
FIG. 4 is a further implementation of the first sub-aspect.

Advantageously, the pre-echo ducking curve block 160 is controlled by a pre-echo estimator 150 collecting characteristics related to the pre-echo such as the pre-echo width as determined by block 240 of FIG. 2*b* or the pre-echo threshold as determined by block 260 or other pre-echo characteristics as discussed with respect to FIG. 3*a*, FIG. 3*b*, FIG. 4.

Advantageously, as outlined in FIG. 3*a*, the pre-echo ducking curve 160 can be considered to be a weighting matrix that has a certain frequency-domain weighting factor for each frequency bin of a plurality of time frames as generated by block 100. FIG. 3*a* illustrates a pre-echo threshold estimator 260 controlling a spectral weighting matrix calculator 300 corresponding to block 160 in FIG. 2*d*, that controls a spectral weighter 320 corresponding to the pre-echo ducking operation 320 of FIG. 2*d*.

Advantageously, the pre-echo threshold estimator 260 is controlled by the pre-echo width and also receives information on the time-frequency representation. The same is true for the spectral weighting matrix calculator 300 and, of course, for the spectral weighter 320 that, in the end, applies the weighting factor matrix to the time-frequency representation in order to generate a frequency-domain output signal, in which the pre-echo is reduced or eliminated. Advantageously, the spectral weighting matrix calculator 300 operates in a certain frequency range being equal to or greater than 700 Hz and advantageously being equal than or greater than 800 Hz. Furthermore, the spectral weighting matrix calculator 300 is limited to calculate weighting factors so that only for the pre-echo area that, additionally, depends on an overlap-add characteristic as applied by the converter 100 of FIG. 1. Furthermore, the pre-echo threshold estimator 260 is configured for estimating pre-echo thresholds for spectral values in the time-frequency representation within a pre-echo width as, for example, determined by block 240 of FIG. 2*b*, wherein the pre-echo thresholds indicate amplitude thresholds of corresponding spectral values that should occur subsequent to the pre-echo reduction or elimination, i.e., that should correspond to the true signal amplitudes without a pre-echo.

Advantageously, the pre-echo threshold estimator 260 is configured to determine the pre-echo threshold using a weighting curve having an increasing characteristic from a start of the pre-echo width to the transient location. Particularly, such a weighting curve is determined by block 350 in FIG. 3*b* based on the pre-echo width indicated by $M_{pre}$. Then, this weighting curve $C_m$ is applied to spectral values in block 340, where the spectral values have been smoothed before by means of block 330. Then, as illustrated in block 360, minima are selected as the thresholds for all frequency indices k. Thus, in accordance with an embodiment, the pre-echo threshold estimator 260 is configured to smooth 330 the time-frequency representation over a plurality of subsequent frames of the time-frequency representation and to weight (340) the smoothed time-frequency representation using a weighting curve having an increasing characteristic from a start of the pre-echo width to the transient location. This increasing characteristic makes sure that a certain energy increase or decrease of the normal "signal", i.e., a signal without a pre-echo artifact is allowed.

In a further embodiment, the signal manipulator 140 is configured to use a spectral weights calculator 300, 160 for calculating individual spectral weights for spectral values of the time-frequency representation. Furthermore, a spectral weighter 320 is provided for weighting spectral values of the time-frequency representation using the spectral weights to obtain a manipulated time-frequency representation. Thus, the manipulation is performed within the frequency domain by using weights and by weighting individual time/frequency bins as generated by the converter 100 of FIG. 1.

Advantageously, the spectral weights are calculated as illustrated in the specific embodiment illustrated in FIG. 4. The spectral weighter 320 receives, as a first input, the time-frequency representation $X_{k,m}$ and receives, as a second input, the spectral weights. These spectral weights are calculated by raw weights calculator 450 that is configured to determine raw spectral weights using an actual spectral value and a target spectral value that are both input into this block. The raw weights calculator operates as illustrated in equation 4.18 illustrated later on, but other implementations relying on an actual value on the one hand and a target value on the other hand are useful as well. Furthermore, alternatively or additionally, the spectral weights are smoothed over time in order to avoid artifacts and in order to avoid changes that are too strong from one frame to the other.

Advantageously, the target value input into the raw weights calculator 450 is specifically calculated by a pre-masking modeler 420. The pre-masking modeler 420 may operate in accordance with equation 4.26 defined later, but other implementations can be used as well that rely on psychoacoustic effects and, particularly rely on a pre-masking characteristic that is typically occurring for a transient. The pre-masking modeler 420 is, on the one hand, controlled by a mask estimator 410 specifically calculating a mask relying on the pre-masking type acoustic effect. In an embodiment, the mask estimator 410 operates in accordance with equation 4.21 described later on but, alternatively, other mask estimations can be applied that rely on the psychoacoustic pre-masking effect.

Furthermore, a fader 430 is used for fade-in a reduction or elimination of the pre-echo using a fading curve over a plurality of frames at the beginning of the pre-echo width. This fading curve may be controlled by the actual value in a certain frame and by the determined pre-echo threshold $th_k$. The fader 430 makes sure that the pre-echo reduction/elimination not only starts at once, but is smoothly faded in. An implementation is illustrated later on in connection with equation 4.20, but other fading operations are useful as well. Advantageously, the fader 430 is controlled by a fading curve estimator 440 controlled by the pre-echo width $M_{pre}$ as determined, for example, by the pre-echo width estimator 240. Embodiments of the fading curve estimator operate in accordance with equation 4.19 discussed later on, but other implementations are useful as well. All these operations by blocks 410, 420, 430, 440 are useful to calculate a certain target value so that, in the end, together with the actual value, a certain weight can be determined by block 450 that is then applied to the time-frequency representation and, particularly, to the specific time/frequency bin subsequent to smoothing.

Naturally, a target value can also be determined without any pre-masking psychoacoustic effect and without any fading. Then, the target value would be directly the threshold $th_k$, but it has been found that the specific calculations performed by blocks 410, 420, 430, 440 result in an improved pre-echo reduction in the output signal of the spectral weighter 320.

Thus, it is of advantage to determine the target spectral value so that the spectral value having an amplitude below a pre-echo threshold is not influenced by the signal manipulation or to determine the target spectral values using the pre-masking model 410, 420 so that a damping of a spectral value in the pre-echo area is reduced based on the pre-masking model 410.

Advantageously, the algorithm performed in the converter 100 is so that the time-frequency representation comprises complex-valued spectral values. On the other hand, however, the signal manipulator is configured to apply real-valued spectral weighting values to the complex-valued spectral values so that, subsequent to the manipulation in block 320, only the amplitudes have been changed, but the phases are the same as before the manipulation.

Figure 5:
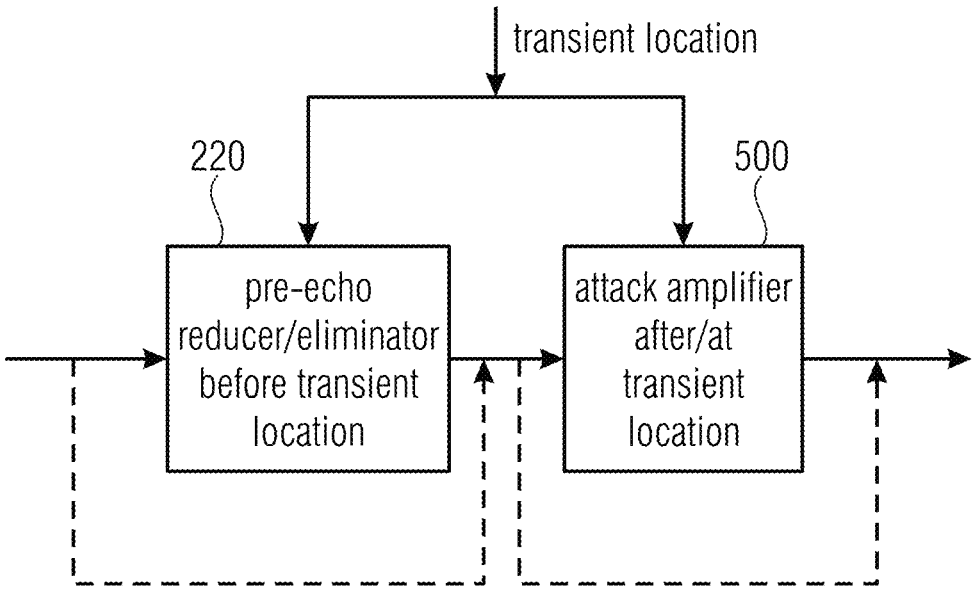
FIG. 5 illustrates the two sub-aspects of the first aspect of the present invention.

FIG. 5 illustrates an implementation of the signal manipulator 140 of FIG. 1. Particularly, the signal manipulator 140 either comprises the pre-echo reducer/eliminator operating before the transient location illustrated at 220 or comprises an attack amplifier operating after/at the transient location as illustrated by block 500. Both blocks 220, 500 are controlled by a transient location as determined by the transient location estimator 120. The pre-echo reducer 220 corresponds to the first sub-aspect and block 500 corresponds to the second sub-aspect in accordance with the first aspect of the present invention. Both aspects can be used alternatively to each other, i.e., without the other aspect as illustrated by the broken lines in FIG. 5. On the other hand, however, it is of advantage to use both operations in the specific order illustrated in FIG. 5, i.e., that the pre-echo reducer 220 is operative and the output of the pre-echo reducer/eliminator 220 is input into the attack amplifier 500.

Figure 6A:
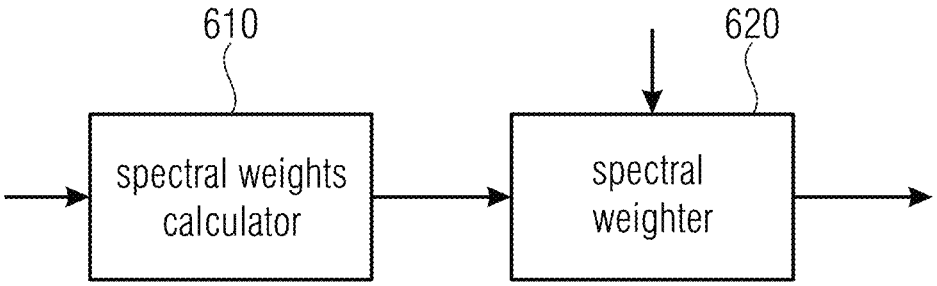
FIG. 6*a* illustrates an overview over the second sub-aspect.

FIG. 6*a* illustrates an embodiment of the attack amplifier 500. Again, the attack amplifier 500 comprises a spectral weights calculator 610 and a subsequently connected spectral weighter 620. Thus, the signal manipulator is configured to amplify 500 spectral values within a transient frame of the time-frequency representation and advantageously to additionally amplify spectral values within one or more frames following the transient frame within the time-frequency representation.

Advantageously, the signal manipulator 140 is configured to only amplify spectral values above a minimum frequency, where this minimum frequency is greater than 250 Hz and lower than 2 KHz. The amplification can be performed until the upper border frequency, since attacks at the beginning of the transient location typically extend over the whole high frequency range of the signal.

Figure 6B:
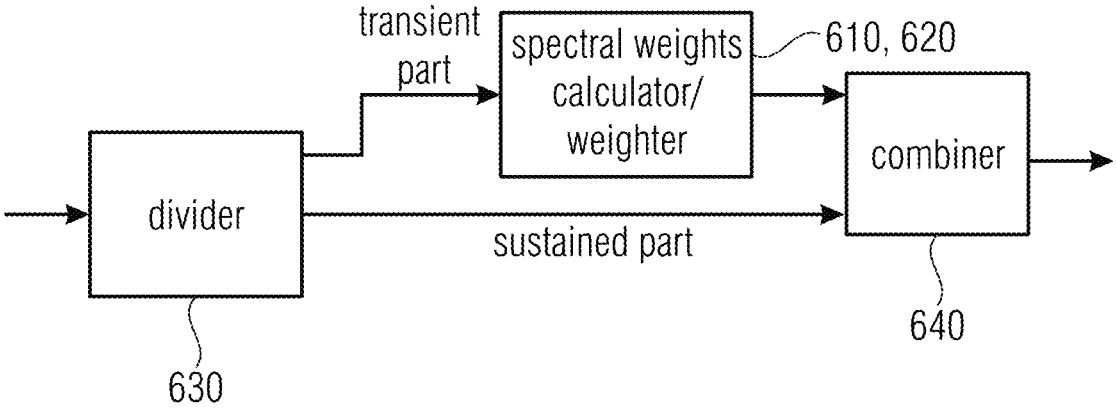
FIG. 6*b* illustrates an implementation of the second sub-aspect relying on a division into a transient part and a sustained part.
Figure 6C:
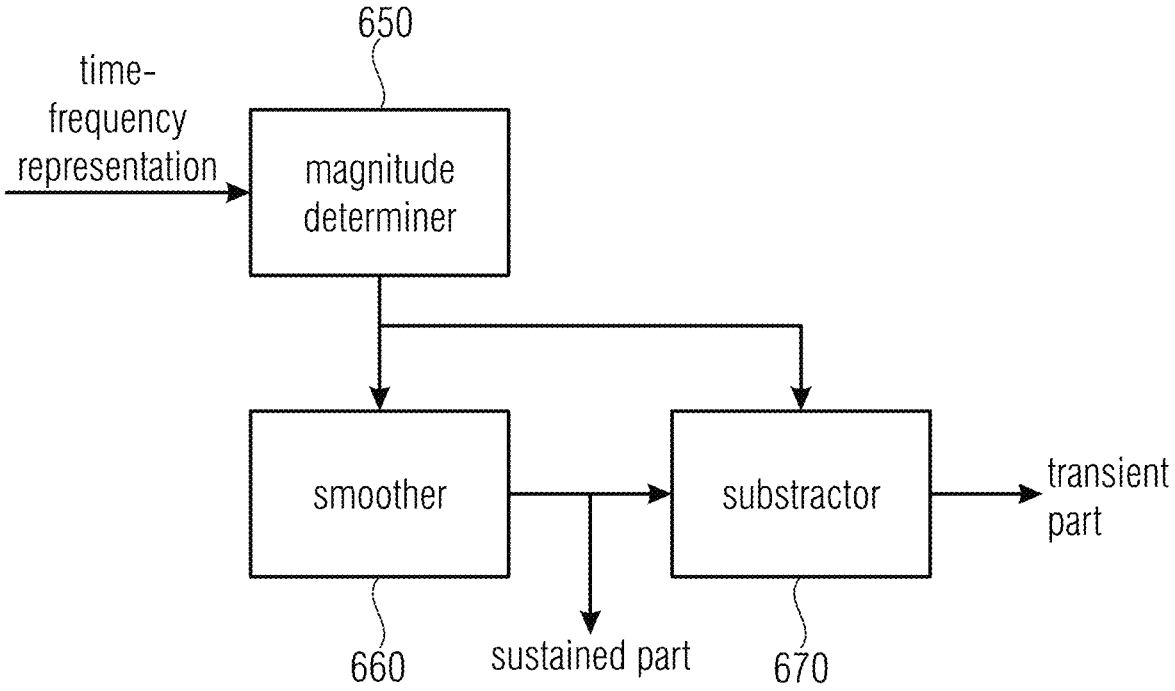
FIG. 6*c* illustrates a further embodiment of the division of FIG. 6*b;*
Figure 6D:
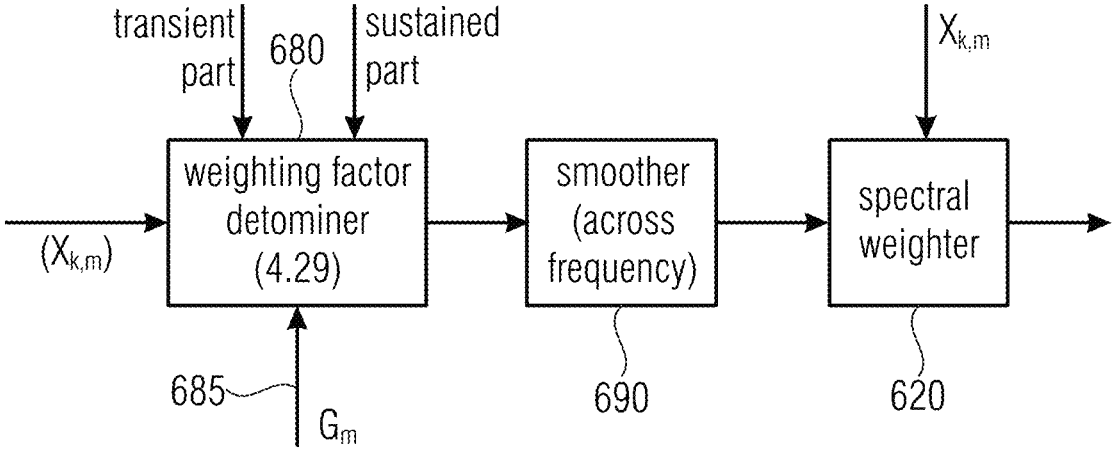
FIG. 6*d* illustrates a further implementation of the second sub-aspect.
Figure 6E:
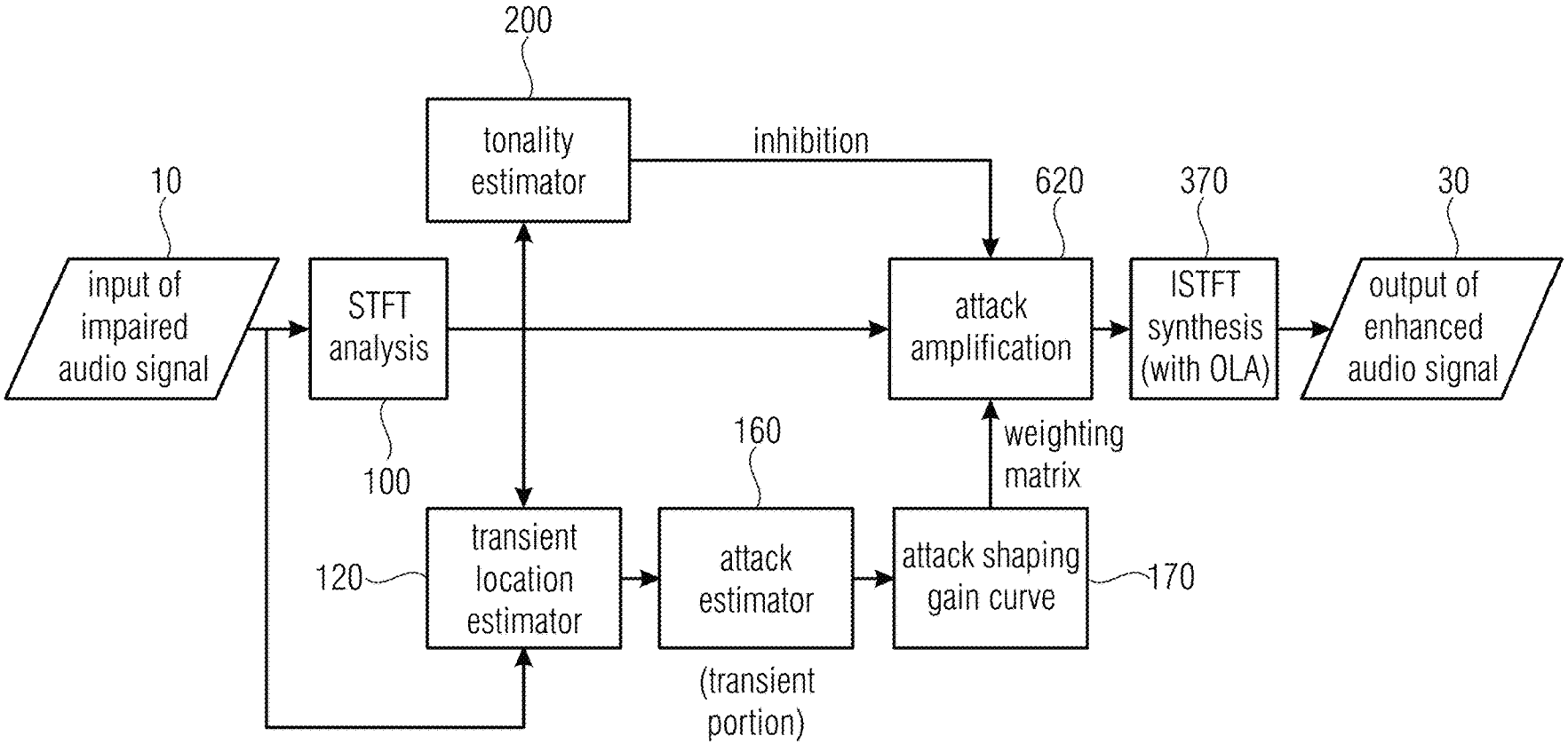
FIG. 6*e* illustrates a further embodiment of the second sub-aspect.

Advantageously, the signal manipulator 140 and, particularly, the attack amplifier 500 of FIG. 5 comprises a divider 630 for dividing the frame within a transient part on the one hand and a sustained part on the other hand. The transient part is then subjected to the spectral weighting and, additionally, the spectral weights are also calculated depending on information on the transient part. Then, only the transient part is spectrally weighted and the result of block 610, 620 in FIG. 6*b* on the one hand and the sustained part as output by the divider 630 are finally combined within a combiner 640 in order to output an audio signal where an attack has been amplified. Thus, the signal manipulator 140 is configured to divide 630 the time-frequency representation at the transient location into a sustained part and the transient part and to advantageously, additionally divide frames subsequent to the transient location as well. The signal manipulator 140 is configured to only amplify the transient part and to not amplify or manipulate the sustained part.

As stated, the signal manipulator 140 is configured to also amplify a time portion of the time-frequency representation subsequent to the transient location in time using a fade-out characteristic 685 as illustrated by block 680. Particularly, the spectral weights calculator 610 comprises a weighting factor determiner 680 receiving information on the transient part on the one hand, on the sustained part on the other hand, on the fade-out curve $G_m$ 685 and advantageously also receiving information on the amplitude of the corresponding spectral value $X_{k,m}$. Advantageously, the weighting factor determiner 680 operates in accordance with equation 4.29 discussed later on, but other implementations relying on information on the transient part, on the sustained part and the fade-out characteristic 685 are useful as well.

Subsequent to the weighting factor determination 680, a smoothing across frequency is performed in block 690 and, then, at the output of block 690, the weighting factors for the individual frequency values are available and are ready to be used by the spectral weighter 620 in order to spectrally weight the time/frequency representation. Advantageously, of the amplified part as determined, for example by a maximum of the fade-out characteristics 685 is predetermined and between 300% and 150%. In an embodiment, as maximum amplification factor of 2.2 is used that decreases, over a number of frames, until a value of 1, where, as illustrated in FIG. 13.17, such a decrease is obtained, for example, after 60 frames. Although FIG. 13.17 illustrates a kind of exponential decay, other decays, such as a linear decay or a cosine decay can be used as well.

Advantageously, the result of the signal manipulation 140 is converted from the frequency domain into the time domain using a spectral-time converter 370 illustrated in FIG. 2*d*. Advantageously, the spectral-time converter 370 applies an overlap-add operation involving at least two adjacent frames of the time-frequency representation, but multi-overlap procedures can be used as well, wherein an overlap of three or four frames is used.

Advantageously, the converter 100 on the one hand and the other converter 370 on the other hand apply the same hop size between 1 and 3 ms or an analysis window having a window length between 2 and 6 ms. And, advantageously, the overlap range on the one hand, the hop size on the other hand or the windows applied by the time-frequency converter 100 and the frequency-time converter 370 are equal to each other.

Figure 7:
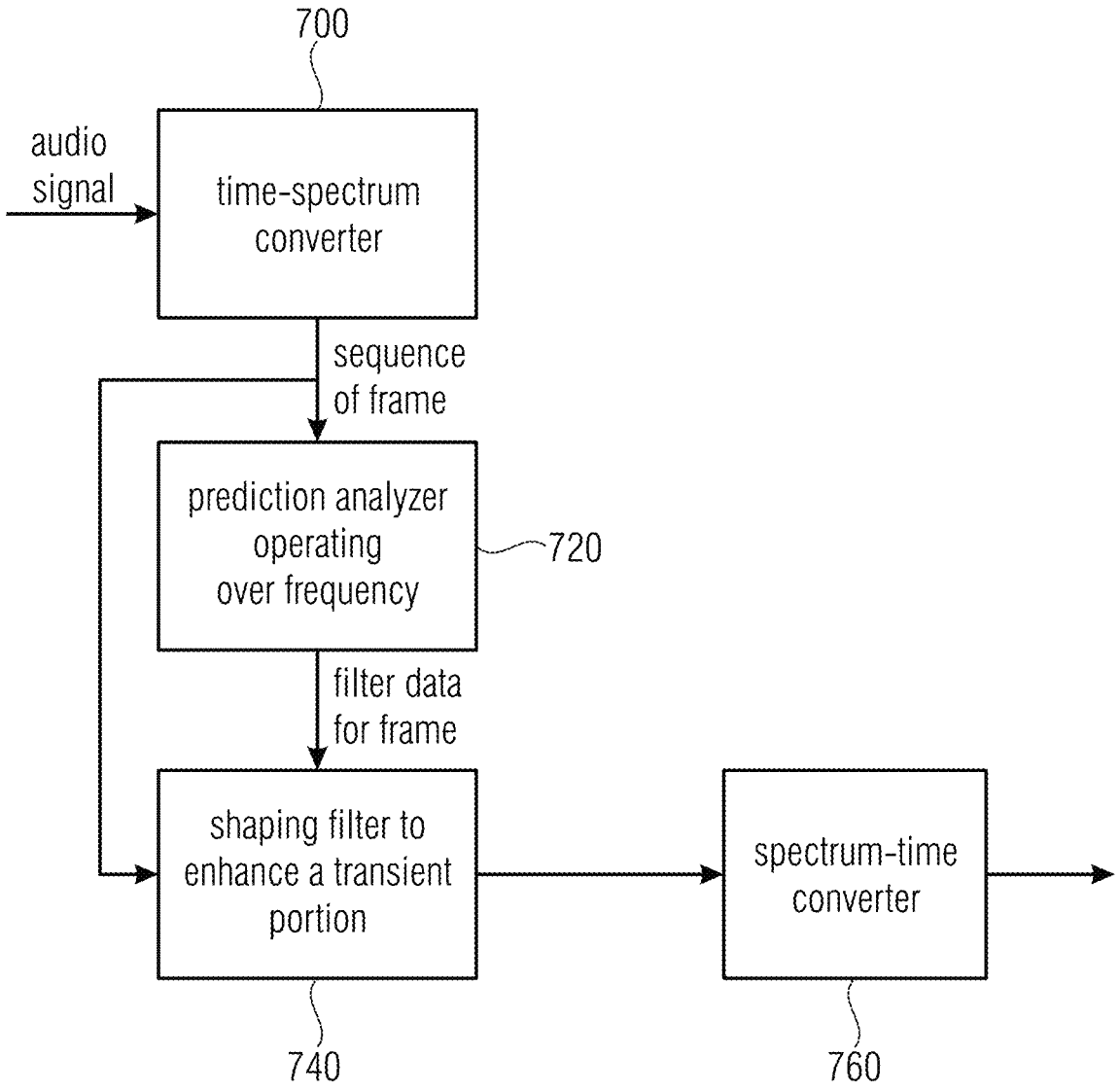
FIG. 7 illustrates a block diagram of an embodiment of the second aspect of the present invention.

FIG. 7 illustrates an apparatus for post-processing 20 of an audio signal in accordance with the second aspect of the present invention. The apparatus comprises a time-spectrum converter 700 for converting the audio signal into a spectral representation comprising a sequence of spectral frames. Additionally, a prediction analyzer 720 for calculating prediction filter data for a prediction over frequency within the spectral frame is used. The prediction analyzer operating over frequency 720 generates filter data for a frame and this filter data for a frame is used by a shaping filter 740 frame to enhance a transient portion within the spectral frame. The output of the shaping filter 740 is forwarded to a spectrum-time converter 760 for converting a sequence of spectral frames comprising a shaped spectral frame into a time-domain.

Advantageously, the prediction analyzer 720 on the one hand or the shaping filter 740 on the other hand operate without an explicit transient location detection. Instead, due to the prediction over frequency applied by block 720 and due to the shaping to enhance the transient portion generated by block 740, a time envelope of the audio signal is manipulated so that a transient portion is enhanced automatically, without any specific transient detection. However, as the case may be, block 720, 740 can also be supported by an explicit transient location detection in order to make sure that any probably artifacts are not impressed into the audio signal at non-transient portions.

Figure 8A:
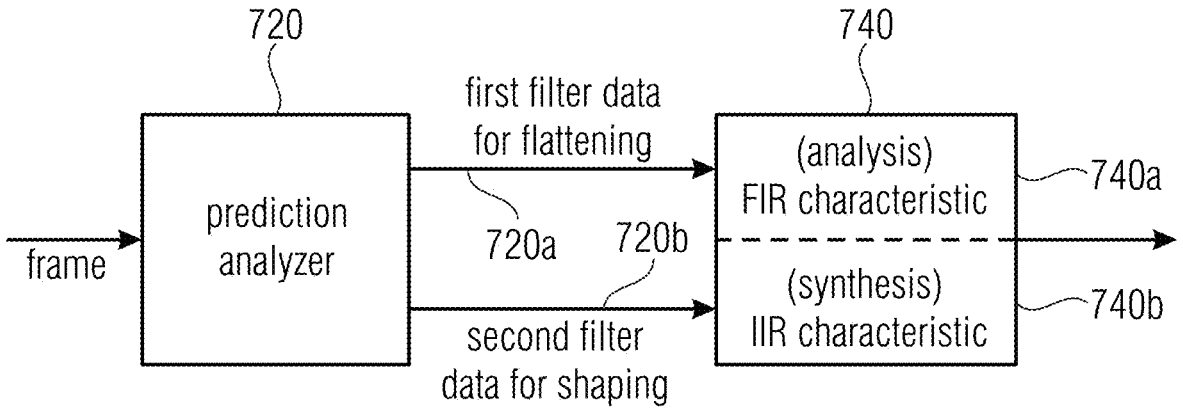
FIG. 8*a* illustrates an implementation of the second aspect based on two different filter data.

Advantageously, the prediction analyzer 720 is configured to calculate first prediction filter data 720*a* for a flattening filter characteristic 740*a* and second prediction filter data 720*b* for a shaping filter characteristic 740*b* as illustrated in FIG. 8*a*. In particular, the prediction analyzer 720 receives, as an input, a complete frame of the sequence of frames and then performs an operation for the prediction analysis over frequency in order to obtain either the flattening filter data characteristic or to generate the shaping filter characteristic. The flattening filter characteristic is the filter characteristic that, in the end, resembles an inverse filter that can also be represented by an FIR (finite impulse response) characteristic 740*a*, in which the second filter data for the shaping corresponds to a synthesis or IIR filter characteristic (IIR=Infinite Impulse Response) illustrated at 740*b*.

Advantageously, the degree of shaping represented by the second filter data 720*b* is greater than the degree of flattening 720*a* represented by the first filter data so that, subsequent to the application of the shaping filter having both characteristics 740*a*, 740*b*, a kind of an "over shaping" of the signal is obtained that results in a temporal envelope being less flatter than the original temporal envelope. This is exactly what is used for a transient enhancement.

Although FIG. 8*a* illustrates a situation in which two different filter characteristics, one shaping filter and one flattening filter are calculated, other embodiments rely on a single shaping filter characteristic. This is due to the fact that a signal can, of course, also be shaped without a preceding flattening so that, in the end, once again an over-shaped signal that automatically has improved transients is obtained. This effect of the over-shaping may be controlled by a transient location detector but this transient location detector is not required due to an implementation of a signal manipulation that automatically influences non-transient portions less than transient portions. Both procedures fully rely on the fact that the prediction over frequency is applied by the prediction analyzer 720 in order to obtain information on the time envelope of the time domain signal that is then manipulated in order to enhance the transient nature of the audio signal.

Figure 8B:
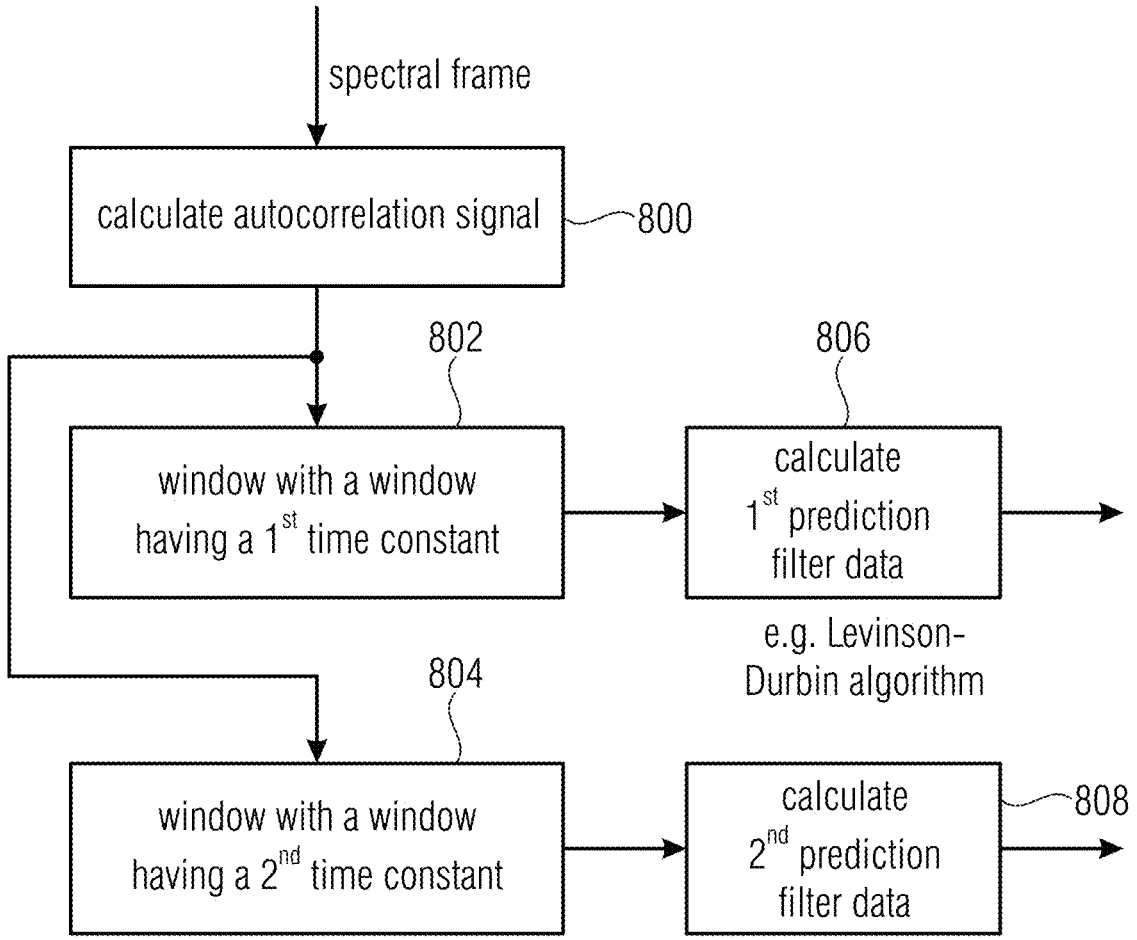
FIG. 8*b* illustrates an implementation of the second aspect for the calculation of the two different prediction filter data.

In this embodiment, an autocorrelation signal 800 is calculated from a spectral frame as illustrated at 800 in FIG. 8*b*. A window with a first time constant is then used for windowing the result of block 800 as illustrated in block 802. Furthermore, a window having a second time constant being greater than the first time constant is used for windowing the autocorrelation signal obtained by block 800, as illustrated in block 804. From the result signal obtained from block 802, the first prediction filter data are calculated as illustrated by block 806 advantageously by applying a Levinson-Durbin recursion. Similarly, the second prediction filter data 808 are calculated from block 804 with the greater time constant. Once again, block 808 may use the same Levinson-Durbin algorithm.

Due to the fact that the autocorrelation signal is windowed with windows having two different time constants, the—automatic—transient enhancement is obtained. Typically, the windowing is such that the different time constants only have an impact on one class of signals but do not have an impact on the other class of signals. Transient signals are actually influenced by means of the two different time constants, while non-transient signals have such an autocorrelation signal that windowing with the second larger time constant results in almost the same output as windowing with the first time constant. With respect to FIG. 13.18, this is due to the fact that non-transient signals do not have any significant peaks at high time lags and, therefore, using two different time constants does not make any difference with respect to these signals. However, this is different for transient signals. Transient signals have peaks at higher time lags and, therefore, applying different time constants to the autocorrelation signal that actually has the peaks at higher time lags as illustrated in FIG. 13.18 at 1300, for example, results in different outputs for the different windowing operations with different time constants.

Depending on the implementation, the shaping filter can be implemented in many different ways. One way is illustrated in FIG. 8*c* and is a cascade of a flattening sub-filter controlled by the first filter data 806 as illustrated at 809 and a shaping sub-filter controlled by the second filter data 808 as illustrated at 810 and a gain compensator 811 that is also implemented in the cascade.

However, the two different filter characteristics and the gain compensation can also be implemented within a single shaping filter 740 and the combined filter characteristic of the shaping filter 740 is calculated by a filter characteristic combiner 820 relying, on the one hand, on both first and second filter data and additionally relying, on the other hand, on the gains of the first filter data and the second filter data to finally also implement the gain compensation function 811 as well. Thus, with respect to FIG. 8*d* embodiment in which a combined filter is applied, the frame is input into a single shaping filter 740 and the output is the shaped frame that has both filter characteristics, on the one hand, and the gain compensation functionality, on the other hand, implemented on it.

Figure 8C:
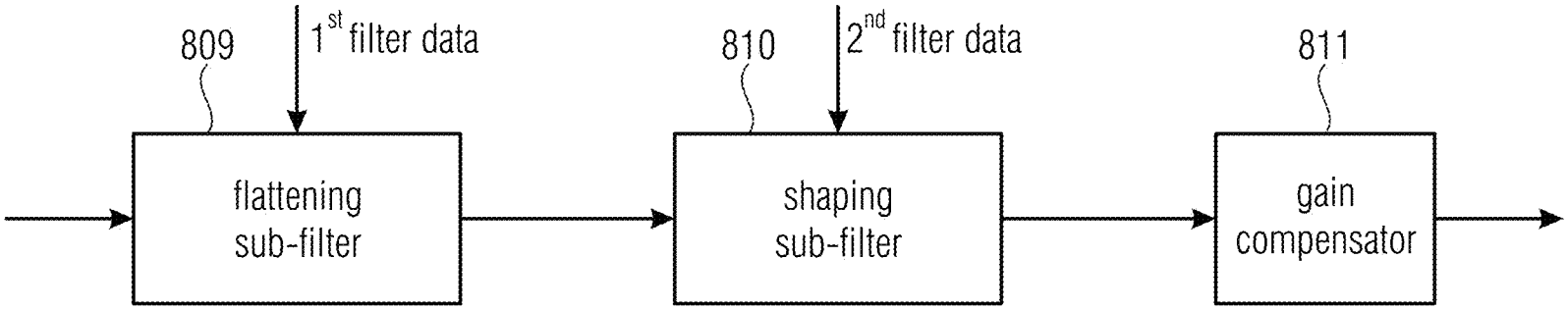
FIG. 8*c* illustrates an implementation of the shaping filter of FIG. 7.
Figure 8D:
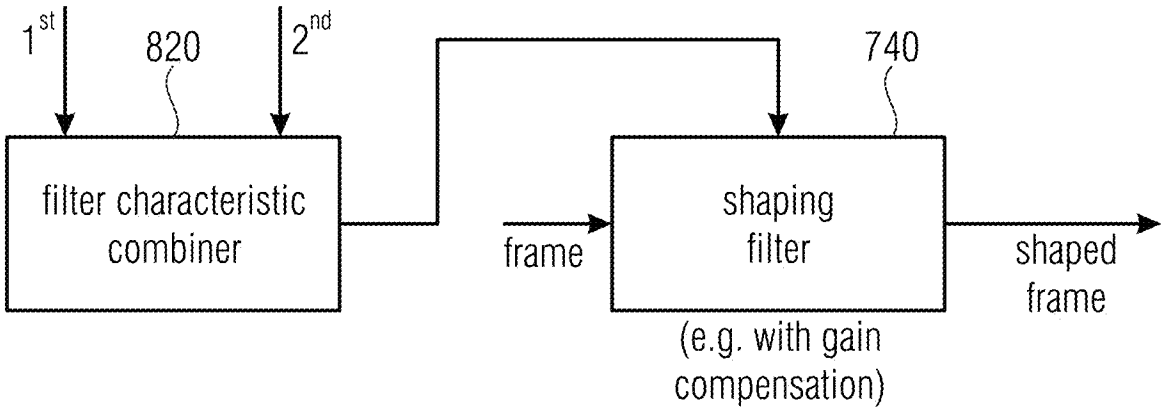
FIG. 8*d* illustrates a further implementation of the shaping filter of FIG. 7.
Figures 8E, 8F:
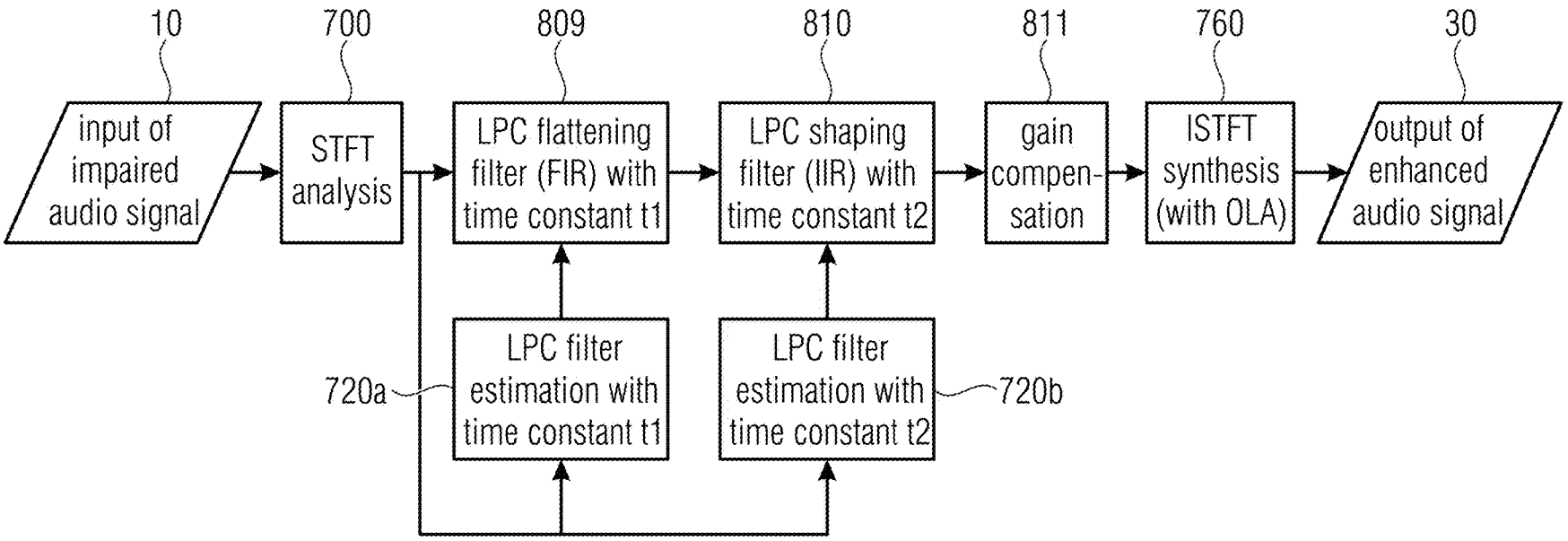
FIG. 8*e* illustrates a further embodiment of the second aspect of the present invention.
FIG. 8*f* illustrates an implementation for the LPC filter estimation with different time constants.

FIG. 8*e* illustrates a further implementation of the second aspect of the present invention, in which the functionality of the combined shaping filter 740 of FIG. 8*d* is illustrated in line with FIG. 8*c* but it is to be noted that FIG. 8*e* can actually be an implementation of three separate stages 809, 810, 811 but, at the same time, can be seen as a logical representation that is practically implemented using a single filter having a filter characteristic with a nominator and a denominator, in which the nominator has the inverse/flattening filter characteristic and the denominator has the synthesis characteristic and in which, additionally, a gain compensation is included as, for example, illustrated in equation 4.33 that is determined later on.

FIG. 8*f* illustrates the functionality of the windowing obtained by block 802, 804 of FIG. 8*b* in which r(k) is the autocorrelation signal and $w_{lag}$ is the window r'(k) is the output of the windowing, i.e., the output of blocks 802, 804 and, additionally, a window function is exemplarily illustrated that, in the end, represents an exponential decay filter having two different time constants that can be set by using a certain value for a in FIG. 8*f*.

Thus, applying a window to the autocorrelation value prior to Levinson-Durbin recursion results in an expansion of the time support at local temporal peaks. In particular, the expansion using a Gaussian window is described by FIG. 8*f*. Embodiments here rely on the idea to derive a temporal flattening filter that has a greater expansion of time support at local non-flat envelopes than the subsequent shaping filter through the choice of different values 4*a*. Together, these filters result in a sharpening of temporal attacks in the signal. In the result there is a compensation for the prediction gains of the filter such that spectral energy of the filtered spectral region is preserved.

Thus, a signal flow of a frequency domain-LPC based attack shaping is obtained as illustrated in FIGS. 8*a* to 8*e*.

Figure 9:
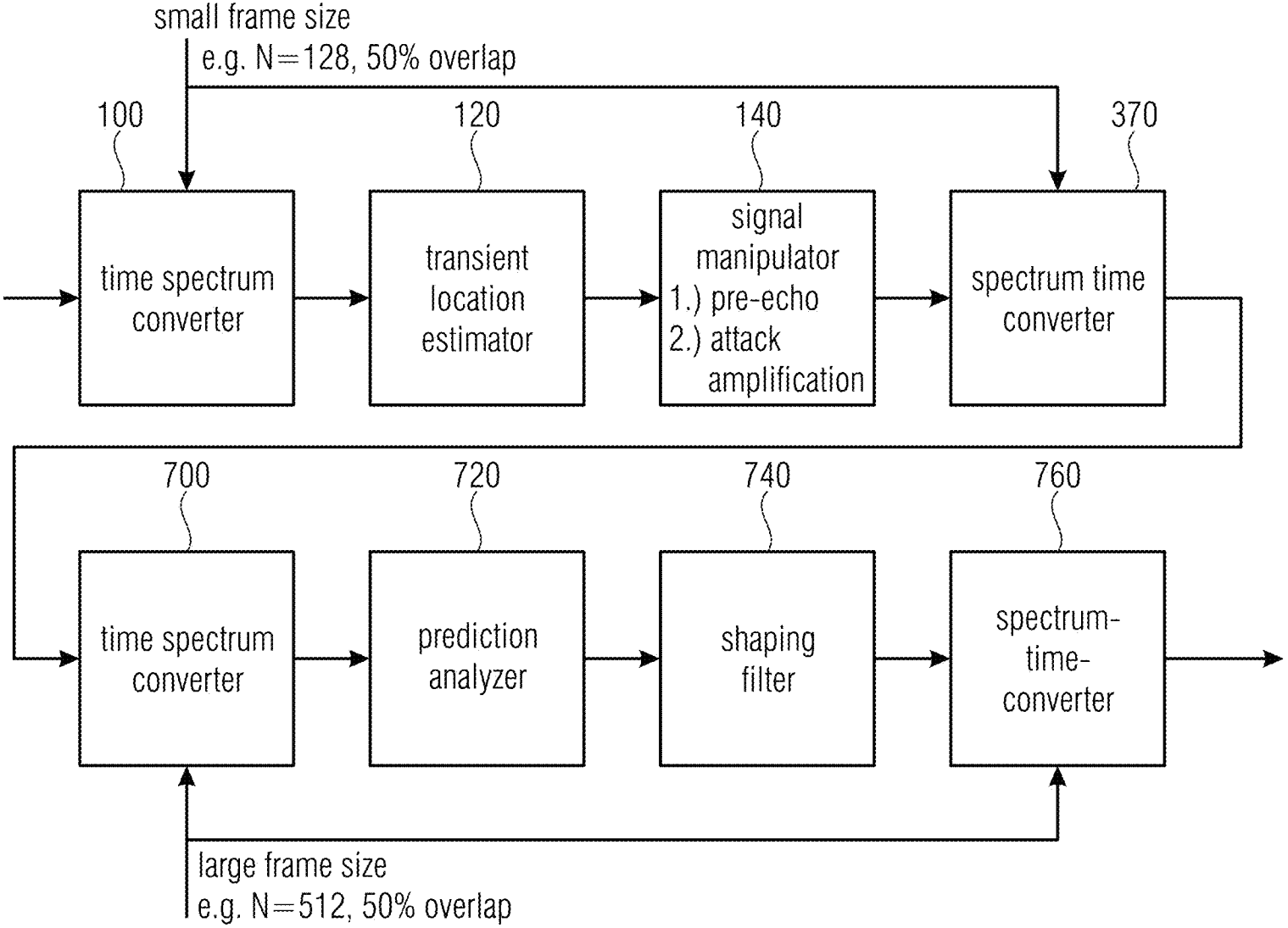
FIG. 9 illustrates an overview over an implementation for a post-processing procedure relying on the first sub-aspect and the second sub-aspect of the first aspect of the present invention and additionally relying on the second aspect of the present invention performed on an output of a procedure based on the first aspect of the present invention.

FIG. 9 illustrates an implementation of embodiments that rely on both the first aspect illustrated from block 100 to 370 in FIG. 9 and a subsequently performed second aspect illustrated by block 700 to 760. Advantageously, the second aspect relies on a separate time-spectrum conversion that uses a large frame size such as a frame size of 512 and the 50% overlap. On the other hand, the first aspect relies on a small frame size in order to have a better time resolution for transient location detection. Such a smaller frame size is, for example, a frame size of 128 samples and an overlap of 50%. Generally, however, it is of advantage to use separate time-spectrum conversions for the first and the second aspect in which the frame size aspect is greater (the time resolution is lower but the frequency resolution is higher) while the time resolution for the first aspect is higher with a corresponding lower frequency resolution.

Figure 10A:
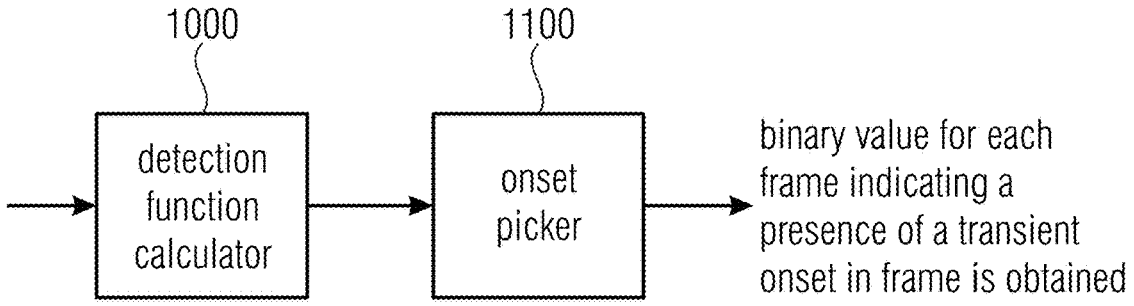
FIG. 10*a* illustrates an implementation of the transient location detector.

FIG. 10*a* illustrates an implementation of the transient location estimator 120 of FIG. 1. The transient location estimator 120 can be implemented as known in the art but, in the embodiment, relies on a detection function calculator 1000 and the subsequently connected onset picker 1100 so that, in the end, a binary value for each frame indicating a presence of a transient onset in frame is obtained.

Figure 10B:
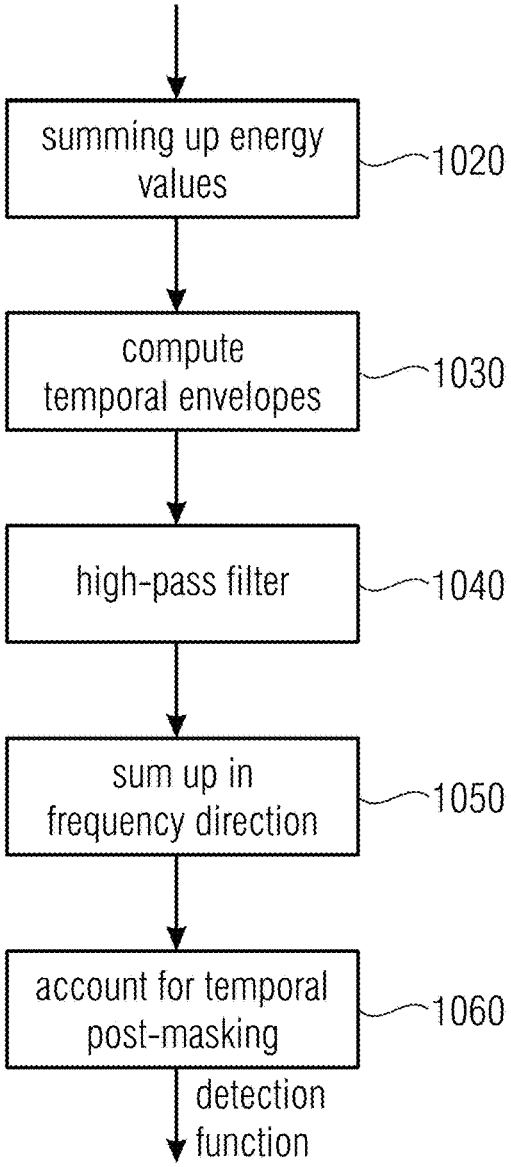
FIG. 10*b* illustrates an implementation for the detection function calculation of FIG. 10*a;*

The detection function calculator 1000 relies on several steps illustrated in FIG. 10*b*. These are a summing up of energy values in block 1020. In block 1030 a computation of temporal envelopes is performed. Subsequently, in step 1040, a high-pass filtering of each bandpass signal temporal envelope is performed. In step 1050, a summing up of the resulted high-pass filtered signals in the frequency direction is performed and in block 1060 an accounting for the temporal post-masking is performed so that, in the end, a detection function is obtained.

Figure 10C:
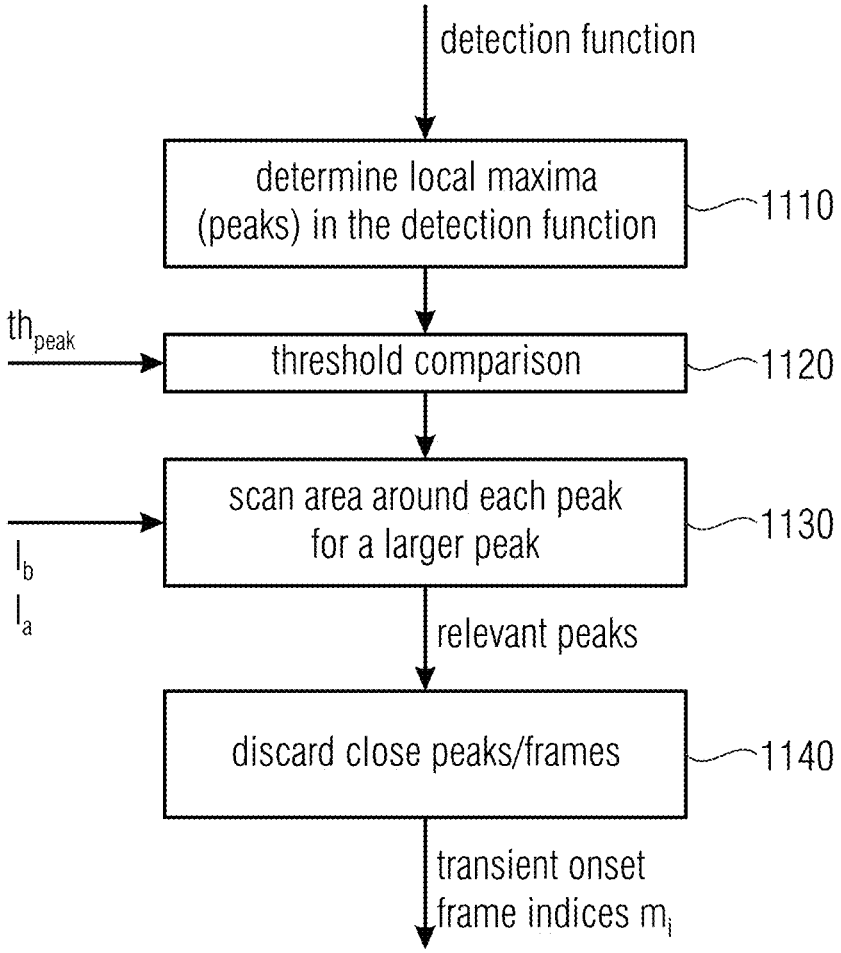
FIG. 10*c* illustrates an implementation of the onset picker of FIG. 10*a;*

FIG. 10*c* illustrates an advantageous way of onset picking from the detection function as obtained by block 1060. In step 1110, local maxima (peaks) are found in the detection function. In block 1120, a threshold comparison is performed in order to only keep peaks for the further prosecution that are above a certain minimum threshold.

In block 1130, the area around each peak is scanned for a larger peak in order to determine from this area the relevant peaks. The area around the peaks extends a number of $I_b$ frames before the peak and a number of $I_a$ frames subsequent to the peak.

In block 1140, close peaks are discarded so that, in the end, the transient onset frame indices $m_t$ are determined.

Subsequently, technical and auditory concepts, that are utilized in the proposed transient enhancement methods are disclosed. First, some basic digital signal processing techniques regarding selected filtering operations and linear prediction will be introduced, followed by a definition of transients. Subsequently, the psychoacoustic concept of auditory masking is explained, that is exploited in the perceptual coding of audio content. This portion closes with a brief description of a generic perceptual audio codec and the induced compression artifacts, that are subject to the enhancement methods in accordance with the invention.

Smoothing and Differentiating Filters

The transient enhancement methods described later on make frequent use of some particular filtering operations. An introduction to these filters will be given in the section below. Refer to [9, 10] for a more detailed description. Eq. (2.1) describes a finite impulse response (FIR) low-pass filter that computes the current output sample value $y_n$ as the mean value of the current and past samples of an input signal $x_n$. The filtering process of this so-called moving average filter is given by the following Eq. 2.1

$$y_n = \frac{1}{p+1}(x_n + x_{n-1} + \ldots + x_{n-p}) = \frac{1}{p+1}\sum_{i=0}^{p} x_{n-i},$$

where p is the filter order. The top image of FIG. 12.1 shows the result of the moving average filter operation in Eq. (2.1) for an input signal $x_n$. The output signal $y_n$ in the bottom image was computed by applying the moving average filter two times on $x_n$ in both forward and backward direction. This compensates the filter delay and also results in a smoother output signal $y_n$ since $x_n$ is filtered two times.

A different way to smooth a signal is to apply a single pole recursive averaging filter, that is given by the following difference equation 2.2:

$$y_n = b \cdot x_n + (1-b) \cdot y_{n-1}, 1 \le n \le N,$$

with $y_0 = x_1$ and N denoting the number of samples in $x_n$. FIG. 12.2(*a*) displays the result of a single pole recursive averaging filter applied to a rectangular function. In (b) the filter was applied in both directions to further smooth the signal. By taking $y_n^{max}$ and $y_n^{min}$ as (upper Eq. 2.3, lower Eq. 2.4)

$$y_n^{max} = \max(y_n, x_n) = \begin{cases} y_n, & y_n > x_n \\ x_n, & x_n > y_n \end{cases} \text{ and}$$

$$y_n^{min} = \min(y_n, x_n) = \begin{cases} y_n, & y_n < x_n \\ x_n, & x_n < y_n \end{cases},$$

where $x_n$ and $y_n$ are the input and output signals of Eq. (2.2), respectively, the resulting output signals $y_n^{max}$ and $y_n^{min}$ directly follow the attack or decay phase of the input signal. FIG. 12.2(*c*) shows $y_n^{max}$ as the solid black curve and $y_n^{min}$ as the dashed black curve.

Strong amplitude increments or decrements of an input signal $x_n$ can be detected by filtering $x_n$ with a FIR high-pass filter as (Eq. 2.5)

$$y_n = b_0 x_n + b_1 x_{n-1} + \ldots + b_p x_{n-p} = \sum_{i=0}^{p} b_i \cdot x_{n-i},$$

with b=[1, −1] or b=[1, 0, . . . , −1]. The resulting signal after high-pass filtering the rectangular function is shown in FIG. 12.2(*d*) as the black curve.

Linear Prediction

Linear prediction (LP) is a useful method for the encoding of audio. Some past studies particularly describe its ability to model the speech production process [11, 12, 13], while others also apply it for the analysis of audio signals in general [14, 15, 16, 17]. The following section is based on [11, 12, 13, 15, 18].

In linear predictive coding (LPC) a sampled time signal $s(nT) \triangleq = s_n$, with T being the sampling period, can be predicted by a weighted linear combination of its past values in the form of (Eq. 2.6)

$$s_n = \sum_{r=1}^{p} a_r s_{n-r} + G u_n,$$

where n is the time index that identifies a certain time sample of the signal, p is the prediction order, $\alpha_r$, with $1 \le r \le p$, are the linear prediction coefficients (and in this case the filter coefficients of an all-pole infinite impulse response (IIR) filter, G is the gain factor and $u_n$ is some input signal that excites the model. By taking the z-transform of Eq. (2.6), the corresponding all-pole transfer function H (z) of the system is (Eq. 2.7)

$$H(z) = \frac{G}{1 - \sum_{r=1}^{p} a_r z^{-1}} = \frac{G}{A(z)},$$

where (Eq. 2.8)

$$z = e^{j2\pi f t} = e^{j\omega T}.$$

The UR filter H(z) is called the synthesis or LPC filter, while the FIR filter $A(z) = 1 - \Sigma_{r=1}^{p} \alpha_r z^{-1}$ 1 is referred to as the inverse filter. Using the prediction coefficients $\alpha_r$ as the filter coefficients of a FIR filter, a prediction of the signal $s_n$ can be obtained by (Eq. 2.9)

$$\hat{s}_n = \sum_{r=1}^{p} a_r s_{n-r} \text{ or } \mathcal{Z}\{\hat{s}_n\} = \hat{S}(z) = S(z)\sum_{r=1}^{p} a_r z^{-1} = S(z)P(z).$$

This results in a prediction error between the predicted signal $\hat{S}_n$ and the actual signal $s_n$ which can be formulated by (Eq. 2.10)

$$e_{n,p} = s_n - \hat{s}_n = s_n - \sum_{r=1}^{p} a_r s_{n-r},$$

with the equivalent representation of the prediction error in the z-domain being (Eq. 2.11)

$$E_p(z)=S(z)-\hat{S}(z)=S(z)[1-P(z)]=S(z)A(z).$$

FIG. 12.3 shows the original signal sn, the predicted signal $\hat{s}_n$ and the difference signal $e_{n,p}$, with a prediction order p=10. This difference signal $e_{n,p}$ is also called the residual. In FIG. 12.4 the autocorrelation function of the residual shows almost complete decorrelation between neighboring samples, which indicates that $e_{n,p}$ can be seen as proximately as white Gaussian noise. Using $e_{n,p}$ from Eq. (2.10) as the input signal $u_n$ in Eq. (2.6) or filtering Ep(z) from Eq. (2.11) with the all-pole filter H (z) from Eq. (2.7) (with G=1) the original signal can be perfectly recovered by (Eq. 2.12)

$$s_n = \sum_{r=1}^{p} a_r s_{n-r} + e_{n,p}$$

and (Eq. 2.13)

$$S(z) = E_p(z)H(z) = \frac{E_p(z)}{1 - \sum_{r=1}^{p} a_r z^{-1}}$$

respectively.

With increasing prediction order p the energy of the residual decreases. Besides the number of predictor coefficients, the residual energy also depends on the coefficients themselves. Therefore, the problem in linear predictive coding is how to obtain the optimal filter coefficients $\alpha_r$, so that the energy of the residual is minimized. First, we take the total squared error (total energy) of the residual from a windowed signal block $x_n=s_n \cdot w_n$, where $w_n$ is some window function of width N, and its prediction $\hat{x}_n$ by (Eq. 2.14)

$$E = \sum_{n=0}^{N-1+p} |e_{n,p}|^2 = |x_0|^2 + \sum_{n=1}^{N-1+p} \left| \left( x_n - \sum_{r=1}^{p} a_r x_{n-r} \right) \right|^2,$$

with (Eq. 2.15)

$$x_n = \begin{cases} s_n w_n, & 0 \le n \le N-1 \\ 0, & \text{else} \end{cases}.$$

To minimize the total squared error E, the gradient of Eq. (2.14) has to be computed with respect to each $\alpha_r$ and set to 0 by setting (Eq. 2.16)

$$\frac{\partial E}{\partial a_i}, 1 \le i \le p.$$

This leads to the so-called normal equations (Eq. 2.17):

$$\sum_{r=1}^{p} a_r \sum_n x_{n-r} x_{n-i} = \sum_n x_n x_{n-i}, 1 \le i \le p$$

$$\sum_{r=1}^{p} a_r R_{i-r} = R_i, 1 \le i \le p.$$

$R_i$ denotes the autocorrelation of the signal $x_n$ as (Eq. 2.18)

$$R_i = \sum_n x_n x_{n-i},$$

Eq. (2.17) forms a system of p linear equations, from which the p unknown prediction coefficients $\alpha_r$, $1 \le r \le p$, which minimize the total squared error, can be computed. With Eq. (2.14) and Eq. (2.17), the minimum total squared error $E_p$ can be obtained by (Eq. 2.19)

$$E_p = \sum_n x_n^2 - \sum_{r=1}^{p} a_r \sum_n x_n x_{n-r} = R_0 - \sum_{r=1}^{p} a_r R_r.$$

A fast way to solve the normal equations in Eq. (2.17) is the Levinson-Durbin algorithm [19]. The algorithm works recursively, which brings the advantage that with increasing prediction order it yields the predictor coefficients for the current and all the previous orders less than p. First, the algorithm gets initialized by setting (Eq. 2.20)

$$E_0=R_0.$$

Subsequently, for the prediction orders m=1, . . . , p, the prediction coefficients $a_r^{(m)}$, which are the coefficients $a_r$ of the current order m, are computed with the partial correlation coefficients $p_m$ as follows (Eq. 2.21 to 2.24):

$$\rho_m = \frac{R_m - \sum_{r=1}^{m-1} a_r^{(m-1)} R_{m-r}}{E_{m-1}}$$

$$a_m^{(m)} = \rho_m$$

$$a_r^{(m)} = a_r^{(m-1)} - \rho_m a_{m-r}^{(m-1)}, 1 \le r \le m-1$$

$$E_m = (1 - k_m^2) E_{m-1}$$

With every iteration the minimum total squared error $E_m$ of the current order m is computed in Eq. (2.24). Since $E_m$ is always positive and with $E_0=R_0$, it can be shown that with increasing order m the minimum total energy decreases, so that we have (Eq. 2.25)

$$0 \le E_m \le E_m - 1.$$

Therefore the recursion brings another advantage, in that the calculation of the predictor coefficients can be stopped, when $E_m$ falls below a certain threshold.

Envelope Estimation in Time- and Frequency-Domain

An important feature of LPC filters is their ability to model the characteristics of a signal in the frequency domain, if the filter coefficients were calculated on a time-signal. Equivalent to the prediction of the time sequence, linear prediction approximates the spectrum of the sequence. Depending on the prediction order, LPC filters can be used to compute a more or less detailed envelope of the signals frequency response. The following section is based on [11, 12, 13, 14, 16, 17, 20, 21].

From Eq. (2.13) we can see that the original signal spectrum can be perfectly reconstructed from the residual spectrum by filtering it with the all-pole filter H(z). By setting $u_n=\delta_n$ in Eq. (2.6), where $\delta_n$ is the Dirac delta function, the signal spectrum S(z) can be modeled by the all-pole filter $\tilde{S}(z)$ from Eq. (2.7) as (Eq. 2.26)

$$\tilde{S}(z) = H(z) = \frac{G}{1 - \sum_{r=1}^{p} a_r z^{-1}}.$$

With the prediction coefficients ar being computed using the Levinson-Durbin algorithm in Eq. (2.21)-(2.24), only the gain factor G remains to be determined. With $u_n=\delta_n$ Eq. (2.6) becomes (Eq. 2.27)

$$h_n = \sum_{r=1}^{p} a_r h_{n-r} + G\delta_n,$$

where $h_n$ is the impulse response of the synthesis filter H(z). According to Eq. (2.17) the autocorrelation $\tilde{R}_i$ of the impulse response $h_n$ is (Eq. 2.28)

$$\tilde{R}_i = \sum_{r=1}^{p} a_r \tilde{R}_{i-r},\ 1 \le i \le p.$$

By squaring $h_n$ in Eq. (2.27) and summing over all n, the 0th autocorrelation coefficient of the synthesis filter impulse response becomes (Eq. 2.29)

$$\tilde{R}_0 = \sum_n h_n^2 = \sum_{r=1}^{p} a_r \sum_n h_n h_{n-r} + \sum_n h_n G\delta_n = \sum_{r=1}^{p} a_r \tilde{R}_r + G^2.$$

Since $R_0=\Sigma_n s_n^2=E$, the 0th autocorrelation coefficient corresponds to the total energy of the signal $s_n$. With the condition that the total energies in the original signal spectrum S(z) and its approximation $\tilde{S}(z)$ should be equal, it follows that $\tilde{R}_0=R_0$. With this conclusion, the relation between the autocorrelations of the signal $s_n$ and the impulse response $h_n$ in Eq. (2.17) and Eq. (2.28) respectively becomes $\tilde{R}_i=R_i$ for $0 \le i \le p$. The gain factor G can be computed by reshaping Eq. (2.29) and with Eq. (2.19) as (Eq. 2.30)

$$G^2 = \tilde{R}_0 - \sum_{r=1}^{p} a_r \tilde{R}_r = R_0 - \sum_{r=1}^{p} a_r R_r = E_p \rightarrow G = \sqrt{E_p}.$$

FIG. 12.5 shows the spectrum S(z) of one frame (1024 samples) from a speech signal $S_n$. The smoother black curve is the spectral envelope $\tilde{S}(z)$ computed according to Eq. (2.26), with a prediction order p=20. As the prediction order p increases, the approximation $\tilde{S}(z)$ adapts always more closely to the original spectrum S(z). The dashed curve is computed with the same formula as the black curve, but with a prediction order p=100. It can be seen that this approximation is much more detailed and provides a better fit to S(z). With p→length ($s_n$) it is also possible to exactly model S(z) with the all-pole filter $\tilde{S}(z)$ so that $\tilde{S}(z)=S(z)$, provided the time-signal $s_n$ is minimum phase.

Due to the duality between time and frequency it is also possible to apply linear prediction in the frequency domain on the spectrum of a signal, in order to model its temporal envelope. The computation of the temporal estimation is done the same way, only that the calculation of the predictor coefficients is performed on the signal spectrum, and the impulse response of the resulting all-pole filter is then transformed to the time domain. FIG. 12.6 shows the absolute values of the original time signal and two approximations with a prediction order of p=10 and p=20. As for the estimation of the frequency response it can be observed that the temporal approximation is more exact with higher orders.

Transients

In the literature many different definitions of transients can be found. Some refer to it as onsets or attacks [22, 23, 24, 25], while others use these terms to describe transients [26, 27]. This section aims to describe the different approaches to define transients and to characterize them for the purpose of this disclosure.

Characterization

Some earlier definitions of transients describe them solely as a time domain phenomenon, for example as found in Kliewer and Mertins [24]. They describe transients as signal segments in the time-domain, whose energy rapidly rises from a low to a high value. To define the boundaries of these segments, they use the ratio of the energies within two sliding windows over the time-domain energy signal right before and after a signal sample n. Dividing the energy of the window right after n by the energy of the preceding window results in a simple criterion function C(n), whose peak values correspond to the beginning of the transient period. These peak values occur when the energy right after n is substantially larger than before, marking the beginning of a steep energy rise. The end of the transient is then defined as the time instant where C(n) falls below a certain threshold after the onset.

Masri and Bateman [28] describe transients as a radical change in the signals temporal envelope, where the signal segments before and after the beginning of the transient are highly uncorrelated. The frequency spectrum of a narrow time-frame containing a percussive transient event often shows a large energy burst over all frequencies, which can be seen in the spectrogram of a castanet transient in FIG. 12.7(*b*). Other works [23, 29, 25] also characterize transients in a time-frequency representation of the signal, where they correspond to time-frames with sharp increases of energy appearing simultaneously in several neighboring frequency bands. Rodet and Jaillet [25] furthermore state that this abrupt increase in energy is especially noticeable in higher frequencies, since the overall energy of the signal is mainly concentrated in the low-frequency area.

Herre [20] and Zhang et al. [30] characterize transients with the degree of flatness of the temporal envelope. With the sudden increase of energy across time, a transient signal has a very non-flat time structure, with a corresponding flat spectral envelope. One way to determine the spectral flatness is to apply a Spectral Flatness Measure (SFM) [31] in the frequency domain. The spectral flatness SF of a signal can be calculated by taking the ratio of the geometric mean Gm and the arithmetic mean Am of the power spectrum (Eq. 2.31):

$$SF = \frac{Gm}{Am} = \frac{\sqrt[K]{\prod_{k=0}^{K-1} |X_k|}}{\frac{1}{K}\sum_{k=0}^{K-1} |X_k|}$$

$|X_k|$ denotes the magnitude value of the spectral coefficient index k and K the total number of coefficients of the spectrum $X_k$. A signal has a non-flat frequency structure if SF→0 and therefore is more likely to be tonal. Opposed to that, if SF→1 the spectral envelope is more flat, which can correspond to a transient or a noise-like signal. A flat spectrum does not stringently specify a transient, whose phase response has a high correlation opposed to a noise signal. To determine the flatness of the temporal envelope, the measure in Eq. (2.31) can also be applied similarly in the time domain.

Suresh Babu et al. [27] furthermore distinguish between attack transients and frequency domain transients. They characterize frequency domain transients by an abrupt change in the spectral envelope between neighboring time-frames rather than by an energy change in the time domain, as described before. These signal events can be produced for example by bowed instruments like violins or by human speech, by changing the pitch of a presented sound. FIG. 12.7 shows the differences between attack transients and frequency domain transients. The signal in (c) depicts an audio signal produced by a violin. The vertical dashed line marks the time instant of a pitch change of the presented signal, i.e. the start of a new tone or a frequency domain transient respectively. Opposed to the attack transient produced by castanets in (a), this new note onset does not cause a noticeable change in the signals amplitude. The time instant of this change in spectral content can be seen in the spectrogram in (d). However the spectral differences before and after the transient are more obvious in FIG. 12.8, which shows two spectra of the violin signal in FIG. 12.7(*c*), one being the spectrum of the time-frame preceding and the other of that following the onset of the frequency domain transient. It stands out that the harmonic components differ between the two spectra. However, the perceptual encoding of frequency domain transients does not cause the kinds of artifacts that will be addressed by the restoration algorithms presented in this thesis and therefore will be disregarded. Henceforward the term transient will be used to represent only the attack transients.

Differentiation of Transients, Onsets and Attacks

A differentiation between the concepts of transients, onsets and attacks can be found in Bello et al. [26], which will be adopted in this thesis. The differentiation of these terms is also illustrated in FIG. 12.9, using the example of a transient signal produced by castanets.

At large, the concept of transients is still not comprehensively defined by the authors, but they characterize it as a short time interval, rather than a distinct time instant. In this transient period the amplitude of a signal rises rapidly in a relatively unpredictable way. But it is not exactly defined where the transient ends after its amplitude reaches its peak. In their rather informal definition they also include part of the amplitude decay to the transient interval. By this characterization acoustic instruments produce transients, during which they are excited (for example when a guitar string is plucked or a snare drum is hit) and then damped afterwards. After this initial decay, the following slower signal decay is only caused by the resonance frequencies of the instrument body.

Onsets are the time instants where the amplitude of the signal starts to rise. For this work, onsets will be defined as the starting time of the transient.

The attack of a transient is the time period within a transient between its onset and peak, during which the amplitude increases.

Psychoacoustics

This section gives a basic introduction to psychoacoustic concepts that are used in perceptual audio coding as well as in the transient enhancement algorithm described later. The aim of psychoacoustics is to describe the relation between "measurable physical properties of sound signals and the internal percepts that these sounds evoke in a listener" [32]. The human auditory perception has its limits, which can be exploited by perceptual audio coders in the encoding process of audio content to substantially reduce the bitrate of the encoded audio signal. Although the goal of perceptual audio coding is to encode audio material in a way that the decoded audio signal should sound exactly or as close as possible to the original signal [1], it may still introduce some audible coding artifacts. The necessary background to understand the origin of these artifacts and how the psychoacoustic model utilized by the perceptual audio coder will be provided in this section. The reader is referred to [33, 34] for a more detailed description on psychoacoustics.

Simultaneous Masking

Simultaneous masking refers to the psychoacoustic phenomenon that one sound (maskee) can be inaudible for a human listener when it is presented simultaneously with a stronger sound (masker), if both sounds are close in frequency. A widely used example to describe this phenomenon is that of a conversation between two people at the side of a road. With no interfering noise they can perceive each other perfectly, but they need to raise their speaking volume if a car or a truck passes by in order to keep understanding each other.

The concept of simultaneous masking can be explained by examining the functionality of the human auditory system. If a probe sound is presented to a listener it induces a travelling wave along the basilar membrane (BM) within the cochlea, spreading from its base at the oval window to the apex at its end [17]. Starting at the oval window, the vertical displacement of the travelling wave initially rises slowly, reaches its maximum at a certain position and then declines abruptly afterwards [33, 34]. The position of its maximum displacement depends on the frequency of the stimulus. The BM is narrow and stiff at the base and about three times wider and less stiff at the apex. This way every position along the BM is most sensitive to a specific frequency, with high frequency signal components causing a maximum displacement near the base and low frequencies near the apex of the BM. This specific frequency is often referred to as the characteristic frequency (CF) [33, 34, 35, 36]. This way the cochlea can be regarded as a frequency analyzer with a bank of highly overlapping bandpass filters with asym-metric frequency response, called auditory filters [17, 33, 34, 37]. The passbands of these auditory filters show a non-uniform bandwidth, which is referred to as the critical bandwidth. The concept of the critical bands was first introduced by Fletcher in 1933 [38, 39]. He assumed, that the audibility of a probe sound that is presented simultaneously with a noise signal is only dependent on the amount of noise energy that is close in frequency to the probe sound. If the signal-to-noise ratio (SNR) in this frequency area is under a certain threshold, i.e. the energy of the noise signal is to a certain degree higher than the energy of the probe sound, then the probe signal is inaudible by a human listener [17, 33, 34]. However, simultaneous masking does not only occur within one single critical band. In fact, a masker at the CF of a critical band can also affect the audibility of a maskee outside of the boundaries of this critical band, yet to a lesser extent [17]. The simultaneous masking effect is illustrated in FIG. 12.10. The dashed curve represents the threshold in quiet, that "describes the minimum sound pressure level that is needed for a narrow band sound to be detected by human listeners in the absence of other sounds" [32]. The black curve is the simultaneous masking threshold corresponding to a narrow band noise masker depicted as the dark grey bar. A probe sound (light grey bar) is masked by the masker, if its sound pressure level is smaller than the simultaneous masking threshold at the particular frequency of the maskee.

Temporal Masking

Masking is not only effective if the masker and maskee are presented at the same time, but also if they are temporally separated. A probe sound can be masked before and after the time period where the masker is present [40], which is referred to as pre-masking and post-masking. An illustration of the temporal masking effects is shown in FIG. 12.11. Pre-masking takes place prior to the onset of the masking sound, which is depicted for negative values of t. After the pre-masking period simultaneous masking is effective, with an overshoot effect directly after the masker is turned on, where the simultaneous masking threshold is temporarily increased [37]. After the masker is turned off (depicted for positive values of t), post-masking is effective. Pre-masking can be explained with the integration time needed by the auditory system to produce the perception of a presented sound [40]. Additionally, louder sounds are being processed faster by the auditory system than weaker sounds [33]. The time period during which pre-masking occurs is highly dependent on the amount of training of the particular listener [17, 34] and can last up to 20 ms [33], however being significant only in a time period of 1-5 ms before the masker onset [17, 37]. The amount of post-masking depends on the frequency of both the masker and the probe sound, the masker level and duration, as well as on the time period between the probe sound and the instant where the masker is turned off [17, 34]. According to Moore [34], post-masking is effective for at least 20 ms, with other studies showing even longer durations up to about 200 ms [33]. In addition, Painter and Spanias state that post-masking "also exhibits frequency-dependent behavior similar to simultaneous masking that can be observed when the masker and the probe frequency relationship is varied" [17, 34].

Perceptual Audio Coding

The purpose of perceptual audio coding is to compress an audio signal in a way that the resulting bitrate is as small as possible compared to the original audio, while maintaining a transparent sound quality, where the reconstructed (decoded) signal should not be distinguishable from the uncompressed signal [1, 17, 32, 37, 41, 42]. This is done by removing redundant and irrelevant information from the input signal exploiting some limitations of the human auditory system. While redundancy can be removed for example by exploiting the correlation between subsequent signal samples, spectral coefficients or even different audio channels and by an appropriate entropy coding, irrelevancy can be handled by the quantization of the spectral coefficients.

Generic Structure of a Perceptual Audio Coder

The basic structure of a monophonic perceptual audio encoder is depicted in FIG. 12.12. First, the input audio signal is transformed to a frequency-domain representation by applying an analysis filterbank. This way the received spectral coefficients can be quantized selectively "depending on their frequency content" [32]. The quantization block rounds the continuous values of the spectral coefficients to a discrete set of values, to reduce the amount of data in the coded audio signal. This way the compression becomes lossy, since it is not possible to reconstruct the exact values of the original signal at the decoder. The introduction of this quantization error can be regarded as an additive noise signal, which is referred to as quantization noise. The quantization is steered by the output of a perceptual model that calculates the temporal- and simultaneous masking thresholds for each spectral coefficient in each analysis window. The absolute threshold in quiet can also be utilized, by assuming "that a signal of 4 kHz, with a peak magnitude of ±1 least significant bit in a 16 bit integer is at the absolute threshold of hearing" [31]. In the bit allocation block these masking thresholds are used to determine the number of bits needed, so that the induced quantization noise becomes inaudible for a human listener. Additionally, spectral coefficients that are below the computed masking thresholds (and therefore irrelevant to the human auditory perception) do not need to be transmitted and can be quantized to zero. The quantized spectral coefficients are then entropy coded (for example by applying Huffman coding or arithmetic coding), which reduces the redundancy in the signal data. Finally, the coded audio signal, as well as additional side information like the quantization scale factors, are multiplexed to form a single bit stream, which is then transmitted to the receiver. The audio decoder (see FIG. 12.13) at the receiver side then performs inverse operations by demultiplexing the input bitstream, reconstructing the spectral values with the transmitted scale factors and applying a synthesis filterbank complementary to the analysis filterbank of the encoder, to reconstruct the resulting output time-signal.

Transient Coding Artifacts

Despite the goal of perceptual audio coding to produce a transparent sound quality of the decoded audio signal, it still exhibits audible artifacts. Some of these artifacts that affect the perceived quality of transients will be described below.

Birdies and Limitation of Bandwidth

There is only a limited amount of bits available for the bit allocation process to provide for the quantization of an audio signal block. If the bit demand for one frame is too high, some spectral coefficients could be deleted by quantizing them to zero [1, 43, 44]. This essentially causes the temporary loss of some high frequency content and is mainly a problem for low-bitrate coding or when dealing with very demanding signals, for example a signal with frequent transient events. The allocation of bits varies from one block to the next, hence the frequency content for a spectral coefficient might be deleted in one frame and be present in the following one. The induced spectral gaps are called "birdies" and can be seen in the bottom image of FIG. 12.14. Especially the encoding of transients is prone to produce birdie artifacts, since the energy in these signal parts is spread over the whole frequency spectrum. A common approach is to limit the band-width of the audio signal prior to the encoding process, to save the available bits for the quantization of the LF content, which is also illustrated for the coded signal in FIG. 12.14. This trade-off is suitable since birdies have a bigger impact on the perceived audio quality than a constant loss of bandwidth, which is generally more tolerated. However, even with the limitation of bandwidth it is still possible that birdies may occur. Although the transient enhancement methods described later on do not per se aim to correct spectral gaps or extent the bandwidth of the coded signal, the loss of high frequencies also causes a reduced energy and degraded transient attack (see FIG. 12.15), that is subject to the attack enhancement methods described later on.

Pre-Echoes

Another common compression artifact is the so-called pre-echo [1, 17, 20, 43, 44]. Pre-echoes occur if a sharp increase of signal energy (i.e. a transient) takes place near the end of a signal block. The substantial energy contained in transient signal parts is distributed over a wide range of frequencies, which causes the estimation of comparatively high masking thresholds in the psychoacoustic model and therefore the allocation of only a few bits for the quantization of the spectral coefficients. The high amount of added quantization noise is then spread over the entire duration of the signal block in the decoding process. For a stationary signal the quantization noise is assumed to be completely masked, but for a signal block containing a transient the quantization noise could precede the transient onset and become audible, if it "extends beyond the pre-masking [ . . . ] period" [1]. Even though there are several proposed methods dealing with pre-echoes, these artifacts are still subject to current research. FIG. 12.16 shows an example of a pre-echo artifact for a castanet transient. The dotted black curve is the waveform of the original signal with no substantial signal energy prior to the transient onset. Therefore, the induced pre-echo preceding the transient of the coded signal (gray curve) is not simultaneously masked and can be perceived even without a direct comparison with the original signal. The proposed method for the supplementary reduction of the pre-echo noise will be presented later on.

There are several approaches to enhance the quality of transients that have been proposed over the past years. These enhancement methods can be categorized in those integrated in the audio codec and those working as a post-processing module on the decoded audio signal. An overview on previous studies and methods regarding the transient enhancement as well as the detection of transient events is given in the following.

Transient Detection

An early approach for the detection of transients was proposed by Edler [6] in 1989. This detection is used to control the adaptive window switching method, which will be described later in this chapter. The proposed method only detects if a transient is present in one signal frame of the original input signal at the audio encoder, and not its exact position inside the frame. Two decision criteria are being computed to determine the likelihood of a present transient in a particular signal frame. For the first criterion the input signal x(n) is filtered with a FIR high-pass tilter according to Eq. (2.5) with the filter coefficients b=[1, −1]. The resulting difference signal d(n) shows large peaks at the instants of time where the amplitude between adjacent samples changes rapidly. The ratio of the magnitude sums of d(n) for two neighboring blocks is then used for the computation of the first criterion (Eq. 3.1):

$$c_1(m) = \frac{\sum_{n=0}^{N-1} |d(mN+n)|}{\sum_{n=0}^{N-1} |d(mN-N+n)|}$$

The variable m denotes the frame number and N the number of samples within one frame. However, $c_1(m)$ struggles with the detection of very small transients at the end of a signal frame, since their contribution to the total energy within the frame is rather small. Therefore a second criterion is formulated, which calculates the ratio of the maximum magnitude value of x(n) and the mean magnitude inside one frame (Eq. 3.2):

$$c_2(m) = \frac{\max_{n=0}^{N-1} \{|x(mN+n)|\}}{\frac{1}{N}\sum_{n=0}^{N-1} |x(mN+n)|}$$

If $c_1$ (m) or $c_2(m)$ exceed a certain threshold, then the particular frame m is determined to contain a transient event.

Kliewer and Merlins [24] also propose a detection method that operates exclusively in the time-domain. Their approach aims to determine the exact start and end samples of a transient, by employing two sliding rectangular windows on the signal energy. The signal energy within the windows is computed as (Eq. 3.3)

$$E_L(n) = \frac{1}{L}\sum_{k=n-L}^{n-1} x^2(k) \text{ and } E_R(n) = \frac{1}{L}\sum_{k=n+1}^{n+L} x^2(k),$$

where L is the window length and n denotes the signal sample right in the middle between the left and right window. A detection function D(n) is then calculated by (Eq. 3.4)

$$D(n) = c \cdot \log\left(\frac{E_R(n)}{E_L(n)}\right) \cdot E_R(n), \text{ with } c \in \mathbb{R}.$$

Peak values of D(n) correspond to the onset of a transient, if they are higher than a certain threshold $T_b$. The end of a transient event is determined as "the largest value of D(n) being smaller than some threshold $T_e$ directly after the onset" [24].

Other detection methods are based on linear prediction in the time-domain to distinguish between transient and steady-state signal parts, using the predictability of the signal waveform [45]. One method that uses linear prediction was proposed by Lee and Kuo [46] in 2006. They decompose the input signal into several sub-bands to compute a detection function for each of the resulting narrow-band signals. The detection functions are obtained as the output after filtering the narrow-band signal with the inverse filter according to Eq. (2.10). A subsequent peak selection algorithm determines the local maximum values of the resulting prediction error signals as the onset time candidates for each sub-band signal, which are then used to determine a single transient onset time for the wide-band signal.

The approach of Niemeyer and Edler [23] works on a complex time-frequency representation of the input signal and determines the transient onsets as a steep increase of the signal energy in neighboring bands. Each bandpass signal is filtered according to Eq. (2.3) to compute a temporal envelope that follows sudden energy increases as the detection function. A transient criterion is then computed not only for frequency band k, but also considering K=7 neighboring frequency bands on either side of k.

Subsequently, different strategies for the enhancement of transient signal parts will be described. The block diagram in FIG. 13.1 shows an overview of the different parts of the restoration algorithm. The algorithm takes the coded signal $s_n$, which is represented in the time-domain, and transforms it into a time-frequency representation $X_{k,m}$ by means of the short-time Fourier transform (STFT). The enhancement of the transient signal parts is then carried out in the STFT-domain. In the first stage of the enhancement algorithm, the pre-echoes right before the transient are being reduced. The second stage enhances the attack of the transient and the third stage sharpens the transient using a linear prediction based method. The enhanced signal $Y_{k,m}$ is then transformed back to the time domain with the inverse short-time Fourier transform (ISTFT), to obtain the output signal $y_n$.

By applying the STFT, the input signal $s_n$ is first divided into multiple frames of length N, that are overlapping by L samples and are windowed with an analysis window function $W_{n,m}$ to get the signal blocks $x_{n,m}=s_n \cdot W_{n,m}$. Each frame $x_{n,m}$ is then transformed to the frequency domain using the Discrete Fourier Transform (DFT). This yields the spectrum $X_{k,m}$ of the windowed signal frame $x_{n,m}$, where k is the spectral coefficient index and m is the frame number. The analysis by STFT can be formulated by the following equation (Eq. 4.1):

$$X_{k,m} = STFT\{s_n\}_{k,m} = \sum_{n=i}^{i+N-1} s_n w_{n,m} e^{-j2\pi kn/N},$$

with (Eq. 4.2)

$$i=(m-1)\cdot(N-L), m\in\mathbb{N}^+ \text{ and } 0\leq k<K, k\in\mathbb{N}$$

(N−L) is also referred to as the hop size. For the analysis window $w_{n,m}$ a sine window of the form (Eq. 4.3)

$$w_{n,m} = \sin\left(\frac{\pi(n-i)}{N-1}\right)$$

has been used. In order to capture the fine temporal structure of the transient events, the frame size has been chosen to be comparatively small. For the purpose of this work it was set to N=128 samples for each time-frame, with an overlap of L=N/2=64 samples for two neighboring frames. K in Eq. (4.2) defines the number of DFT points and was set to K=256. This corresponds to the number of spectral coefficients of the two-sided spectrum of $x_{k,m}$. Before the STFT analysis, each windowed input signal frame is zero-padded to obtain a longer vector of length K, in order to match the number of DFT points. These parameters give a sufficiently fine ti me-resolution to isolate the transient signal parts in one frame from the rest of the signal, while providing enough spectral coefficients for the following frequency-selective enhancement operations.

Transient Detection

In Embodiments, the methods for the enhancement of transients are applied exclusively to the transient events themselves, rather than constantly modifying the signal. Therefore, the instants of the transients have to be detected. For the purpose of this work, a transient detection method has been implemented, which has been adjusted to each individual audio signal separately. This means that the particular parameters and thresholds of the transient detection method, which will be described later in this section, are specifically tuned for each particular sound file to yield an optimal detection of the transient signal parts. The result of this detection is a binary value for each frame, indicating the presence of a transient onset.

The implemented transient detection method can be divided into two separate stages: the computation of a suitable detection function and an onset picking method that uses the detection function as its input signal. For the incorporation of the transient detection into a real-time processing algorithm an appropriate look-ahead is needed, since the subsequent pre-echo reduction method operates in the time interval preceding the detected transient onset.

Computation of a Detection Function

For the computation of the detection function, the input signal is transformed to a representation that enables an improved onset detection over the original signal. The input of the transient detection block in FIG. 13.1 is the time-frequency representation $X_{k,m}$ of the input signal $s_n$. Computing the detection function is done in five steps:

1. For each frame, sum up the energy values of several neighboring spectral coefficients.
2. Compute the temporal envelope of the resulting bandpass signals over all time-frames.
3. High-pass filtering of each bandpass signal temporal envelope.
4. Sum up the resulting high-pass filtered signals in frequency direction.
5. Account for temporal post-masking.

TABLE 4.1

Border frequencies $f_{low}$ and $f_{high}$ and bandwidth Δf of the resulting pass-bands of $X_{K,m}$ after the connection of n adjacent spectral coefficients of the magnitude energy spectrum of the signal $X_{k,m}$.

| K | $f_{low}$ (Hz) | $f_{high}$ | Δ (Hz) | n |
|---|---|---|---|---|
| 0 | 0 | 86 | 86 | 1 |
| 1 | 86 | 431 | 345 | 2 |
| 2 | 431 | 112 | 689 | 4 |
| 3 | 112 | 2498 | 137 | 8 |
| 4 | 2498 | 5254 | 2756 | 1 |
| 5 | 5254 | 1076 | 5513 | 32 |
| 6 | 1076 | 2179 | 1102 | 64 |

First, the energy of several neighboring spectral coefficients of $X_{k,m}$ are summed up for each time-frame m, by taking (Eq. 4.4)

$$X_{K,m} = \sum_{i=n}^{2n-1} X_{i,m}^2, \text{ with } n = \{2^0, 2^1, 2^2, \ldots, 2^6\} = 2^K,$$

where K denotes the index of the resulting sub-band signals. Therefore, $X_{K,m}$ consists of 7 values for each frame m, representing the energy contained in a certain frequency band of the spectrum $X_{k,m}$. The border frequencies $f_{low}$ and $f_{high}$, as well as passband bandwidth Δf and the number n of connected spectral coefficients, are displayed in Table 4.1. The values of the bandpass signals in $X_{K,m}$ are then smoothed over all time-frames. This is done by filtering each sub-band signal $X_{K,m}$ with an IIR low-pass filter in time direction according to Eq. (2.2) as (Eq. 4.5)

$$\tilde{X}_{K,m}=a\cdot\tilde{X}_{K,m-1}+b\cdot X_{K,m}, m\in\mathbb{N}^{+}.$$

$\tilde{X}_{K,m}$ is the resulting smoothed energy signal for each frequency channel K. The filter coefficients b and a=I−b are adapted for each processed audio signal separately, to yield satisfactory time constants. The slope of $\tilde{X}_{K,m}$ is then computed via high-pass (HP) filtering each bandpass signal in $\tilde{X}_{K,m}$ by using Eq. (2.5) as (Eq. 4.6)

$$S_{K,m}=\sum_{i=0}^{p} b_i\cdot\tilde{X}_{K,m-i}$$

where $S_{K,m}$ is the differentiated envelope, $b_i$ are the tilter coefficients of the deployed FIR high-pass filter and p is the filter order. The specific filter coefficients $b_i$ were also separately defined for each individual signal. Subsequently, $S_{K,m}$ is summed up in frequency direction across all K, to get the overall envelope slope $F_m$. Large peaks in $F_m$ correspond to the time-frames in which a transient event occurs. To neglect smaller peaks, especially following the larger ones, the amplitude of $F_m$ is reduced by a threshold of 0.1 in a way that $F_m=\max(F_m-0.1, 0)$. Post-masking after larger peaks is also considered by filtering $F_m$ with a single pole recursive averaging filter equivalent to Eq. (2.2) by (Eq. 4.7)

$$\tilde{F}_m=a\cdot\tilde{F}_{m-1}+b\cdot F_m, \text{ where } \tilde{F}_0=0$$

and taking the larger values of $\tilde{F}_m$ and $F_m$ for each frame m according to Eq. (2.3) to yield the resulting detection function $D_m$.

FIG. 13.2 shows the castanet signal in the time domain and the STFT domain, with the derived detection function $D_m$ illustrated in the bottom image. $D_m$ is then used as the input signal for the onset picking method, which will be described in the following section.

Onset Picking

Essentially, the onset picking method determines the instances of the local maxima in the detection function $D_m$ as the onset time-frames of the transient events in $S_n$. For the detection function of the castanets signal in FIG. 13.2, this is obviously a trivial task. The results of the onset picking method are displayed in the bottom image as red circles. However, other signals do not always yield such an easy-to-handle detection function, so the determination of the actual transient onsets gets somewhat more complex. For example the detection function for a musical signal at the bottom of FIG. 13.3 exhibits several local peak values that are not associated with a transient onset frame. Hence, the onset picking algorithm must distinguish between those "false" transient onsets and the "actual" ones.

First of all, the amplitude of the peak values in $D_m$ needs to be above a certain threshold $th_{peak}$, to be considered as onset candidates. This is done to prevent smaller amplitude changes in the envelope of the input signal $s_n$, that are not handled by the smoothing and post-masking filters in Eq. (4.5) and Eq. (4.7), to be detected as transient onsets. For every value $D_m=1$ of the detection function $D_m$, the onset picking algorithm scans the area preceding and following the current frame/for a larger value than $D_m=1$. If no larger value exists $I_b$ frames before and $I_a$ frames after the current frame, then/is determined as a transient frame. The number of "look-back" and "look-ahead" frames $I_b$ and $I_a$, as well as the threshold $th_{peak}$, were defined for each audio signal individually. After the relevant peak values have been identified, detected transient onset frames, that are closer than 50 ms to a preceding onset, will be discarded [50, 51]. The output of the onset picking method (and the transient detection in general) are the indexes of the transient onset frames $m_i$, that are required for the following transient enhancement blocks.

Pre-Echo Reduction

The purpose of this enhancement stage is to reduce the coding artifact known as pre-echo that may be audible in a certain time period before the onset of a transient. An overview of the pre-echo reduction algorithm is displayed in FIG. 13.4. The pre-echo reduction stage takes the output after the STFT analysis $X_{k,m}$ (100) as the input signal, as well as the previously detected transient onset frame index $m_i$. In the worst case, the pre-echo starts up to the length of a long-block analysis window at the encoder side (which is 2048 samples regardless of the codec sampling rate) before the transient event. The time duration of this window depends on the sampling frequency of the particular encoder. For the worst case scenario a minimum codec sampling frequency of 8 kHz is assumed. At a sampling rate of 44.1 kHz for the decoded and resampled input signal $s_n$, the length of a long analysis window (and therefore the potential extent of the pre-echo area) corresponds to $N_{long}$=2048·44.1 kHz/8 kHz=11290 samples (or 256 ms) of time signal $s_n$. Since the enhancement methods described in this chapter operate on the time-frequency representation $X_{k,m}$, $N_{long}$ has to be converted to $M_{long}=(N_{long}-L)/(N-L)=(11290-64)/(128-64)=176$ frames. N and L are the frame size and overlap of the STFT analysis block (100) in FIG. 13.1. $M_{long}$ is set as the upper bound of the pre-echo width and is used to limit the search area for the pre-echo start frame before a detected transient onset frame $m_i$. For this work, the sampling rate of the decoded signal before resampling is taken as a ground truth, so that the upper bound $M_{long}$ for the pre-echo width is adapted to the particular codec, that was used to encode $s_n$.

Before estimating the actual width of the pre-echo, tonal frequency components preceding the transient are being detected (200). After that, the pre-echo width is determined (240) in an area of $M_{long}$ frames before the transient frame. With this estimation a threshold for the signal envelope in the pre-echo area can be calculated (260), to reduce the energy in those spectral coefficients whose magnitude values exceed this threshold. For the eventual pre-echo reduction, a spectral weighting matrix is computed (450), containing multiplication factors for each k and m, which is then multiplied elementwise with the pre-echo area of $X_{k,m}$.

Detection of Tonal Signal Components Preceding the Transient

The subsequent detected spectral coefficients, corresponding to tonal frequency components before the transient onset, are utilized in the following pre-echo width estimation, as described in the next subsection. It could also be beneficial to use them in the following pre-echo reduction algorithm, to skip the energy reduction for those tonal spectral coefficients, since the pre-echo artifacts are likely to be masked by present tonal components. However, in some cases the skipping of the tonal coefficients resulted in the introduction of an additional artifact in the form an audible energy increase at some frequencies in the proximity of the detected tonal frequencies, so this approach has been omitted for the pre-echo reduction method in this embodiment.

FIG. 13.5 shows the spectrogram of the potential pre-echo area before a transient of the Glockenspiel audio signal. The spectral coefficients of the tonal components between the two dashed horizontal lines are detected by combining two different approaches:

1. Linear prediction along the frames of each spectral coefficient and
2. an energy comparison between the energy in each k over all $K_{long}$ frames before the transient onset and a running mean energy of all previous potential pre-echo areas of length $K_{long}$.

First, a linear prediction analysis is performed on each complex-valued STFT coefficient k across time, where the prediction coefficients $\alpha_{k,r}$ are computed with the Levinson-Durbin algorithm according to Eq. (2.21)-(2.24). With these prediction coefficients a prediction gain $R_{p,k}$ [52, 53, 54J can be calculated for each k as (Eq. 4.8)

$$R_{p,k} = 10\log_{10}\left(\frac{\sigma^2_{X_k}}{\sigma^2_{E_k}}\right)\text{dB},$$

where $\sigma^2_{Xk}$ and $\sigma_{Ek}^2$ are the variances of the input signal $X_{k,m}$ and its prediction error $E_{k,m}$ respectively for each k. $E_{k,m}$ is computed according to Eq. (2.10). The prediction gain is an indication on how accurate $X_{k,m}$ can be predicted with the prediction coefficients $\alpha_{k,r}$ with a high prediction gain corresponding to a good predictability of the signal. Transient and noise-like signals tend to cause a lower prediction gain for a time-domain linear prediction, so if $R_{p,k}$ is high enough for a certain k, then this spectral coefficient is likely to contain tonal signal components. For this method, the threshold for a prediction gain corresponding to a tonal frequency component was set to 10 dB.

In addition to a high prediction gain, tonal frequency components should also contain a comparatively high energy over the rest of the signal spectrum. The energy $\varepsilon_{i,k}$ in the potential pre-echo area of the current i-th transient is therefore compared to a certain energy threshold. $\varepsilon_{i,k}$ is calculated by (Eq. 4.9)

$$\varepsilon_{i,k} = \frac{1}{M_{long}} \cdot \sum_{j=m_i-M_{long}}^{m_i-1} |X_{k,j}|^2.$$

The energy threshold is computed with a running mean energy of the past pre-echo areas, that is updated for every next transient. The running mean energy shall be denoted as $\bar{\varepsilon}_i$. Note that $\bar{\varepsilon}_i$ does not yet consider the energy in the current pre-echo area of the i-th transient. The index i solely points out, that $\bar{\varepsilon}_i$ is used for the detection regarding the current transient. If $\bar{\varepsilon}_{i-1}$ is the total energy over all spectral coefficients k and frames m of the previous pre-echo area, then $\bar{\varepsilon}_i$ is calculated by (Eq. 4.10)

$$\bar{\varepsilon}_i = b\cdot\bar{\varepsilon}_{i-1} + (1-b)\cdot\varepsilon_{i-1}, \text{ with } b=0.7.$$

Hence a spectral coefficient index k in the current pre-echo area is defined to contain tonal components, if (Eq. 4.11)

$$R_{p,k} > 10 \text{ dB and } \varepsilon_{i,k} > 0.8\cdot\bar{\varepsilon}_i.$$

The result of the tonal signal component detection method (200) is a vector $k_{tonal,i}$ for each pre-echo area preceding a detected transient, that specifies the spectral coefficient indexes k which fulfill the conditions in Eq. (4.11).

Estimation of the Pre-Echo Width

Since there is no information about the exact framing of the decoder (and therefore about the actual pre-echo width) available for the decoded signal $s_n$, the actual pre-echo start frame has to be estimated (240) for every transient before the pre-echo reduction process. This estimation is crucial for the resulting sound quality of the processed signal after the pre-echo reduction. If the estimated pre-echo area is too small, part of the present pre-echo will remain in the output signal. If it is too large, too much of the signal amplitude before the transient will be damped, potentially resulting in audible signal drop-outs. As described before, $M_{long}$ represents the size of a long analysis window used in the audio encoder and is regarded as the maximum possible number of frames of the pre-echo spread before the transient event. The maximum range $M_{long}$ of this pre-echo spread will be denoted as the pre-echo search area.

FIG. 13.6 displays a schematic representation of the pre-echo estimation approach. The estimation method follows the assumption, that the induced pre-echo causes an increase in the amplitude of the temporal envelope before the onset of the transient. This is shown in FIG. 13.6 for the area between the two vertical dashed lines. In the decoding process of the encoded audio signal the quantization noise is not spread equally over the entire synthesis block, but rather will be shaped by the particular form of the used window function. Therefore the induced pre-echo causes a gradual rise and not a sudden increase of the amplitude. Before the onset of the pre-echo, the signal may contain silence or other signal components like the sustained part of another acoustic event that occurred sometime before. So the aim of the pre-echo width estimation method is to find the time instant where the rise of the signal amplitude corresponds to the onset of the induced quantization noise, i.e. the pre-echo artifact.

The detection algorithm only uses the HF content of $X_{k,m}$ above 3 kHz, since most of the energy of the input signal is concentrated in the LF area. For the specific STFT parameters used here, this corresponds to the spectral coefficients with k≥18. This way, the detection of the pre-echo onset gets more robust because of the supposed absence of other signal components that could complicate the detection process. Furthermore, the tonal spectral coefficients $k_{tonal}$, that have been detected with the previously described tonal component detection method, will also be excluded from the estimation process, if they correspond to frequencies above 3 kHz. The remaining coefficients are then used to compute a suitable detection function that simplifies the pre-echo estimation. First, the signal energy is summed up in frequency direction for all frames in the pre-echo search area, to get magnitude signal $L_m$ as (Eq. 4.12)

$$L_m = 20\cdot\log_{10}\left(\sum_{i=18}^{k_{max}} X_{i,m}^2\right)\text{dB},\ i \neq k_{tonal}.$$

$k_{max}$ corresponds to the cut-off frequency of the low-pass filter, that has been used in the encoding process to limit the bandwidth of the original audio signal. After that, $L_m$ is smoothed to reduce the fluctuations on the signal level. The smoothing is done by filtering $L_m$ with a 3-tap running average filter in both forward and backward directions across time, to yield the smoothed magnitude signal $\tilde{L}_m$. This way, the filter delay is compensated and the filter becomes zero-phase. $\tilde{L}_m$ is then derived to compute its slope $L'_m$ by (Eq. 4.13)

$$L'_m = \tilde{L}_m - \tilde{L}_{m-1}$$

$L'_m$ is then filtered with the same running average filter used for $L_m$ before. This yields the smoothed slope $\tilde{L}'_m$, which is used as the resulting detection function $D_m = D_m \tilde{L}_m$ to determine the starting frame of the pre-echo.

The basic idea of the pre-echo estimation is to find the last frame with a negative value of $D_m$, which marks the time instant after which the signal energy increases until the onset of the transient. FIG. 13.7 shows two examples for the computation of the detection function $D_m$ and the subsequently estimated pre-echo start frame. For both signals in (a) and (b) the magnitude signals $L_m$ and $\tilde{L}_m$ are displayed in the upper image, while the lower image shows the slopes $L'_m$ and $\tilde{L}_m$, which is also the detection function $D_m$. For the signal in FIG. 13.7(*a*), the detection simply requires to find the last frame $m^-_{last}$ with a negative value of $D_m$ in the lower image, i.e. $D_{m^-_{last}} \leq 0$. The determined pre-echo $m_{last}^-$ start frame $m_{pre} = m_{last}^-$ is represented as the vertical line. The plausibility of this estimation can be seen by a visual examination of the upper image of FIG. 13.7(*a*). However, exclusively taking the last negative value of $D_m$ would not give a suitable result for the lower signal (funk) in (b). Here, the detection function ends with a negative value and taking this last frame as $m_{pre}$ would effectively result in no reduction of the pre-echo at all. Furthermore, there may be other frames with negative values of $D_m$ before that, that also do not fit the actual start of the pre-echo. This can be seen for example in the detection function of signal (b) for $52 \leq m \leq 58$. Therefore the search algorithm has to consider these fluctuations in the amplitude of magnitude signal, that can also be present in the actual pre-echo area.

The estimation of the pre-echo start frame $m_{pre}$ is done by employing an iterative search algorithm. The process for the pre-echo start frame estimation will be described with the example detection function shown in FIG. 13.8 (which is the same detection function of the signal in FIG. 13.7(*b*)). The top and bottom diagrams of FIG. 13.8 illustrate the first two iterations of the search algorithm. The estimation method scans $D_m$ in reverse order from the estimated onset of the transient to beginning of the pre-echo search area and determines several frames where the sign of $D_m$ changes. These frames are represented as the numbered vertical lines in the diagram. The first iteration in the top image starts at the last frame with a positive value of $D_m$ (line 1), denoted here as $m^+_{last}$ and determines the preceding frame where the sign changes from $+ \rightarrow -$ as the pre-echo start frame candidate (line 2). To decide whether the candidate frame should be regarded as the final estimation of $m_{pre}$, two additional frames with a change of sign $m^+$ (line 3) and $m^-$ (line 4) are determined prior to the candidate frame. The decision whether the candidate frame should be taken as the resulting pre-echo start frame $m_{pre}$ is based on the comparison between the summed up values in the gray and black area ($A^+$ and $A^-$). This comparison checks if the black area $A^-$, where $D_m$ exhibits a negative slope, can be considered as the sustained part of the input signal before the starting point of the pre-echo, or if it is a temporary amplitude decrease within the actual pre-echo area. The summed up slopes $A^+$ and $A^-$ are calculated as (Eq. 4.14)

$$A^+ = \sum_{i=m^-+1}^{m^+} D_i \text{ and } A^- = \sum_{i=m^++1}^{cand.\ m_{pre}} D_i.$$

With $A^+$ and $A^-$, the candidate pre-echo start frame at line 2 will be defined as the resulting start frame $m_{pre}$, if (Eq. 4.15)

$$A^- > \alpha \cdot A^+,$$

The factor a is initially set to a=0.5 for the first iteration of the estimation algorithm and is then adjusted to a=0.92·a for every subsequent iteration. This gives a greater emphasis to the negative slope area $A^-$, which is necessary for some signals that exhibit stronger amplitude variations in the magnitude signal $L_m$ throughout the whole search area. If the stop-criterion in Eq. (4.15) does not hold (which is the case for the first iteration in the top image of FIG. 13.8), then the next iteration, as illustrated in the bottom image, takes the previously determined $m^+$ as the last considered frame $m^+_{last}$ and precedes equivalent to the past iteration. It can be seen that Eq. (4.15) holds for the second iteration, since $A^-$ is obviously larger than $A^+$, so the candidate frame at line 2 will be taken as the final estimation of the pre-echo start frame $m_{pre}$.

Adaptive Pre-Echo Reduction

The following execution of the adaptive pre-echo reduction can be divided into three phases, as can be seen in the bottom layer of the block diagram in FIG. 13.4: the determination of a pre-echo magnitude threshold $th_k$ the computation of a spectral weighting matrix $W_{k,m}$ and the reduction of pre-echo noise by an element-wise multiplication of $W_{k,m}$ with the complex-valued input signal $X_{k,m}$. FIG. 13.9 shows the spectrogram of the input signal $X_{on}$ in the upper image, as well as the spectrogram of the processed output signal $Y_{k,m}$ in the middle image, where the pre-echoes have been reduced. The pre-echo reduction is executed by an element-wise multiplication of $X_{k,m}$ and the computed spectral weights $W_{k,m}$ (displayed in the lower image of FIG. 13.9) as (Eq. 4.16)

The goal of the pre-echo reduction method is to weight the values of $X_{k,m}$ in the previously estimated pre-echo area, so that the resulting magnitude values of $Y_{k,m}$ lie under a certain threshold thk. The spectral weight matrix $W_{k,m}$ is created by determining this threshold $th_k$ for each spectral coefficient in $X_{k,m}$ over the pre-echo area and computing the weighting factors required for the pre-echo attenuation for each frame m. The computation of $W_{k,m}$ is limited to the spectral coefficients between $k_{min} \leq k \leq k_{max}$, where $k_{min}$ is the spectral coefficient index corresponding to the closest frequency to $f_{min}$=800 Hz, so that $W_{k,m}=1$ for $k<k_{min}$ and $k>k_{max}$·f min was chosen to avoid an amplitude reduction in the low-frequency area, since most of the fundamental frequencies of musical instruments and speech lie beneath 800 Hz. An amplitude damping in this frequency area is prone to produce audible signal drop-outs before the transients, especially for complex musical audio signals. Furthermore, $W_{k,m}$ is restricted to the estimated pre-echo area with $m_{pre} \leq m \leq m_i - 2$, where $m_i$ is the detected transient onset. Due to the 50% overlap between adjacent time-frames in the STFT analysis of the input signal $s_n$, the frame directly preceding the transient onset frame $m_i$ is also likely to contain the transient event. Therefore, the pre-echo damping is limited to the frames $m \leq m_i - 2$.

Pre-Echo Threshold Determination

As stated before, a threshold $th_k$ needs to be determined (260) for each spectral coefficient $X_{k,m}$, with $k_{min} \leq k \leq k_{max}$, that is used to determine the spectral weights needed for the pre-echo attenuation in the individual pre-echo areas preceding each detected transient onset. $th_k$ corresponds to the magnitude value to which the signal magnitude values of $X_{k,m}$ should be reduced, to get the output signal $Y_{k,m}$. An intuitive way could be to simply take the value of the first frame $m_{pre}$ of the estimated pre-echo area, since it should correspond to the time instant where signal amplitude starts to rise constantly as a result of the induced pre-echo quantization noise. However, $|X_{k,m}|$ does not necessarily represent the minimum magnitude value for all signals, for example if the pre-echo area was estimated too large or because of possible fluctuations of the magnitude signal in the pre-echo area. Two examples of a magnitude signal $|X_{k,m}|$ in the pre-echo area preceding a transient onset are displayed as the solid gray curves in FIG. 13.10. The top image represents a spectral coefficient of a castanet signal and the bottom image a glockenspiel signal in the sub-band of a sustained tonal component from a previous glockenspiel tone. To compute a suitable threshold, $|X_{k,m}|$ is first filtered with a 2-tap running average filter back and forth over time, to get the smoothed envelope $|\tilde{X}_{k,m}|$ (illustrated as the dashed black curve). The smoothed signal $|\tilde{X}_{k,m}|$ is then multiplied with a weighting curve $C_m$ to increase the magnitude values towards the end of the pre-echo area. $C_m$ is displayed in FIG. 13.11 and can be generated as (Eq. 4.17)

$$C_m = 1 + \left(\frac{m-1}{M_{pre}-1}\right)^{5.012}, \; 1 \le m \le M_{pre},$$

where $M_{pre}$ is the number of frames in the pre-echo area. The weighted envelope after multiplying $|\tilde{X}_{k,m}|$ with $C_m$ is shown as the dashed gray curve in both diagrams of FIG. 13.10. Subsequently, the pre-echo noise threshold $th_k$ will be taken as the minimum value of $|\tilde{X}_{k,m}| \cdot C_m$, which is indicated by the black circles. The resulting thresholds $th_k$ for both signals are depicted as the dash-dotted horizontal lines. For the castanet signal in the top image it would be sufficient to simply take the mini mum value of the smoothed magnitude signal $|\tilde{X}_{k,m}|$, without weighting it with $C_m$. However, the application of the weighting curve is necessary for the glockenspiel signal in the bottom image, where the minimum value of $|\tilde{X}_{k,m}|$ is located at the end of the pre-echo area. Taking this value as $th_k$ would result in a strong damping of the tonal signal component, hence induce audible drop-out artifacts. Also, due to the higher signal energy in this tonal spectral coefficient, the pre-echo is probably masked and therefore inaudible. It can be seen, that the multiplication of $|\tilde{X}_{k,m}|$ with the weighting curve Cm does not change the minimum value of $|\tilde{X}_{k,m}|$ in the upper signal in FIG. 13.10 very much, while resulting in an appropriately high $th_k$ for the tonal glockenspiel component displayed in the bottom diagram.

Computation of the Spectral Weights

The resulting threshold $th_k$ is used to compute the spectral weights $W_{k,m}$ required to decrease the magnitude values of $X_k$m' Therefore a target magnitude signal $|\check{X}_{k,m}|$ will be computed (450) for every spectral coefficient index k, that represents the optimal output signal with reduced pre-echo for every individual k. With $|\check{X}_{k,m}|$, the spectral weight matrix $W_{k,m}$ can be computed as (Eq. 4.18)

$$W_{k,m} = \frac{|\check{X}_{k,m}|}{|X_{k,m}|}.$$

$W_{k,m}$ is subsequently smoothed (460) across frequency by applying a 2-tap running average filter in both forward and backward direction for each frame m, to reduce large differences between the weighting factors of neighboring spectral coefficients k prior to the multiplication with the input signal $X_k$m' The damping of the pre-echoes is not done immediately at the pre-echo start frame $m_{pre}$ to its full extent, but rather faded in over the time period of the pre-echo area. This is done by employing (430) a parametric fading curve $f_m$ with adjustable steepness, that is generated (440) as (Eq. 4.19)

$$f_m = \left(\frac{M_{pre}-m}{M_{pre}-1}\right)^{10^c}, \; 1 \le m \le M_{pre},$$

where the exponent $10^c$ determines the steepness of $f_m$. FIG. 13.12 shows the fading curves for different values of c, which has been set to c=−0.5 for this work. With $f_m$ and $th_k$, the target magnitude signal $|\check{X}_{k,m}|$ can be computed as (Eq. 4.20)

$$|\check{X}_{k,m}| = \begin{cases} th_k + f_m \cdot (|X_{k,m}| - th_k), & |X_{k,m}] > th_k \\ |X_{k,m}|, & \text{else.} \end{cases}$$

This effectively reduces the values of $|X_{k,m}|$ that are higher than the threshold $th_k$, while leaving values below $th_k$ untouched.

Application of a Temporal Pre-Masking Model

A transient event acts as a masking sound that can temporally mask preceding and following weaker sounds. A pre-masking model is also applied (420) here, in a way that the values of $|X_{k,m}|$ should only be reduced until they fall under the pre-masking threshold, where they are assumed to be inaudible. The used pre-masking model first computes a "prototype" pre-masking threshold $mask_{m,i}^{proto}$, that is then adjusted to the signal level of the particular masker transient in $X_{k,m}$. The parameters for the computation of the pre-masking thresholds were chosen according to B. Edler (personal communication, Nov. 22, 2016) [55]. $mask_{m,i}^{proto}$ is generated as an exponential function as (Eq. 4.21)

$$mask_{m,i}^{proto} = L \cdot \exp(m \cdot a), m \le 0.$$

The parameters L and α determine the level, as well as the slope, of $mask_{m,i}^{proto}$. The level parameter L was set to (Eq. 4.22)

$$L = L_{fall} + L_0 = 50 \text{ dB} + 10 \text{ dB} = 60 \text{ dB}.$$

$t_{fall}$=3 ms before the masking sound, the pre-masking threshold should be decreased by $L_{fall}$=50 dB. First, $t_{fall}$ needs to be converted into a corresponding number of frames $m_{fall}$, by taking (Eq. 4.23)

$$m_{fall} = \frac{t_{fall}}{N-L} \cdot \frac{f_s}{1000} = \frac{3 \text{ ms}}{64} \cdot 44.1 \text{ kHz} = 2.0672,$$

where (N−L) is the hop size of the STFT analysis and $f_s$ is the sampling frequency. With L, $L_{fall}$ and $M_{fall}$ Eq. (4.21) becomes (Eq. 4.24)

$$mask_{-m_{fall},i}^{proto} = L \cdot \exp(-m_{fall} \cdot a) = L - L_{fall} = 10 \text{ dB},$$

so the parameter α can be determined by transforming Eq. (4.24) as (Eq. 4.25)

$$a = -\frac{\ln\left(1 - \frac{L_{fall}}{L}\right)}{m_{fall}} = 0.8668.$$

The resulting preliminary pre-masking threshold $mask_{m,i}^{proto}$ is shown in FIG. 13.13 for the time period before the onset of a masking sound (occurring at m=0). The vertical dashed line marks the time instant $-m_{fall}$, corresponding to $t_{fall}$ ms before the masker onset, where the threshold decreases by $L_{fall}$=50 dB. According to Fastl and Zwicker [33], as well as Moore [34], pre-masking can last up to 20 ms. For the used framing parameters in the STFT analysis this corresponds to a pre-masking duration of $M_{mask}$≈14 frames, so that $mask_{m,i}^{proto}$ is set to −oo frames $m \leq -Mm_{ask}$.

For the computation of the particular signal-dependent pre-masking threshold $mask_{k,m,i}$ in every pre-echo area of $X_{k,m}$, the detected transient frame $m_i$ as well as the following $M_{mask}$ frames will be regarded as the time instances of potential maskers. Hence, $mask_{m,i}^{proto}$ is shifted to every $m_i \leq m < m_i + M_{mask}$ and adjusted to the signal level of $X_{k,m}$ with a signal-to-mask ratio of −6 dB (i.e. the distance between the masker level and $mask_{m,i}^{proto}$ at the masker frame) for every spectral coefficient. After that, the maximum values of the overlapping thresholds are taken as the resulting pre-masking thresholds $mask_{k,m,i}$ for the respective pre-echo area. Finally, $mask_{k,m,i}$ is smoothed across frequency in both directions, by applying a single pole recursive averaging filter equivalent to the filtering operation in Eq. (2.2), with a filter coefficient b=0.3.

The pre-masking threshold $mask_{k,m,i}$ is then used to adjust the values of the target magnitude signal (as computed in Eq. (4.20)), by taking (Eq. 4.26)

$$\left|\breve{X}_{k,m}\right| = \begin{cases} \text{mask}_{k,m,i}, & \left|\breve{X}_{k,m}\right| \leq \text{mask}_{k,m,i} \leq |X_{k,m}| \\ \left|\breve{X}_{k,m}\right|, & \text{else.} \end{cases}$$

FIG. 13.14 shows the same two signals from FIG. 13.10 with the resulting target magnitude signal $|\breve{X}_{k,m}|$ as the solid black curves. For the castanets signal in the top image it can be seen how the reduction of the signal magnitude to the threshold $th_k$ is faded in across the pre-echo area, as well as the influence of the pre-masking threshold for the last frame m=16, where $|\breve{X}=_{k,16}|=|\breve{X}=_{k,16}|$ The bottom image (tonal spectral component of the glockenspiel signal) shows, that the adaptive pre-echo reduction method has only a minor impact on sustained tonal signal components, only slightly damping smaller peaks while retaining the overall magnitude of the input signal $X_{k,m}$.

The resulting spectral weights $W_{k,m}$ are then computed (450) with $X_{k,m}$ and $X_{k,m}$ according to Eq. (4.18) and smoothed across frequency, before they are applied to the input signal $X_{k,m}$. Finally, the output signal $Y_{k,m}$ of the adaptive pre-echo reduction method is obtained by applying (320) the spectral weights $W_{k,m}$ to $X_{k,m}$ via element-wise multiplication according to Eq. (4.16). Note that $W_{k,m}$ is real-valued and therefore does not alter the phase response of the complex-valued $X_{k,m}$. FIG. 13.15 displays the result of the pre-echo reduction for a glockenspiel transient with a tonal component preceding the transient onset. The spectral weights $W_{k,m}$ in the bottom image show values at around 0 dB in the frequency band of the tonal component, resulting in the retention of the sustained tonal part of the input signal.

Enhancement of the Transient Attack

The methods discussed in this section aim to enhance the degraded transient attack as well as to emphasize the amplitude of the transient events.

Adaptive Transient Attack Enhancement

Besides the transient frame $m_i$, the signal in the time period after the transient gets amplified as well, with the amplification gain being faded out over this interval. The adaptive transient attack enhancement method takes the output signal of the pre-echo reduction stage as its input signal $X_{k,m}$. Similar to the pre-echo reduction method, a spectral weighting matrix $W_{k,m}$ is computed (610) and applied (620) to $X_{k,m}$ as $$Y_{k,m} = X_{k,m} \cdot W_{k,m}.$$

However, in this case $W_{k,m}$ is used to raise the amplitude of the transient frame $m_i$ and to a lesser extent also the frames after that, instead of modifying the time period preceding the transient. The amplification is thereby restricted to frequencies above $f_{min}$=400 Hz and below the cut-off frequency $f_{max}$ of the low-pass filter applied in the audio encoder. First, the input signal Xk,m is divided into a sustained part $X_{k,m}^{sust}$ and a transient part $X_{k,m}^{trans}$. The subsequent signal amplification is only applied to the transient signal part, while the sustained part is fully retained. $X_{k,m}^{sust}$ is computed by filtering the magnitude signal $|X_{k,m}|$ (650) with a single pole recursive averaging filter according to Eq. (2.4), with the used filter coefficient being set to b=0.41. The top image of FIG. 13.16 shows an example of the input signal magnitude $|X_{k,m}|$ as the gray curve, as well as the corresponding sustained signal part $X_{k,m}^{sust}$ as the dashed curve. The transient signal part is then computed (670) as (Eq. 4.27)

$$X_{k,m}^{trans} = |X_{k,m}| - X_{k,m}^{sust}.$$

The transient part $X_{k,m}^{trans}$ of the corresponding input signal magnitude $|X_{k,m}|$ in the top image is displayed in the bottom image of FIG. 13.16 as the gray curve. Instead of only multiplying $X_{k,m}^{trans}$ at $m_i$ with a certain gain factor G, the amount of amplification is rather faded out (680) over a time period of $T_{amp}$=100 ms≜$M_{amp}$=69 frames after transient frame. The faded out gain curve G111 is shown in FIG. 13.17. The gain factor for the transient frame of $X_{k,m}^{trans}$ is set to $G_1$=2.2, which corresponds to a magnitude level increase of 6.85 dB, with the gain for the subsequent frames being decreased according to $G_m$. With the gain curve G111 and the sustained and transient signal parts, the spectral weighting matrix $W_{k,m}$ will be obtained (680) by (Eq. 4.28)

$$W_{k,m} = \frac{X_{k,m}^{sust} + G_m \cdot X_{k,m}^{trans}}{|X_{k,m}|}, \; m_i \leq m < m_i + M_{amp},$$

$W_{k,m}$ is then smoothed (690) across frequency in both forward and backward direction according to Eq. (2.2), before enhancing the transient attack according to Eq. (4.27). In the bottom image of FIG. 13.16 the result of the amplification of the transient signal part $X_{k,m}^{trans}$ with the gain curve $G_m$ can be seen as the black curve. The output signal magnitude $Y_{k,m}$ with the enhanced transient attack is shown in the top image as the solid black curve.

Temporal Envelope Shaping Using Linear Prediction

Opposed to the adaptive transient attack enhancement method described before, this method aims to sharpen the attack of a transient event, without increasing its amplitude. Instead, "sharpening" the transient is done by applying (720) linear prediction in the frequency domain and using two different sets of prediction coefficients $\alpha_r$ for the inverse (720*a*) and the synthesis filter (720*b*) to shape (740) the temporal envelope of the time signal $s_n$. By filtering the input signal spectrum with the inverse filter (740*a*), the prediction residual $E_{k,m}$ can be obtained according to Eq. (2.9) and (2.10) as (Eq. 4.29)

$$E_{k,m} = X_{k,m} - \sum_{r=1}^{p} a_r^{flat} \cdot X_{k-r,m}.$$

The inverse filter (740*a*) decorrelates the filtered input signal $X_{k,m}$ both in the frequency and the time domain, effectively flattening the temporal envelope of the input signal $s_n$. Filtering $E_{k,m}$ with the synthesis filter (740*b*) according to Eq. (2.12) (using the prediction coefficients $\alpha_r^{synth}$) perfectly reconstructs the input signal $X_{k,m}$ if $\alpha_r^{synth}=\alpha_r^{flat}$. The goal for the attack enhancement is to compute the prediction coefficients $\alpha_r^{flat}$ and $\alpha_r^{synth}$ in a way that the combination of the inverse filter and the synthesis filter exaggerates the transient while attenuating the signal parts before and after it in the particular transient frame.

The LPC shaping method works with different framing parameters as the preceding enhancement methods. Therefore the output signal of the preceding adaptive attack enhancement stage needs to be resynthesized with the ISTFT and the analyzed again with the new parameters. For this method a frame size of N=512 samples is used, with a 50% overlap of L=N/2=256 samples. The DFT size was set to 512. The larger frame size was chosen to improve the computation of the prediction coefficients in the frequency domain, wherefore a high frequency resolution is more important than a high temporal resolution. The prediction coefficients $\alpha_r^{flat}$ and $\alpha_r^{synth}$ are computed on the complex spectrum of the input signal $X_{k,m}$, for a frequency band between $f_{min}$=800 Hz and $f_{max}$ (which corresponds to the spectral coefficients with $k_{min}=10\leq k_{lpc}\leq k_{max}$) with the Levinson-Durbin algorithm after Eq. (2.21)-(2.24) and a LPC order of p=24. Prior to that, the autocorrelation function $R_i$ of the bandpass signal $X_{k_{lpc},m_i}$ is multiplied (802, 804) with two different window functions $W_i^{flat}$ and $W_i^{synth}$ for the computation of $\alpha_r^{flat}$ and $\alpha_r^{synth}$ in order to smooth the temporal envelope described by the respective LPC filters [56]. The window functions are generated as (Eq. 4.30)

$$W_i=c^i, 0\leq i\leq k_{max}-k_{min},$$

with $c_{flat}$=0.4 and $c_{synth}$=0.94. The top image FIG. 13.13 shows the two different window functions, which are then multiplied with $R_i$. The autocorrelation function of an example input signal frame is depicted in the bottom image, along with the two windowed versions ($R_i \cdot W_i^{flat}$) and ($R_i \cdot W_i^{synth}$). With the resulting prediction coefficients as the filter coefficients of the flattening and shaping filter, the input signal $X_{k,m}$ is shaped by using the result of Eq. (4.30) with Eq. (2.6) as (Eq. 4.31)

$$Y_{k,m} = \sum_{r=1}^{p} a_r^{synth} Y_{k-r,m} + G \cdot \left( X_{k,m} - \sum_{r=1}^{p} a_r^{flat} \cdot X_{k-r,m} \right)$$

This describes the filtering operation with resulting shaping filter, which can be interpreted as the combined application (820) of the inverse filter (809) and the synthesis filter (810). Transforming Eq. (4.32) with the FFT yields the time-domain filter transfer function (TF) of the system as (Eq. 4.32)

$$\begin{aligned} H_n^{shape} &= G \cdot \frac{1-P_n}{A_n} \\ &= G \cdot H_n^{flat} \cdot H_n^{synth}, \end{aligned}$$

with the FIR (inverse/flattening) filter $(1-P_n)$ and the IIR (synthesis) filter $A_n$. Eq. (4.32) can equivalently be formulated in the time-domain as the multiplication of the input signal frame $s_n$ with the shaping filter TF $H_n^{shape}$ as (Eq. 4.33)

$$y_n=s_n \cdot H_n^{shape},$$

FIG. 13.13 shows the different time-domain TFs of Eq. (4.33). The two dashed curves correspond to $H_n^{flat}$ and $H_n^{synth}$, with the solid gray curve representing the combination (820) of the inverse and the synthesis filter ($H_n^{flat} \cdot H_n^{synth}$) before the multiplication with the gain factor G (811). It can be seen that the filtering operation with a gain factor of G=1 would result in a strong amplitude increase of the transient event, in this case for the signal part between 140<n>426. An appropriate gain factor G can be computed as the ratio of the two prediction gains $R_p^{flat}$ and $R_p^{synth}$ for the inverse filter and the synthesis filter by (Eq. 4.34)

$$G = \frac{R_p^{flat}}{R_p^{synth}}.$$

The prediction gain $R_p$ is calculated from the partial correlation coefficients $\rho_m$, with $1\leq m\leq p$, which are related to the prediction coefficients $\alpha_r$, and are calculated along with $\alpha_r$ in Eq. (2.21) of the Levinson-Durbin algorithm. With $\rho_m$, the prediction gain (811) is then obtained by (Eq. 4.31)

$$R_p = \frac{1}{\Pi_{m=1}^{p}(1-|\rho_m|^2)}$$

The final TF $H_n^{shape}$ with the adjusted amplitude is displayed in FIG. 13.13 as the solid black curve. FIG. 13.13 shows the waveform of the resulting output signal $y_n$ after the LPC envelope shaping in the top image, as well as the input signal $s_n$ in the transient frame. The bottom image compares the input signal magnitude spectrum $X_{k,m}$ with the filtered magnitude spectrum $Y_{k,m}$.

Furthermore examples of embodiments particularly relating to the first aspect are set out subsequently:

1. Apparatus for post-processing (20) an audio signal, comprising:
   - a converter (100) for converting the audio signal into a time-frequency representation;
   - a transient location estimator (120) for estimating a location in time of a transient portion using the audio signal or the time-frequency representation; and
   - a signal manipulator (140) for manipulating the time-frequency representation, wherein the signal manipulator is configured to reduce (220) or eliminate a pre-echo in the time-frequency representation at a location in time before the transient location or to perform a shaping (500) of the time-frequency representation at the transient location to amplify an attack of the transient portion.

2. Apparatus of example 1,
wherein the signal manipulator (140) comprises a tonality estimator (200) for detecting tonal signal components in the time-frequency representation preceding the transient portion in time, and
wherein the signal manipulator (140) is configured to apply the pre-echo reduction or elimination in a frequency-selective way, so that at frequencies where tonal signal components have been detected, the signal manipulation is reduced or switched off compared to frequencies where the tonal signal components have not been detected.

3. Apparatus of examples 1 or 2, wherein the signal manipulator (140) comprises a pre-echo width estimator (240) for estimating a width in time of the pre-echo preceding the transient location based on a development of a signal energy of the audio signal over time to determine a pre-echo start frame in the time-frequency representation comprising a plurality of subsequent audio signal frames.

4. Apparatus of one of the preceding examples, wherein the signal manipulator (140) comprises a pre-echo threshold estimator (260) for estimating pre-echo thresholds for spectral values in the time-frequency representation within a pre-echo width, wherein the pre-echo thresholds indicate amplitude thresholds of corresponding spectral values subsequent to the pre-echo reduction or elimination.

5. Apparatus of example 4, wherein the pre-echo threshold estimator (260) is configured to determine the pre-echo threshold using a weighting curve having an increasing characteristic from a start of the pre-echo width to the transient location.

6. Apparatus of one of the preceding examples, wherein the pre-echo threshold estimator (260) is configured:
to smooth (330) the time-frequency representation over a plurality of subsequent frames of the time-frequency representation, and
to weight (340) the smoothed time-frequency representation using a weighting curve having an increasing characteristic from a start of the pre-echo width to the transient location.

7. Apparatus of one of the preceding examples, wherein the signal manipulator (140) comprises:
a spectral weights calculator (300, 160) for calculating individual spectral weights for spectral values of the time-frequency representation; and
a spectral weighter (320) for weighting spectral values of the time-frequency representation using the spectral weights to obtain a manipulated time-frequency representation.

8. Apparatus of example 7, wherein the spectral weights calculator (300) is configured:
to determine (450) raw spectral weights using an actual spectral value and a target spectral value, or
to smooth (460) the raw spectral weights in frequency within a frame of the time-frequency representation, or
to fade-in (430) a reduction or elimination of the pre-echo using a fading curve over a plurality of frames at the beginning of the pre-echo width, or
to determine (420) the target spectral value so that the spectral value having an amplitude below a pre-echo threshold is not influenced by the signal manipulation, or
to determine (420) the target spectral values using a pre-masking model (410) so that a damping of a spectral value in the pre-echo area is reduced based on the pre-masking model (410).

9. Apparatus of one of the preceding examples,
wherein the time-frequency representation comprises complex-valued spectral values, and
wherein the signal manipulator (140) is configured to apply real-valued spectral weighting values to the complex-valued spectral values.

10. Apparatus of one of the preceding examples,
wherein the signal manipulator (140) is configured to amplify (500) spectral values within a transient frame of the time-frequency representation.

11. Apparatus of one of the preceding examples,
wherein the signal manipulator (140) is configured to only amplify spectral values above a minimum frequency, the minimum frequency being greater than 250 Hz and lower than 2 kHz.

12. Apparatus of one of the preceding examples,
wherein the signal manipulator (140) is configured to divide (630) the time-frequency representation at the transient location into a sustained part and the transient part,
wherein the signal manipulator (140) is configured to only amplify the transient part and to not amplify the sustained part.

13. Apparatus of one of the preceding examples,
wherein the signal manipulator (140) is configured to also amplify a time portion of the time-frequency representation subsequent to the transient location in time using a fade-out characteristic (685).

14. Apparatus of one of the preceding examples,
wherein the signal manipulator (140) is configured to calculate (680) a spectral weighting factor for a spectral value using a sustained part of the spectral value, an amplified transient part and a magnitude of the spectral value, wherein an amplification amount of the amplified part is predetermined and between 300% and 150%, or
wherein the spectral weights are smoothed (690) across frequency.

15. Apparatus of one of the preceding examples,
further comprising a spectral-time converter for converting (370) a manipulated time-frequency representation into a time domain using an overlap-add operation involving at least adjacent frames of the time-frequency representation.

16. Apparatus of one of the preceding examples,
wherein the converter (100) is configured to apply a hop size between 1 and 3 ms or an analysis window having a window length between 2 and 6 ms, or
wherein the spectral-time converter (370) is configured to use and overlap range corresponding to an overlap size of overlapping windows or corresponding to a hop size used by the converter between 1 and 3 ms, or to use a synthesis window having a window length between 2 and 6 ms, or wherein the analysis window and the synthesis window are identical to each other.

17. Method of post-processing (20) an audio signal, comprising:
converting (100) the audio signal into a time-frequency representation;
estimating (120) a transient location in time of a transient portion using the audio signal or the time-frequency representation; and manipulating (140) the time-frequency representation to reduce (220) or eliminate a pre-echo in the time-frequency representation at a location in time before the transient location, or to perform a shaping (500) of the time-frequency representation at the transient location to amplify an attack of the transient portion.

18. Computer program for performing, when running on a computer or a processor, the method of example 17.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

BIBLIOGRAPHY

[1] K. Brandenburg, "MP3 and AAC explained," in Audio Engineering Society Conference: 17th International Conference: High-Quality Audio Coding, September 1999.

[2] K. Brandenburg and G. Stoll, "ISO/MPEG-1 audio: A generic standard for coding of high-quality digital audio," J. Audio Eng. Soc., vol. 42, pp. 780-792, October 1994.

[3] ISO/IEC 11172-3, "MPEG-1: Coding of moving pictures and associated audio for digital storage media at up to about 1.5 mbit/s—part 3: Audio," international standard, ISO/IEC, 1993. JTC1/SC29/WG11.

[4] ISO/IEC 13818-1, "Information technology—generic coding of moving pictures and associated audio information: Systems," international standard, ISO/IEC, 2000. ISO/IEC JTC1/SC29.

[5] J. Herre and J. D. Johnston, "Enhancing the performance of perceptual audio coders by using temporal noise shaping (TNS)," in 101st Audio Engineering Society Convention, no. 4384, AES, November 1996.

[6] B. Edler, "Codierung von Audiosignalen mit überlappender Transformation and adaptiven Fensterfunktionen," Frequenz-Zeitschrift für Telekommunikation, vol. 43, pp. 253-256, September 1989.

[7] I. Samaali, M. T. H. Alouane, and G. Mahé, "Temporal envelope correction for attack restoration in low bit-rate audio coding," in 17th European Signal Processing Conference (EUSIPCO), (Glasgow, Scotland), IEEE, August 2009.

[8] J. Lapierre and R. Lefebvre, "Pre-echo noise reduction in frequency-domain audio codecs," in 42nd IEEE International Conference on Acoustics, Speech and Signal Processing, pp. 686-690, IEEE, March 2017.

[9] A. V. Oppenheim and R. W. Schafer, Discrete-Time Signal Processing. Harlow, UK: Pearson Education Limited, 3. ed., 2014.

[10] J. G. Proakis and D. G. Manolakis, Digital Signal Processing—Principles, Algorithms, and Applications. New Jersey, U.S.: Pearson Education Limited, 4. ed., 2007.

[11] J. Benesty, J. Chen, and Y. Huang, Springer handbook of speech processing, ch. 7. Linear Prediction, pp. 121-134. Berlin: Springer, 2008.

[12] J. Makhoul, "Spectral analysis of speech by linear prediction," in IEEE Transactions on Audio and Electroacoustics, vol. 21, pp. 140-148, IEEE, June 1973.

[13] J. Makhoul, "Linear prediction: A tutorial review," in Proceedings of the IEEE, vol. 63, pp. 561-580, IEEE, April 2000.

[14] M. Athineos and D. P. W. Ellis, "Frequency-domain linear prediction for temporal features," in IEEE Workshop on Automatic Speech Recognition and Understanding, pp. 261-266, IEEE, November 2003.

[15] F. Keiler, D. Arfib, and U. Zölzer, "Efficient linear prediction for digital audio effects," in COST G-6 Conference on Digital Audio Effects (DAFX-00), (Verona, Italy), December 2000.

[16] J. Makhoul, "Spectral linear prediction: Properties and applications," in IEEE Transactions on Acoustics, Speech, and Signal Processing, vol. 23, pp. 283-296, IEEE, June 1975.

[17] T. Painter and A. Spanias, "Perceptual coding of digital audio," in Proceedings of the IEEE, vol. 88, April 2000.

[18] J. Makhoul, "Stable and efficient lattice methods for linear prediction," in IEEE Transactions on Acoustics, Speech, and Signal Processing, vol. ASSP-25, pp. 423-428, IEEE, October 1977.

[19] N. Levinson, "The wiener rms (root mean square) error criterion in filter design and prediction," Journal of Mathematics and Physics, vol. 25, pp. 261-278, April 1946.

[20] J. Herre, "Temporal noise shaping, quantization and coding methods in perceptual audio coding: A tutorial introduction," in Audio Engineering Society Conference: 17th International Conference: High-Quality Audio Coding, vol. 17, AES, August 1999.

[21] M. R. Schroeder, "Linear prediction, entropy and signal analysis," IEEE ASSP Magazine, vol. 1, pp. 3-11, July 1984.

[22] L. Daudet, S. Molla, and B. Torrésani, "Transient detection and encoding using wavelet coefficient trees," Colloques sur le Traitement du Signal et des Images, September 2001.

[23] B. Edler and O. Niemeyer, "Detection and extraction of transients for audio coding," in Audio Engineering Society Convention 120, no. 6811, (Paris, France), May 2006.

[24] J. Kliewer and A. Mertins, "Audio subband coding with improved representation of transient signal segments," in 9th European Signal Processing Conference, vol. 9, (Rhodes), pp. 1-4, IEEE, September 1998.

[25] X. Rodet and F. Jaillet, "Detection and modeling of fast attack transients," in Proceedings of the International Computer Music Conference, (Havana, Cuba), pp. 30-33, 2001.

[26] J. P. Bello, L. Daudet, S. Abdallah, C. Duxbury, and M. Davies, "A tutorial on onset detection in music signals," IEEE Transactions on Speech and Audio Processing, vol. 13, pp. 1035-1047, September 2005.

[27] V. Suresh Babu, A. K. Malot, V. Vijayachandran, and M. Vinay, "Transient detection for transform domain coders," in Audio Engineering Society Convention 116, no. 6175, (Berlin, Germany), May 2004.

[28] P. Masri and A. Bateman, "Improved modelling of attack transients in music analysis-resynthesis," in International Computer Music Conference, pp. 100-103, January 1996.

[29] M. D. Kwong and R. Lefebvre, "Transient detection of audio signals based on an adaptive comb filter in the frequency domain," in Conference on Signals, Systems and Computers, 2004. Conference Record of the Thirty-Seventh Asilomar, vol. 1, pp. 542-545, IEEE, November 2003.

[30] X. Zhang, C. Cai, and J. Zhang, "A transient signal detection technique based on flatness measure," in 6th International Conference on Computer Science and Education, (Singapore), pp. 310-312, IEEE, August 2011.

[31] J. D. Johnston, "Transform coding of audio signals using perceptual noise criteria," IEEE Journal on Selected Areas in Communications, vol. 6, pp. 314-323, February 1988.

[32] J. Herre and S. Disch, Academic press library in Signal processing, vol. 4, ch. 28. Perceptual Audio Coding, pp. 757-799. Academic press, 2014.

[33] H. Fastl and E. Zwicker, Psychoacoustics—Facts and Models. Heidelberg: Springer, 3. ed., 2007.

[34] B. C. J. Moore, An Introduction to the Psychology of Hearing. London: Emerald, 6. ed., 2012.

[35] P. Dallos, A. N. Popper, and R. R. Fay, The Cochlea. New York: Springer, 1. ed., 1996.

[36] W. M. Hartmann, Signals, Sound, and Sensation. Springer, 5. ed., 2005.

[37] K. Brandenburg, C. Faller, J. Herre, J. D. Johnston, and B. Kleijn, "Perceptual coding of high-quality digital audio," in IEEE Transactions on Acoustics, Speech, and Signal Processing, vol. 101, pp. 1905-1919, IEEE, September 2013.

[38] H. Fletcher and W. A. Munson, "Loudness, its definition, measurement and calculation," The Bell System Technical Journal, vol. 12, no. 4, pp. 377-430, 1933.

[39] H. Fletcher, "Auditory patterns," Reviews of Modern Physics, vol. 12, no. 1, pp. 47-65, 1940.

[40] M. Bosi and R. E. Goldberg, Introduction to Digital Audio Coding and Standards. Kluwer Academic Publishers, 1. ed., 2003.

[41] P. Noll, "MPEG digital audio coding," IEEE Signal Processing Magazine, vol. 14, pp. 59-81, September 1997.

[42] D. Pan, "A tutorial on MPEG/audio compression," IEEE MultiMedia, vol. 2, no. 2, pp. 60-74, 1995.

[43] M. Erne, "Perceptual audio coders "what to listen for"," in 111st Audio Engineering Society Convention, no. 5489, AES, September 2001.

[44] C. M. Liu, H. W. Hsu, and W. Lee, "Compression artifacts in perceptual audio coding," in IEEE Transactions on Audio, Speech, and Language Processing, vol. 16, pp. 681-695, IEEE, May 2008.

[45] L. Daudet, "A review on techniques for the extraction of transients in musical signals," in Proceedings of the Third international conference on Computer Music, pp. 219-232, September 2005.

[46] W. C. Lee and C. C. J. Kuo, "Musical onset detection based on adaptive linear prediction," in IEEE International Conference on Multimedia and Expo, (Toronto, Ontario), pp. 957-960, IEEE, July 2006.

[47] M. Link, "An attack processing of audio signals for optimizing the temporal characteristics of a low bit-rate audio coding system," in Audio Engineering Society Convention, vol. 95, October 1993.

[48] T. Vaupel, Ein Beitrag zur Transformationscodierung von Audiosignalen unter Verwendung der Methode der "Time Domain Aliasing Cancellation (TDAC)" and einer Signalkompandierung im Zeitbereich. Ph.d. thesis, Universitat Duisburg, Duisburg, Germany, April 1991.

[49] G. Bertini, M. Magrini, and T. Giunti, "A time-domain system for transient enhancement in recorded music," in 14th European Signal Processing Conference (EUSIPCO), (Florence, Italy), IEEE, September 2013.

[50] C. Duxbury, M. Sandler, and M. Davies, "A hybrid approach to musical note onset detection," in Proc. of the 5th Int. Conference on Digital Audio Effects (DAFx-02), (Hamburg, Germany), pp. 33-38, September 2002.

[51] A. Klapuri, "Sound onset detection by applying psychoacoustic knowledge," in Proceedings of the IEEE International Conference on Acoustics, Speech, and Signal Processing, March 1999.

[52] S. L. Goh and D. P. Mandic, "Nonlinear adaptive prediction of complex-valued signals by complex-valued PRNN," in IEEE Transactions on Signal Processing, vol. 53, pp. 1827-1836, IEEE, May 2005.

[53] S. Haykin and L. Li, "Nonlinear adaptive prediction of nonstationary signals," in IEEE Transactions on Signal Processing, vol. 43, pp. 526-535, IEEE, February 1995.

[54] D. P. Mandic, S. Javidi, S. L. Goh, and K. Aihara, "Complex-valued prediction of wind profile using augmented complex statistics," in Renewable Energy, vol. 34, pp. 196-201, Elsevier Ltd., January 2009.

[55] B. Edler, "Parametrization of a pre-masking model." Personal communication, Nov. 22, 2016.

[56] ITU-R Recommendation BS.1116-3, "Method for the subjective assessment of small impairments in audio systems," recommendation, International Telecommunication Union, Geneva, Switzerland, February 2015.

[57] ITU-R Recommendation BS.1534-3, "Method for the subjective assessment of intermediate quality level of audio systems," recommendation, International Telecommunication Union, Geneva, Switzerland, October 2015.

[58] ITU-R Recommendation BS.1770-4, "Algorithms to measure audio programme loudness and true-peak audio level," recommendation, International Telecommunication Union, Geneva, Switzerland, October 2015.

[59] S. M. Ross, Introduction to Probability and Statistics for Engineers and Scientists. Elsevier, 3. ed., 2004.

The invention claimed is:

1. An apparatus for post-processing an audio signal, comprising:

a time-spectrum-converter for converting the audio signal into a spectral representation comprising a sequence of spectral frames;

a prediction analyzer for calculating first prediction filter data for a flattening filter characteristic and second prediction filter data for a shaping filter characteristic for a prediction over frequency within a spectral frame;

a shaping filter controlled by the first prediction filter data for the flattening filter characteristic and the second prediction filter data for the shaping filter characteristic for shaping the spectral frame to enhance a transient portion within the spectral frame; and a spectrum-time-converter for converting a sequence of spectral frames comprising a shaped spectral frame into a time domain, wherein the prediction analyzer is configured for calculating an autocorrelation signal, windowing the autocorrelation signal with a window comprising a first time constant to acquire a first result signal, calculating the first prediction filter data from the first result signal, windowing the autocorrelation signal with a window comprising a second time constant to acquire a second result signal, and calculating the second prediction filter data from the second result signal, wherein the second time constant is greater than the first time constant.

2. The apparatus of claim 1, wherein the flattening filter characteristic is an analysis FIR filter characteristic or an all zero filter characteristic resulting, when applied to the spectral frame, in a modified spectral frame comprising a flatter temporal envelope compared to a temporal envelope of the spectral frame; or wherein the shaping filter characteristic is a synthesis IIR filter characteristic or an all pole filter characteristic resulting, when applied to a spectral frame, in a modified spectral frame comprising a less flatter temporal envelope compared to a temporal envelope of the spectral frame.

3. An apparatus for post-processing an audio signal, comprising:

a time-spectrum-converter for converting the audio signal into a spectral representation comprising a sequence of spectral frames;

a prediction analyzer for calculating prediction filter data for a prediction over frequency within a spectral frame;

a shaping filter controlled by the prediction filter data for shaping the spectral frame to enhance a transient portion within the spectral frame; and a spectrum-time-converter for converting a sequence of spectral frames comprising a shaped spectral frame into a time domain, wherein the prediction analyzer is configured:

to calculate an autocorrelation signal from the spectral frame;

to window the autocorrelation signal using a window with a second time constant;

to calculate second prediction filter coefficients from a windowed autocorrelation signal windowed using the second time constant; and wherein the shaping filter is configured to shape the spectral frame using the second prediction filter coefficients, or wherein the prediction analyzer is configured:

to calculate an autocorrelation signal from the spectral frame;

to window the autocorrelation signal using a window with a first time constant and with a second time constant, the second time constant being greater than the first time constant;

to calculate first prediction filter data from a windowed autocorrelation signal windowed using the first time constant and to calculate second prediction filter coefficients from a windowed autocorrelation signal windowed using the second time constant; and wherein the shaping filter is configured to shape the spectral frame using the second prediction filter coefficients and the first prediction filter coefficients.

4. The apparatus of claim 1, wherein the shaping filter comprises a cascade of two controllable sub-filters, a first sub-filter being a flattening filter comprising the flattening filter characteristic and a second sub-filter being a shaping filter comprising the shaping filter characteristic, wherein the two controllable sub-filters are both controlled by the prediction filter data derived by the prediction analyzer, or wherein the shaping filter is a filter comprising a combined filter characteristic derived by combining the flattening filter characteristic and the shaping filter characteristic, wherein the combined filter characteristic is controlled by the prediction filter data derived from the prediction analyzer.

5. An apparatus for post-processing an audio signal, comprising:

a time-spectrum-converter for converting the audio signal into a spectral representation comprising a sequence of spectral frames;

a prediction analyzer for calculating prediction filter data for a prediction over frequency within a spectral frame;

a shaping filter controlled by the prediction filter data for shaping the spectral frame to enhance a transient portion within the spectral frame; and a spectrum-time-converter for converting a sequence of spectral frames comprising a shaped spectral frame into a time domain, wherein the shaping filter comprises a cascade of two controllable sub-filters, a first sub-filter being a flattening filter comprising a flattening filter characteristic and a second sub-filter being a shaping filter comprising a shaping filter characteristic, wherein the two controllable sub-filters are both controlled by the prediction filter data derived by the prediction analyzer, or wherein the shaping filter is a filter comprising a combined filter characteristic derived by combining a flattening filter characteristic and a shaping filter characteristic, wherein the combined filter characteristic is controlled by the prediction filter data derived from the prediction analyzer, and wherein the prediction analyzer is configured to determine the prediction filter data so that using the prediction filter data for the shaping filter results in a degree of shaping being higher than a degree of flattening acquired by the flattening filter characteristic.

6. The apparatus of claim 1, wherein the prediction analyzer is configured to applying a Levinson-Durbin algorithm to a filtered autocorrelation signal derived from the spectral frame.

7. The apparatus of claim 1, wherein the shaping filter is configured to apply a gain compensation so that an energy of a shaped spectral frame is equal to an energy of the spectral frame generated by the time-spectral-converter or is within a tolerance range of ±20% of an energy of the spectral frame.

8. The apparatus of claim 1, wherein the shaping filter is configured to apply theft flattening filter characteristic comprising a flattening gain and the shaping filter characteristic comprising a shaping gain, and wherein the shaping filter is configured to perform a gain compensation for compensating an influence of the flattening gain and the shaping gain.

9. The apparatus of claim 5, wherein the prediction analyzer is configured to calculate a flattening gain and a shaping gain, and wherein the cascade of the two controllable sub-filters furthermore comprises a separate gain stage or a gain function comprised in at least one of the two controllable sub-filters for applying a gain derived from the flattening gain and/or the shaping gain, or wherein the filter comprising the combined characteristic is configured to apply a gain derived from the flattening gain and/or the shaping gain.

10. The apparatus of claim 3, wherein the window comprises a Gaussian window representing an exponential decay filter comprising a time constant as a parameter.

11. The apparatus of claim 1, wherein the prediction analyzer is configured to calculate the prediction filter data for a plurality of frames so that the shaping filter controlled by the prediction filter data performs a signal manipulation for a frame of the plurality of frames comprising a transient portion, and so that the shaping filter does not perform a signal manipulation or performs a signal manipulation being smaller than the signal manipulation for the frame for a further frame of the plurality of frames not comprising a transient portion.

12. The apparatus of claim 1, wherein the spectrum-time converter is configured to apply an overlap-add operation involving at least two adjacent frames of the spectral representation.

13. The apparatus of claim 1, wherein the time-spectrum converter is configured to apply a hop size between 3 and 8 ms or an analysis window comprising a window length between 6 and 16 ms, or wherein the spectrum-time converter is configured to use an overlap range corresponding to an overlap size of overlapping windows or corresponding to a hop size between 3 and 8 ms used by the time-spectrum converter, or to use a synthesis window comprising a window length between 6 and 16 ms, or wherein the analysis window and the synthesis window are identical to each other.

14. The apparatus of claim 1, wherein the flattening filter characteristic is an inverse filter characteristic resulting, when applied to the spectral frame, in a modified spectral frame comprising a flatter temporal envelope compared to a temporal envelope of the spectral frame; or wherein the shaping filter characteristic is a synthesis filter characteristic resulting, when applied to a spectral frame, in a modified spectral frame comprising a less flatter temporal envelope compared to a temporal envelope of the spectral frame.

15. The apparatus of claim 1, wherein the prediction analyzer is configured to calculate prediction filter data for a shaping filter characteristic, and wherein the shaping filter is configured to filter the spectral frame as acquired by the time-spectrum converter.

16. The apparatus of claim 1, wherein the shaping filter is configured to represent a shaping action in accordance with a time envelope of the spectral frame with a maximum or a less than maximum time resolution, and wherein the shaping filter is configured to represent no flattening action or a flattening action in accordance with a time resolution being smaller than the time resolution associated with the shaping action.

17. A method for post-processing an audio signal, comprising:

converting the audio signal into a spectral representation comprising a sequence of spectral frames;

calculating first prediction filter data for a flattening filter characteristic and second prediction filter data for a shaping filter characteristic for a prediction over frequency within a spectral frame;

shaping, in response to the prediction filter data, the spectral frame using the first prediction filter data for the flattening filter characteristic and the second prediction filter data for the shaping filter characteristic to enhance a transient portion within the spectral frame; and converting a sequence of spectral frames comprising a shaped spectral frame into a time domain, wherein the calculating comprises:

calculating an autocorrelation signal, windowing the autocorrelation signal with a window comprising a first time constant to acquire a first result signal, calculating the first prediction filter data from the first result signal, windowing the autocorrelation signal with a window comprising a second time constant to acquire a second result signal, and calculating the second prediction filter data from the second result signal, wherein the second time constant is greater than the first time constant.

18. A non-transitory digital storage medium having stored thereon a computer program for performing a method for post-processing an audio signal, comprising:

converting the audio signal into a spectral representation comprising a sequence of spectral frames;

calculating first prediction filter data for a flattening filter characteristic and second prediction filter data for a shaping filter characteristic for a prediction over frequency within a spectral frame;

shaping, in response to the prediction filter data, the spectral frame using the first prediction filter data for the flattening filter characteristic and the second prediction filter data for the shaping filter characteristic to enhance a transient portion within the spectral frame; and converting a sequence of spectral frames comprising a shaped spectral frame into a time domain, wherein the calculating comprises:

calculating an autocorrelation signal, windowing the autocorrelation signal with a window comprising a first time constant to acquire a first result signal, calculating the first prediction filter data from the first result signal, windowing the autocorrelation signal with a window comprising a second time constant to acquire a second result signal, and calculating the second prediction filter data from the second result signal, wherein the second time constant is greater than the first time constant, when said computer program is run by a computer.

19. A method for post-processing an audio signal, comprising:

converting the audio signal into a spectral representation comprising a sequence of spectral frames;

calculating prediction filter data for a prediction over frequency within a spectral frame;

shaping, in response to the prediction filter data, the spectral frame to enhance a transient portion within the spectral frame; and converting a sequence of spectral frames comprising a shaped spectral frame into a time domain, wherein the calculating comprises calculating an autocorrelation signal from the spectral frame; windowing the autocorrelation signal using a window with a second time constant; calculating second prediction filter coefficients from a windowed autocorrelation signal windowed using the second time constant; and wherein the shaping comprises shaping the spectral frame using the second prediction filter coefficients, or wherein the calculating comprises calculating an autocorrelation signal from the spectral frame; windowing the autocorrelation signal using a window with a first time constant and with a second time constant, the second time constant being greater than the first time constant; calculating first prediction filter data from a windowed autocorrelation signal windowed using the first time constant and calculating second prediction filter coefficients from a windowed autocorrelation signal windowed using the second time constant; and wherein the shaping comprises shaping the spectral frame using the second prediction filter coefficients and the first prediction filter coefficients, or wherein the shaping comprises using a cascade of two controllable sub-filters, a first sub-filter being a flattening filter comprising a flattening filter characteristic and a second sub-filter being a shaping filter comprising a shaping filter characteristic, wherein the two controllable sub-filters are both controlled by the prediction filter data, or wherein the shaping comprises using a filter comprising a combined filter characteristic derived by combining a flattening filter characteristic and a shaping filter characteristic, wherein the combined filter characteristic is controlled by the prediction filter data, and wherein the calculating comprises determining the prediction filter data so that using the prediction filter data results in a degree of shaping being higher than a degree of flattening acquired by the flattening filter characteristic.

20. A non-transitory digital storage medium having stored thereon a computer program for performing a method for post-processing an audio signal, comprising:

converting the audio signal into a spectral representation comprising a sequence of spectral frames;

calculating prediction filter data for a prediction over frequency within a spectral frame;

shaping, in response to the prediction filter data, the spectral frame to enhance a transient portion within the spectral frame; and converting a sequence of spectral frames comprising a shaped spectral frame into a time domain, wherein the calculating comprises calculating an autocorrelation signal from the spectral frame; windowing the autocorrelation signal using a window with a second time constant; calculating second prediction filter coefficients from a windowed autocorrelation signal windowed using the second time constant; and wherein the shaping comprises shaping the spectral frame using the second prediction filter coefficients, or wherein the calculating comprises calculating an autocorrelation signal from the spectral frame; windowing the autocorrelation signal using a window with a first time constant and with a second time constant, the second time constant being greater than the first time constant; calculating first prediction filter data from a windowed autocorrelation signal windowed using the first time constant and calculating second prediction filter coefficients from a windowed autocorrelation signal windowed using the second time constant; and wherein the shaping comprises shaping the spectral frame using the second prediction filter coefficients and the first prediction filter coefficients, or wherein the shaping comprises using a cascade of two controllable sub-filters, a first sub-filter being a flattening filter comprising a flattening filter characteristic and a second sub-filter being a shaping filter comprising a shaping filter characteristic, wherein the two controllable sub-filters are both controlled by the prediction filter data, or wherein the shaping comprises using a filter comprising a combined filter characteristic derived by combining a flattening filter characteristic and a shaping filter characteristic, wherein the combined filter characteristic is controlled by the prediction filter data, and wherein the calculating comprises determining the prediction filter data so that using the prediction filter data results in a degree of shaping being higher than a degree of flattening acquired by the flattening filter characteristic, when said computer program is run by a computer.

* * * * *